US008273510B2

(12) United States Patent
Nukada et al.

(10) Patent No.: US 8,273,510 B2
(45) Date of Patent: Sep. 25, 2012

(54) ELECTROPHOTOGRAPHIC PHOTORECEPTOR, PROCESS CARTRIDGE AND IMAGE FORMING APPARATUS

(75) Inventors: Katsumi Nukada, Kanagawa (JP); Wataru Yamada, Kanagawa (JP); Tsuyoshi Miyamoto, Kanagawa (JP); Kenya Sonobe, Kanagawa (JP); Takatsugu Doi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 231 days.

(21) Appl. No.: 12/877,671

(22) Filed: Sep. 8, 2010

(65) Prior Publication Data

US 2011/0195354 A1 Aug. 11, 2011

(30) Foreign Application Priority Data

Feb. 10, 2010 (JP) ..... 2010-027775

(51) Int. Cl.
*G03G 5/00* (2006.01)

(52) U.S. Cl. ..... 430/58.05; 430/58.65; 430/66

(58) Field of Classification Search ..... 430/58.05, 430/58.65, 66; 399/159
See application file for complete search history.

(56) References Cited

U.S. PATENT DOCUMENTS

| | | | |
|---|---|---|---|
| 5,283,145 | A | 2/1994 | Nukada et al. |
| 5,290,928 | A | 3/1994 | Nukada et al. |
| 5,298,617 | A | 3/1994 | Nukada et al. |
| 5,302,479 | A | 4/1994 | Daimon et al. |
| 5,308,728 | A | 5/1994 | Imai et al. |
| 5,338,636 | A | 8/1994 | Nukada et al. |
| 5,358,813 | A | 10/1994 | Iijima et al. |
| 5,378,569 | A | 1/1995 | Nukada et al. |
| 5,393,629 | A | 2/1995 | Nukada et al. |
| 5,411,827 | A | 5/1995 | Tamura et al. |
| 5,416,207 | A | 5/1995 | Imai et al. |
| 5,427,880 | A | 6/1995 | Tamura et al. |
| 5,459,004 | A | 10/1995 | Daimon et al. |

(Continued)

FOREIGN PATENT DOCUMENTS

JP A-4-189873 7/1992

(Continued)

OTHER PUBLICATIONS

Tanaka et al., "Hybrid Sol-gel Coating with Dispersed Fluoropolymer Latex," Proceedings of 8$^{th}$ Polymeric Material Forum Lecture, Oct. 13, 1999, p. 89, The Society of Polymer Science, Japan (with partial translation).

*Primary Examiner* — Mark A Chapman
(74) *Attorney, Agent, or Firm* — Oliff & Berridge, PLC

(57) ABSTRACT

The present invention provides an electrophotographic photoreceptor including a photosensitive layer on a conductive substrate, an outermost layer of the electrophotographic photoreceptor including a cured film of a composition which includes at least one charge transporting compound (a) having a charge transporting skeleton and at least two structural units represented by R—O—CO—CR'═CH—R" in the same molecule, and at least one polycarbonate resin; a ratio ($I_A/I_C$) of an absorption peak intensity ($I_A$) resulting from stretching vibration of a carbonyl group originating from the structural unit represented by R—O—CO—CR'═CH—R" of the charge transporting compound (a) to an absorption peak intensity ($I_C$) resulting from stretching vibration of a carbonyl group originating from the polycarbonate resin in an IR absorption spectrum of the outermost layer being from about 0.5 to about 10, and a width at half maximum of the absorption peak of the absorption peak intensity ($I_A$) being about 25 cm$^{-1}$ or more.

11 Claims, 7 Drawing Sheets

U.S. PATENT DOCUMENTS

| | | | |
|---|---|---|---|
| 5,463,043 | A | 10/1995 | Nukada et al. |
| 5,496,671 | A | 3/1996 | Tamura et al. |
| 5,639,581 | A | 6/1997 | Iwasaki et al. |
| 5,654,119 | A | 8/1997 | Ishii et al. |
| 5,734,003 | A | 3/1998 | Iwasaki et al. |
| 6,416,915 | B1 | 7/2002 | Kikuchi et al. |
| 2004/0043312 | A1 | 3/2004 | Kikuchi et al. |
| 2004/0248024 | A1 | 12/2004 | Suzuki et al. |
| 2004/0253527 | A1 | 12/2004 | Suzuki et al. |
| 2005/0181292 | A1 | 8/2005 | Fujii et al. |
| 2007/0122724 | A1 | 5/2007 | Suzuki et al. |
| 2007/0154828 | A1 | 7/2007 | Fujii et al. |
| 2007/0178400 | A1 | 8/2007 | Kikuchi et al. |
| 2008/0020305 | A1 | 1/2008 | Suzuki et al. |

FOREIGN PATENT DOCUMENTS

| | | |
|---|---|---|
| JP | A-5-40360 | 2/1993 |
| JP | A-5-98181 | 4/1993 |
| JP | A-5-140472 | 6/1993 |
| JP | A-5-140473 | 6/1993 |
| JP | A-5-216249 | 8/1993 |
| JP | A-5-263007 | 10/1993 |
| JP | A-5-279591 | 10/1993 |
| JP | A-5-323630 | 12/1993 |
| JP | A-7-72640 | 3/1995 |
| JP | A-8-176293 | 7/1996 |
| JP | A-8-208820 | 8/1996 |
| JP | A-11-52603 | 2/1999 |
| JP | A-2000-206715 | 7/2000 |
| JP | A-2000-206717 | 7/2000 |
| JP | A-2000-264961 | 9/2000 |
| JP | A-2001-166510 | 6/2001 |
| JP | A-2001-175016 | 6/2001 |
| JP | A-2004-12986 | 1/2004 |
| JP | A-2004-78147 | 3/2004 |
| JP | A-2004-302450 | 10/2004 |
| JP | A-2005-181992 | 7/2005 |
| JP | A-2007-86522 | 4/2007 |

ELECTROPHOTOGRAPHIC PHOTORECEPTOR, PROCESS CARTRIDGE AND IMAGE FORMING APPARATUS

CROSS-REFERENCE TO RELATED APPLICATION

This application is based on and claims priority under 35 USC 119 from Japanese Patent Application No. 2010-027775 filed Feb. 10, 2010.

BACKGROUND

1. Technical Field

The present invention relates to an electrophotographic photoreceptor, a process cartridge and an image forming apparatus.

2. Related Art

Recently, a protective layer based on acrylic materials has been getting much attention.

SUMMARY

According to an aspect of the invention, an electrophotographic photoreceptor including a photosensitive layer on a conductive substrate, an outermost layer of the electrophotographic photoreceptor including a cured film of a composition which includes at least one charge transporting compound (a) having a charge transporting skeleton and at least two structural units represented by R—O—CO—CR'═CH—R" in the same molecule, and at least one polycarbonate resin; wherein a ratio ($I_A/I_C$) of an absorption peak intensity ($I_A$) resulting from stretching vibration of a carbonyl group originating from the structural unit represented by R—O—CO—CR'═CH—R" of the charge transporting compound (a) to an absorption peak intensity ($I_C$) resulting from stretching vibration of a carbonyl group originating from the polycarbonate resin in an IR absorption spectrum of the outermost layer is from about 0.5 to about 10, and a width at half maximum of the absorption peak of the absorption peak intensity ($I_A$) is about 25 $cm^{-1}$ or more, wherein either R or R' is bonded to the charge transporting skeleton; wherein, in a case in which R is bonded to the charge transporting skeleton, R represents a single bond or a divalent linking group which may have a substituent group, and R' represents a hydrogen atom or an alkyl group which may have a substituent group; wherein, in a case in which R' is bonded to the charge transporting skeleton, R' represents a divalent linking group which may have a substituent group, and R represents a hydrogen atom or an alkyl group which may have a substituent group; R" represents a hydrogen atom or an alkyl group which may have a substituent group; wherein the divalent linking group represented by R or R' is selected from the group consisting of an alkylene group, an arylene group, —O—, —COO—, —CO— and a combination thereof; and wherein the substituent group is selected from the group consisting of an alkyl group, an alkoxy group, an ester group, and an acyl group is provided.

BRIEF DESCRIPTION OF THE DRAWINGS

Exemplary embodiments of the invention will be described in detail based on the following figures, wherein.

DETAILED DESCRIPTION

Figure 1:
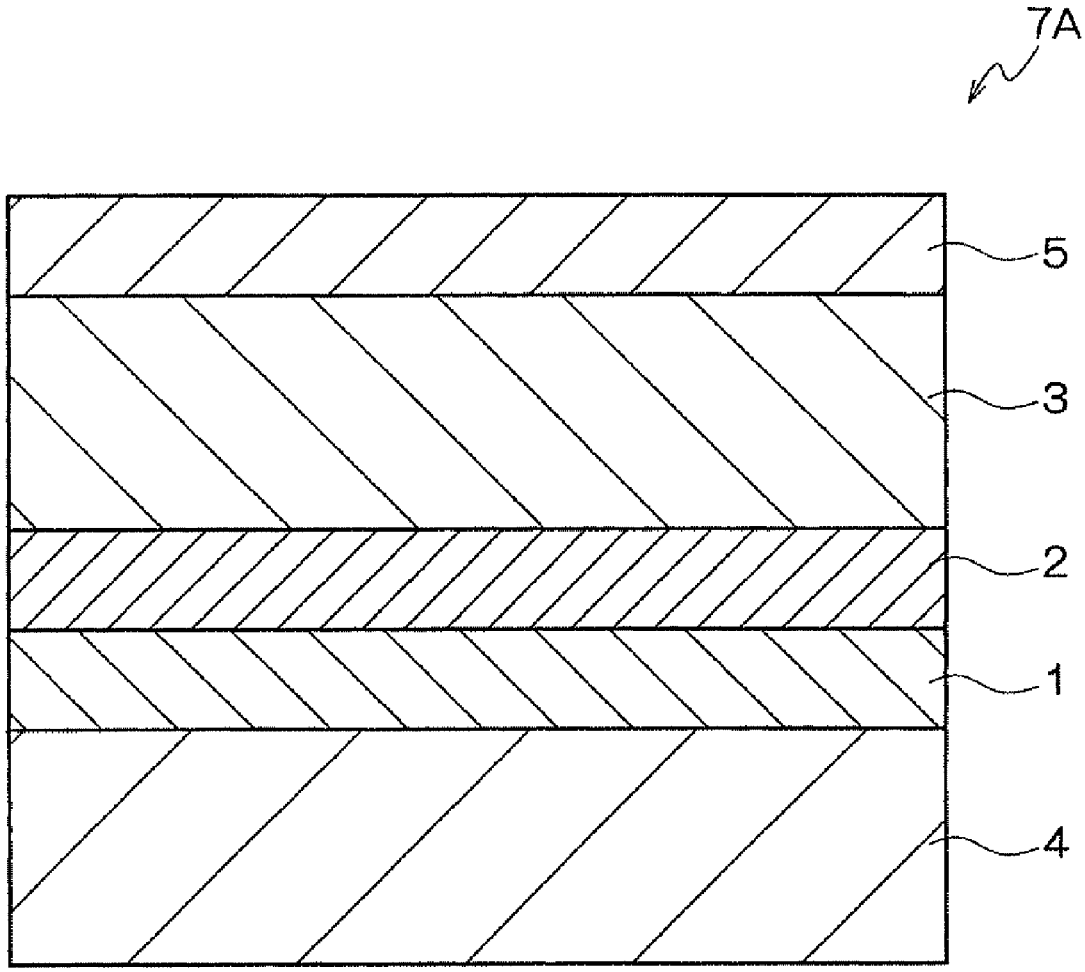
FIG. 1 is a partial cross-sectional view illustrating a preferred exemplary embodiment of an electrophotographic photoreceptor of the invention.

Exemplary embodiments according to the aspect of the invention include, but are not limited to the following items <1> to <11>.

<1> An electrophotographic photoreceptor including a photosensitive layer on a conductive substrate, an outermost layer of the electrophotographic photoreceptor including a cured film of a composition which includes at least one charge transporting compound (a) having a charge transporting skeleton and at least two structural units represented by R—O—CO—CR'═CH—R" in the same molecule, and at least one polycarbonate resin; wherein a ratio ($I_A/I_C$) of an absorption peak intensity ($I_A$) resulting from stretching vibration of a carbonyl group originating from the structural unit represented by R—O—CO—CR'═CH—R" of the charge transporting compound (a) to an absorption peak intensity ($I_C$) resulting from stretching vibration of a carbonyl group originating from the polycarbonate resin in an IR absorption spectrum of the outermost layer is from 0.5 or about 0.5 to 10 or about 10, and a width at half maximum of the absorption peak of the absorption peak intensity ($I_A$) is 25 or about 25 $cm^{-1}$ or more, wherein either R or R' is bonded to the charge transporting skeleton; wherein, in a case in which R is bonded to the charge transporting skeleton, R represents a single bond or a divalent linking group which may have a substituent group, and R' represents a hydrogen atom or an alkyl group which may have a substituent group; wherein, in a case in which R' is bonded to the charge transporting skeleton, R' represents a divalent linking group which may have a substituent group, and R represents a hydrogen atom or an alkyl group which may have a substituent group; R" represents a hydrogen atom or an alkyl group which may have a substituent group; wherein the divalent linking group represented by R or R' is selected from the group consisting of an alkylene group, an arylene group, —O—, —COO—, —CO— and a combination thereof; and wherein the substituent group is selected from the group consisting of an alkyl group, an alkoxy group, an ester group, and an acyl group.

<2> The electrophotographic photoreceptor according to the item <1>, wherein the outermost layer of the electrophotographic photoreceptor includes a cured film of a composition excluding a compound (c) without the charge transporting skeleton and having the at least two structural units represented by R—O—CO—CR'═CH—R".

<3> The electrophotographic photoreceptor according to the item <1> or the item <2>, wherein the charge transporting compound (a) includes three or more of the structural units represented by R—O—CO—CR'═CH—R" in the same molecule.

<4> The electrophotographic photoreceptor according to any one of the items <1> to <3>, wherein the charge transporting compound (a) includes four or more of the structural units represented by R—O—CO—CR'═CH—R" in the same molecule.

<5> The electrophotographic photoreceptor according to any one of the items <1> to <4>, wherein the outermost layer of the electrophotographic photoreceptor includes a cured film of a composition further comprising a compound (b) having the charge transporting skeleton and having no radical-polymerizable unsaturated double bond.

<6> The electrophotographic photoreceptor according to any one of the items <1> to <5>, wherein the composition further includes another charge transporting compound having the charge transporting skeleton and only one of the structural unit represented by R—O—CO—CR'═CH—R" in the same molecule.

<7> The electrophotographic photoreceptor according to any one of the items <1> to <6>, wherein the charge transporting skeleton is derived from a nitrogen-containing compound selected from the group consisting of a triarylamine-based compound, a benzidine-based compound and a hydrazone-based compound.

<8> The electrophotographic photoreceptor according to any one of the items <1> to <7>, wherein the charge transporting compound (a) includes a skeleton derived from a triphenylamine and four or more methacryloyl groups in the same molecule.

<9> The electrophotographic photoreceptor according to any one of the items <1> to <8>, wherein the charge transporting compound (a) is represented by the following Formula (A):

Formula (A)

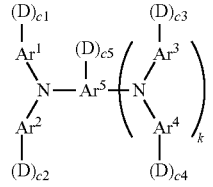

wherein, in the formula (A), $Ar^1$, $Ar^2$, $Ar^3$, and $Ar^4$ each independently represent a substituted or unsubstituted aryl group; $Ar^5$ represents a substituted or unsubstituted aryl group or a substituted or unsubstituted arylene group; D represents a group having the structural unit represented by R—O—CO—CR'═CH—R" in a terminal of the group; c1, c2, c3, c4, c5 each independently represent an integer of 0, 1 or 2; k represents an integer of 0 or 1; and the total number of D is 2 or more.

<10> An image forming apparatus including: the electrophotographic photoreceptor according to any one of the items <1> to <9>, a charging unit that charges a surface of the electrophotographic photoreceptor; an exposing unit that forms an electrostatic latent image at the surface of the charged electrophotographic photoreceptor by exposure to light; a developing unit that develops the electrostatic latent image formed at the electrophotographic photoreceptor by a developer to form a toner image; and a transfer unit that transfers the toner image to a transfer-receiving medium.

<11> A process cartridge which includes the electrophotographic photoreceptor according to any one of the items <1> to <9>, and is attachable to and detachable from an image forming apparatus.

Electrophotographic Photoreceptor

In regard to an electrophotographic photoreceptor of this exemplary embodiment, the outermost layer of the electrophotographic photoreceptor having a photosensitive layer on a conductive layer is a cured film of a composition containing at least one charge transporting compound (a) having a charge transporting skeleton and at least two structures represented by R—O—CO—CR'═CH—R" in the same molecule and at least one polycarbonate resin. In addition, in an IR absorption spectrum of the outermost layer, the ratio ($I_A/I_C$) between absorption peak intensity ($I_C$) resulting from stretching vibration of a carbonyl group originating from the polycarbonate resin and absorption peak intensity ($I_A$) resulting from stretching vibration of a carbonyl group originating from the charge transporting compound (a) represented by R—O—CO—CR'═CH—R" is from 0.5 or about 0.5 to 10 or about 10, and a width at half maximum of the absorption peak of the absorption peak intensity ($I_A$) is 25 $cm^{-1}$ or about 25 $cm^{-1}$ or more.

According to said embodiment, the outermost layer having both good electrical characteristics and sufficient film strength may be formed. In particular, a thick film having a thickness, for example, up to 10 μm may be formed. As a result, deterioration in image quality after repetitive use is suppressed. Since the lifetime of a photoreceptor is determined by worn-out state of a surface layer having a high strength, thickening a film is very effective for achieving a long lifetime.

Further, since an organic photoreceptor is discharged to be charged before use, deterioration in surface material occurs due to electrical stress and stress attributable to a discharge gas such as ozone. As a result, the organic photoreceptor becomes prone to adsorb ionic materials such as ammonium nitrate which are called discharge products thereon. In particular, with moisture adsorption under highly humid condition, surface resistance is lowered and a latent image blur occurs. As a result, an image degradation is likely to occur in a printed image. In order to suppress them, in general the outermost is suitably abraded so as to suppress the latent image blur. The amount of abrasion is affected by charging method, cleaning method and toner shape, etc., thus varies depending on specific method employed. As such, it is preferable that the strength of the outermost layer of a photoreceptor be able to be controlled according to the employed method. Herein, by using a polycarbonate resin in combination with the charge transporting compound (a) in the outermost layer and setting the absorption peak intensity resulting from stretching vibration, that is shown in IR absorption spectrum, to be within the range described above, the strength of the outermost layer may be controlled. Although it is assumed that the outermost layer having both good electrical characteristics and sufficient strength can be obtained for the following reasons, the invention is not limited to the assumption.

The polycarbonate resin is excellent in electrical characteristics because it has a relatively small number of polar groups that prevent carrier transport. By incorporating the polycarbonate resin with such characteristics in combination with the charge transporting compound (a) in the outermost layer, adjusting the blending ratio between the polycarbonate resin and the charge transporting compound (a) so as for a value of the ratio $I_A/I_C$ to be within a range of 0.5 or about 0.5 to 10 or about 10, and preparing a composition so as to have the width at half maximum of the absorption peak of the absorption peak intensity ($I_A$) resulting from stretching vibration of the carbonyl group originating from the charge transporting compound (a) to be 25 $cm^{-1}$ or about 25 $cm^{-1}$ or more, miscibility between the polycarbonate resin and the charge transporting compound (a) is enhanced. As a result, it becomes easier to control the viscosity of a solution that is used for forming the outermost layer, and a layer having a large thickness is obtained. Consequently, the outermost layer having excellent both electrical characteristics and sufficient strength can be obtained.

In particular, it is evident that, as the width at half maximum of the absorption peak of the absorption peak intensity ($I_A$) increases, a film having excellent electrical characteristics and sufficient strength is obtained because interaction with other functional groups is strengthened in the outermost layer and the mixing state of the charge transporting compound (a) is improved. Specifically, in a case in which the width at half maximum of the absorption peak of the absorption peak intensity ($I_A$) is 25 $cm^{-1}$ or about 25 $cm^{-1}$ or more, a film having excellent electrical characteristics and mechanical strength is obtained. The width at half maximum of the absorption peak of the absorption peak intensity ($I_A$) is controlled by the structure of a charge transporting compound having functional groups, the blending ratio relative to the polycarbonate resin, type of a polymerization initiator, and polymerization condition. It is believed that the state of the carbonyl group in a cured film changes according to the condition, resulting in the increasing in the width at half maximum of the absorption peak.

Furthermore, by using at least one charge transporting compound (a) and at least one polycarbonate resin, so called Interpenetrating Polymer Network (IPN) state in which the charge transporting compound (a) and the polycarbonate resin are admixed with each other is formed. As a result, volume shrinkage during curing reaction for forming a layer is effectively inhibited, thereby yielding an electrophotographic photoreceptor with suppressed surface roughness.

Furthermore, in a case in which the requirements described above are satisfied, excellent miscibility between the charge transporting compound (a) and the polycarbonate resin is obtained. Thus, as a third component, a charge transporting compound (b) having no reactive group may be also admixed, and therefore the electrical characteristics can be further improved.

Furthermore, in a case in which the requirements described above are satisfied, excellent miscibility between the charge transporting compound (a) and the polycarbonate resin is obtained. Thus, an additional binder resin other than the polycarbonate resin may be also admixed, and therefore the gas barrier characteristic and adhesiveness can be improved.

Herein below, the charge transporting compound (a) having a charge transporting skeleton and at least two structures represented by R—O—CO—CR'═CH—R" in the same molecule may also be referred to as reactive charge transporting material (a).

The electrophotographic photoreceptor related to this exemplary embodiment includes an outermost layer formed from a cured film of a composition containing the reactive charge transporting material (a) and the polycarbonate resin. In this regard, it is sufficient that the outermost layer forms the uppermost layer of the electrophotographic photoreceptor itself, and serves as a protective layer or a charge transporting layer.

Furthermore, in a case in which the outmost layer is a layer serving as a protective layer, a photosensitive layer composed of a charge transporting layer and a charge generating layer, or a monolayer type photosensitive layer will be provided as an underlying of the protective layer.

Meanwhile, in a case in which the outmost layer is a layer serving as a protective layer, an exemplary structure is configured such that a photosensitive layer and a protective layer are provided on a conductive substrate as the outermost layer, and the protective layer is formed from a cured film of a composition containing the reactive charge transporting material (a) and the polycarbonate resin.

Furthermore, in a case in which the outmost layer is a layer which functions as a charge transporting layer, a structure in which a charge generating layer and a charge transporting layer as the outermost layer are established on a conductive substrate and the charge transporting layer consists of a cured film of a composition including the reactive charge transporting material (a) and the polycarbonate resin can be exemplified.

Herein below, the electrophotographic photoreceptor of an exemplary embodiment of the invention wherein the outmost layer is a layer serving as a protective layer will be explained in greater detail with reference to the drawings. In addition, in the drawings, identical symbols are given for the same or the corresponding portions and the repetitive description will not be given.

Figure 2:
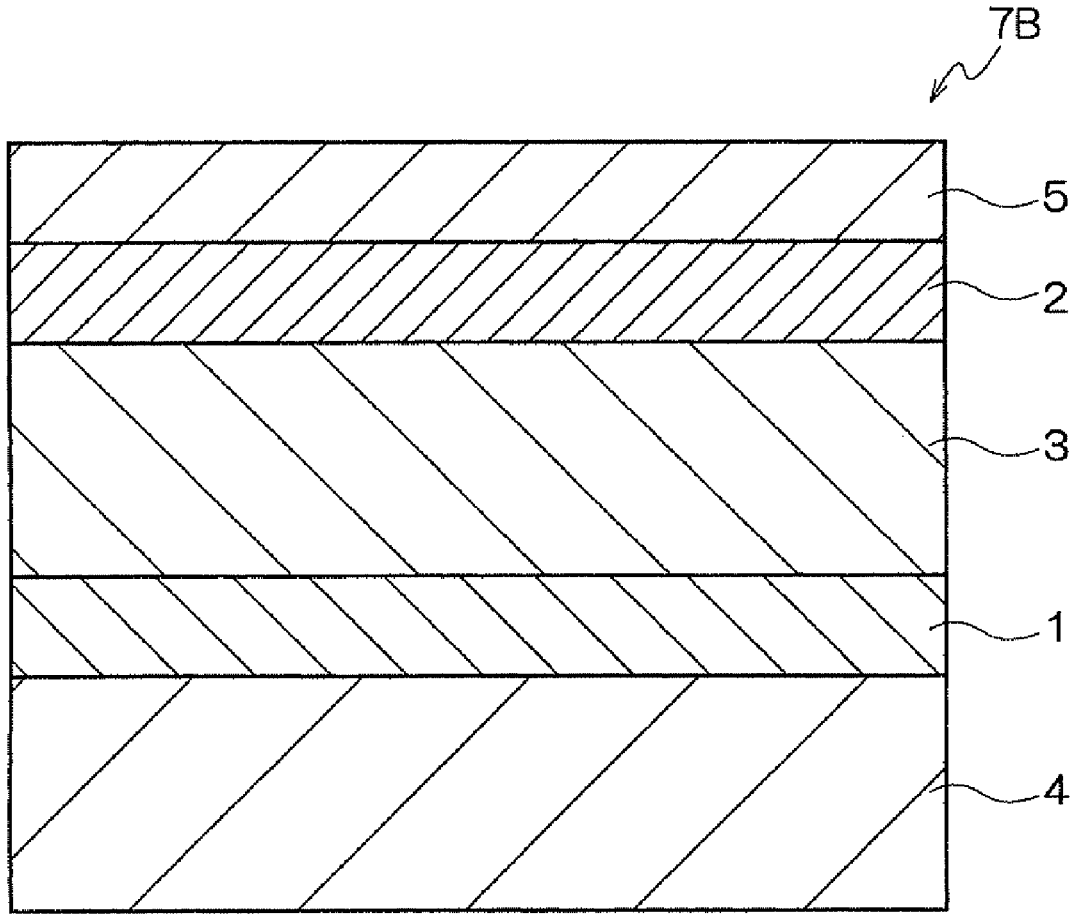
FIG. 2 is a partial cross-sectional view illustrating another preferred exemplary embodiment of an electrophotographic photoreceptor of the invention.
Figure 3:
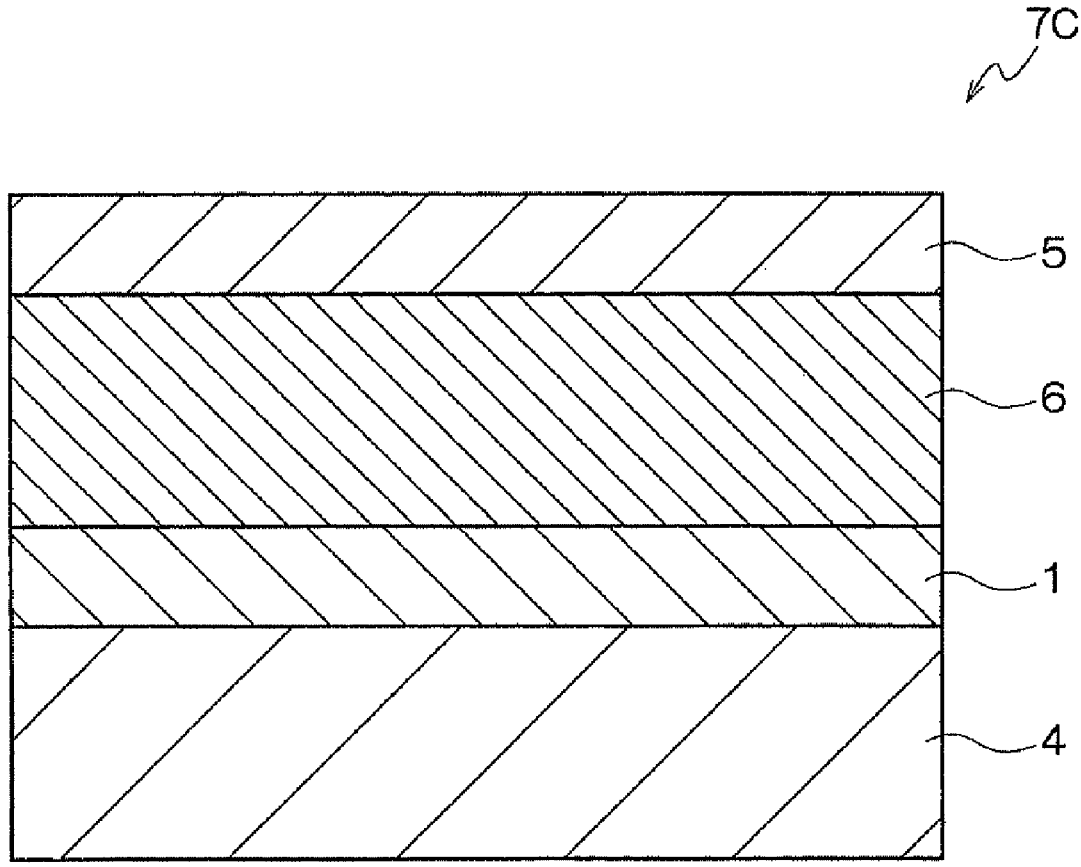
FIG. 3 is a partial cross-sectional view illustrating still another preferred exemplary embodiment of an electrophotographic photoreceptor of the invention.

FIG. 1 is a typical cross sectional drawing showing a preferred embodiment of the electrophotographic photoreceptor of this embodiment. FIGS. 2 and 3 are typical cross sectional drawings of the electrophotographic photoreceptors of other embodiments.

Electrophotographic photoreceptor 7A shown in FIG. 1 is what is called a function separating type photoreceptor (or a lamination type photoreceptor) having a structure comprising conductive substrate 4 having thereon undercoating layer 1, and having formed thereon charge-generating layer 2, charge transporting layer 3, and protective layer 5 in order. In electrophotographic photoreceptor 7A, a photosensitive layer is comprised of charge generating layer 2 and charge transporting layer 3.

Electrophotographic photoreceptor 7B shown in FIG. 2 is a function separating type photoreceptor similar to electrophotographic photoreceptor 7A shown in FIG. 1, wherein the functions are separated to charge generating layer 2 and charge transporting layer 3. Electrophotographic photoreceptor 7B shown in FIG. 2 has a structure comprising conductive substrate 4 having thereon undercoating layer 1, and having formed thereon charge transporting layer 3, charge generating layer 2, and protective layer 5 in order. In electrophotographic photoreceptor 7B, a photosensitive layer is comprised of charge transporting layer 3 and charge generating layer 2.

Electrophotographic photoreceptor 7C includes a charge generating material and a charge transporting material in a same layer (monolayer type photosensitive layer 6). Electrophotographic photoreceptor 7C shown in FIG. 3 has a structure comprising conductive substrate 4 having thereon undercoating layer 1, and having formed thereon monolayer type photosensitive layer 6 and protective layer 5 in order.

Further, regarding each of the electrophotographic photoreceptors 7A, 7B and 7C shown in FIGS. 1, 2 and 3, respectively, a protective layer 5 is the outermost layer which is positioned farthest from conductive substrate 2, and the outermost layer is configured as described in the above.

Further, regarding each of the electrophotographic photoreceptor 7A, 7B and 7C that are shown in FIGS. 1, 2 and 3, respectively, an underlying layer 1 may or may not be formed.

Herein below, based on the electrophotographic photoreceptor 7A that is shown in FIG. 1 as a representative example, each element will be explained.

<Protective Layer>

First, a protective layer 5, which is the outermost layer of electrophotographic photoreceptor 7A, will be explained.

The protective layer 5 is the outermost layer of the electrophotographic photoreceptor 7A and it is a cured film of a composition containing the reactive charge transporting material (a) and the polycarbonate resin.

First, the reactive charge transporting material (a) will be explained.

(Reactive Charge Transporting Material (a))

The reactive charge transporting material (a), which is used for the protective layer (the outermost layer) 5, is a compound having a charge transporting skeleton and at least two structures represented by R—O—CO—CR'═CH—R" in the same molecule. As far as these requirements are satisfied, any compound can be freely used.

Next, the structure represented by R—O—CO—CR'═CH—R" will be explained.

With respect to R—O—CO—CR'═CH—R", either R or R' is bonded to the charge transporting skeleton. In a case in which R is bonded to the charge transporting skeleton, R represents a single bond or a divalent linking group which may have a substituent group and R' represents a hydrogen atom or an alkyl group which may have a substituent group. Meanwhile, in a case in which R' is bonded to the charge transporting skeleton, R' represents a divalent linking group which may have a substituent group and R represents a hydrogen atom or an alkyl group which may have a substituent group. R" represents a hydrogen atom or an alkyl group which may have a substituent group.

The divalent linking group represented by R or R' above represents a group that is selected from the group consisting of an alkylene group, an arylene group, —O—, —COO—, —CO—group and combinations thereof.

The alkylene group represented by R or R' preferably has 1 to 12 carbon atoms, more preferably has 1 to 10 carbon atoms.

The arylene group represented by R or R' preferably has 6 to 20 carbon atoms, more preferably has 6 to 15 carbon atoms. Specifically, phenylene, naphthalenediyl, anthracenediyl and the like can be mentioned.

The divalent linking group represented by R or R' above may have a substituent group, which represents a group that is selected from the group consisting of an alkyl group, an alkoxy group, an ester group (an alkoxycarbonyl group, an aryloxycarbonyl group, or an acyloxy group) and an acyl group.

Each of the alkyl group, alkoxy group, and acyl group, serving as the substituent group for the divalent linking group, preferably has 1 to 12 carbon atoms, more preferably has 1 to 10 carbon atoms.

In a case in which the divalent linking group represented by R or R' above is a combination of two or more kinds selected from the group consisting of an alkylene group, an arylene group, —O—, —COO—, and —CO— group, examples thereof include —O—$R^1$—, —CO—$R^1$—, —R'—CO—$R^1$—, —COO—$R^1$—, —$R^1$—COO—$R^1$—, —OCO—R'—, and —R'—OCO—R'—. Herein, $R^1$ each independently represents an alkylene group or an arylene group.

The alkyl group represented by R, R' or R" preferably has a carbon number of 1 to 12, more preferably 1 to 10.

The alkyl group represented by R, R' or R" above may have a substituent group, which represents a group that is selected from the group consisting of an alkyl group, an alkoxy group, an ester group (—COO—, —COO—) and an acyl group.

Preferably, as for R—O—CO—CR'═CH—R", R is bonded to the charge transporting skeleton and represents a single bond or a divalent linking group which may have a substituent group, and R' represents a hydrogen atom or an alkyl group which may have a substituent group. More preferably, R represents a divalent linking group which may have a substituent group and R' represents an alkyl group which may have a substituent group. Still more preferably, R represents a divalent linking group which may have a substituent group and R' represents an alkyl group having 1 to 10 carbon atoms which may have a substituent group.

In particular, it is preferable that R—O—CO—CR'═CH—R" is a structure having a methacryloyl group. Specifically, it is preferable that R is bonded to the charge transporting skeleton, R" is a hydrogen atom, and R' is a methyl group. Although not clearly identified, the reason is presumably as follows.

In general, a highly reactive acrylic group is used for curing reaction. However, in a case in which a highly reactive acryloyl group is employed as a substituent group on a bulky charge transporting skeleton, non-homogeneous curing reaction may easily occur, and it is believed that a micro (or macro) sea island structure is likely to be formed. The sea island structure rarely causes a problem except electronics field. However in a case in which used as an electrophotographic photoreceptor, heterogeneity and wrinkles are prone to occur in the outermost layer. Furthermore, a region having different charge transporting property may be formed macroscopically, and as a result a problem such as image heterogeneity arises. Furthermore, it is believed that formation of the sea island structure is particularly noticeably active in a case in which multiple functional groups are attached to one charge transporting skeleton.

In this regard, as the formation of the sea island structure is suppressed in a case in which the reactive charge transporting material (a) having a methacryloyl group is used, it is assumed that more stable electrical characteristics and image characteristics are obtained from an electrophotographic photoreceptor which includes the outermost layer formed from a cured film of a composition containing the reactive charge transporting material (a) according to this preferred exemplary embodiment.

Furthermore, as for R—O—CO—CR'═CH—R", it is preferable that R be bonded to the charge transporting skeleton and not be a single bond but be a divalent linking group which may have a substituent group. In particular, the divalent linking group represented by R is preferably an alkylene group or a combination of an alkylene group and —O—, and more preferably an alkylene group.

The reason that the above embodiment is preferred is not necessarily clearly known, but it is presumably due to the following reason.

That is, if electron-attractive methacryloyl groups are present too near to a charge transporting structure, density of electric charge of the charge transporting structure lowers and ionization potential rises, so that there are cases where injection of carriers from the lower layer does not smoothly advance. Further, when radical polymerizable substituents such as methacryloyl groups are polymerized, if radicals generating at the time of polymerization have a structure easily movable to the charge transporting structure, the generated radicals deteriorate the charge transporting function, which presumably causes degradation of electric characteristics. In addition, in connection with mechanical strength in the outermost layer, when a bulky charge transporting structure and polymerization sites (the structural unit represented by the formula of —O—CO—CR'═CH—R") are near and rigid, the polymerization sites are mutually difficult to move and there is presumably the possibility that probability of reaction lowers.

From these facts, a structure such that a flexible carbon chain R intervenes between the charge transporting structure and the structural unit represented by the formula of —O—CO—CR'═CH—R" is preferred.

Next, the charge transporting skeleton will be explained.

Regarding the charge transporting skeleton in the reactive charge transporting material (a), a structure having conjugation with nitrogen atoms corresponds to the charge transporting skeleton like a skeleton originating from a nitrogen-containing hole transporting compound such as a triaylamine compound, a benzidine compound, and a hydrazone compound. Furthermore, when conjugation is disrupted between plural nitrogen atoms in the charge transporting skeleton, a structure including conjugation with plural nitrogen atoms and a region attached to the structure are taken together as the charge transporting skeleton.

The reactive charge transporting material (a) corresponds to the charge transporting skeleton described above to which at least two structures represented by R—O—CO—CR'═CH—R" are introduced.

Furthermore, the preferred exemplary embodiment is directed to the reactive charge transporting material (a) which is a compound having a structure in which a triphenylamine skeleton and 3 or more, preferably 4 or more methacryloyl groups are included. By following this embodiment, a great advantage including that stability of the compound is guaranteed during synthesis and the product can be produced at industrial scale is obtained. Furthermore, by following this embodiment, the outermost layer which having high cross-linking density and satisfying mechanical strength may be formed and therefore it is not necessary to add a polyfunctional monomer having no charge transporting property. As a result, thickening of the outermost layer may be achieved without causing degradation in electrical characteristics which is attributable to the addition of the polyfunctional monomer. Consequently, the electrophotographic photoreceptor having this outermost layer has the increased lifetime and may withstand for be used for a long period of use.

Furthermore, as the outermost layer having satisfactory electrical characteristics and strength can be formed, binder resins other than the polycarbonate resin may be added to the outermost layer. As a result, improvement in gas barrier characteristic and adhesiveness is obtained.

Furthermore, as having a charge transporting skeleton, the reactive charge transporting material (a) has excellent miscibility with conventional charge transporting materials containing no reactive group. Thus, conventional charge transporting materials having no functional group may be added, and therefore further improvement in electrical characteristics can be obtained.

Examples of the curing method include radical polymerization by heating, exposure to light, irradiation of radiation, or the like. Since the unevenness or wrinkles of the film easily occur in a case in which the reaction proceeds too fast, polymerization is preferably performed under a condition where radical generation occurs relatively slowly. From this point, thermal polymerization where polymerization speed is easily controlled is preferably adopted. Further, by carrying out the thermal polymerization with the reactive charge transporting material (a) having a methacryloyl group which has lower reactivity than that of an acryloyl group, relaxation of the structure is facilitated by heat, and therefore a stable film that has high uniformity can be obtained.

In the exemplary embodiments, the specific charge transporting material (a) is preferably a compound represented by Formula (A) below from the viewpoint of excellent charge transportability.

Formula (A):

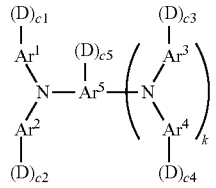

In the formula (A), $Ar^1$, $Ar^2$, $Ar^3$, and $Ar^4$ each independently represent a substituted or unsubstituted aryl group; $Ar^5$ represents a substituted or unsubstituted aryl group or a substituted or unsubstituted arylene group; D represents a group having the structural unit represented by the formula of R—O—CO—CR'═CH—R" in a terminal of the group; c1, c2, c3, c4, c5 represent each independently an integer of 0, 1 or 2; k represent an integer of 0 or 1; and the total number of D is 2 or more.

In Formula (A), each of $Ar^1$, $Ar^2$, $Ar^3$ and $Ar^4$ independently represents a substituted or unsubstituted aryl group. Each of $Ar^1$, $Ar^2$, $Ar^3$ and $Ar^4$ may be the same as or different from.

As the substituents of the substituted aryl group other than D (a group having the structural unit represented by the formula of R—O—CO—CR'═CH—R" in a terminal of the group), an alkyl group and an alkoxy group each having 1 to 4 carbon atoms, or a substituted or unsubstituted aryl group having 6 to 10 carbon atoms are exemplified.

$Ar^1$, $Ar^2$, $Ar^3$ and $Ar^4$ each independently are preferably any of the following formulae (1) to (7). In formulae (1) to (7), "-$(D)_{C1}$" to "-$(D)_{C4}$" capable of bonding to each of $Ar^1$, $Ar^2$, $Ar^3$ and $Ar^4$ independently are generally shown as "-$(D)_C$".

(1)

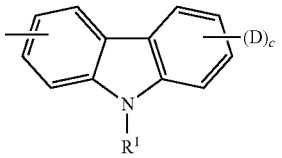

(2)

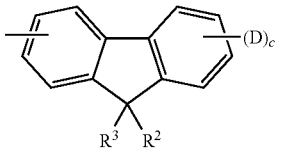

(3)

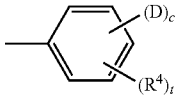

(4)

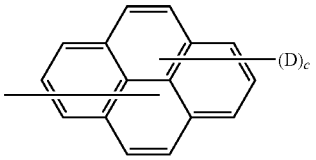

(5)

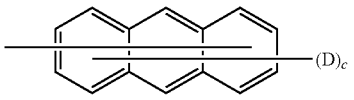

-continued (6)

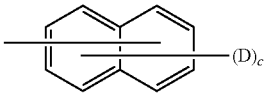

(7)

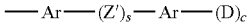

In formulae (1) to (7), $R^1$ represents the one selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and an aralkyl group having 7 to 10 carbon atoms; each of $R^2$, $R^3$ and $R^4$ independently represents the one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; Ar represents a substituted or unsubstituted arylene group; D represents a group having the structural unit represented by the formula of R—O—CO—CR'═CH—R" in a terminal of the group; c represents an integer of 0, 1 or 2; s represents 0 or 1; and t represents an integer of 0 to 3.

Here, Ar in formula (7) is preferably represented by the following formula (8) or (9).

Formula (8):

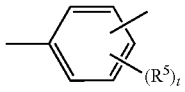

Formula (9):

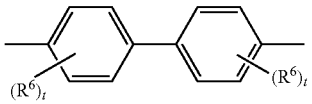

In formulae (8) and (9), each of $R^5$ and $R^6$ independently represents the one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; and each t' represents an integer of 0 to 3.

In formula (7), Z' is preferably represented by any of the following formulae (10) to (17); and s represents 0 or 1.

(10)

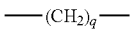

(11)

(12)

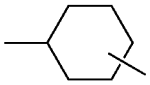

(13)

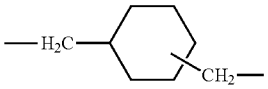

-continued (14)

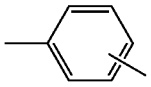

(15)

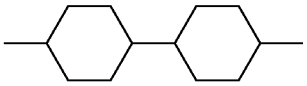

(16)

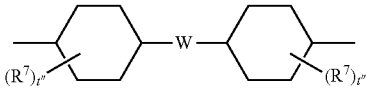

(17)

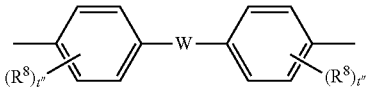

In formulae (10) to (17), each of $R^7$ and $R^8$ independently represents the one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; W represents a divalent group; each of q and r independently represents an integer of 1 to 10; and each of t" represents an integer of 0 to 3.

W in formulae (16) and (17) is preferably any of divalent groups represented by the following formulae (18) to (26). In formula (25), u represents an integer of 0 to 3.

(18)

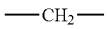

(19)

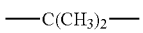

(20)

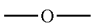

(21)

(22)

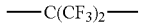

(23)

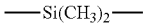

(24)

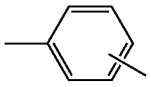

(25)

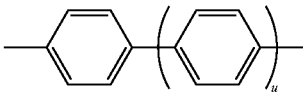

(26)

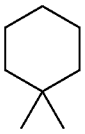

In formula (A), $Ar^5$ represents a substituted or unsubstituted aryl group in a case in which k is 0. As the aryl group, the same aryl groups shown in the description of $Ar^1$ to $Ar^4$ are exemplified. $Ar^5$ represents a substituted or unsubstituted arylene group in a case in which k is 1, and as the arylene group, arylene groups obtained by subtracting one hydrogen atom at a prescribed position from the aryl groups shown in the description of $Ar^1$ to $Ar^4$ are exemplified.

In the Formula (A) above, D represents a group having the structure represented by R—O—CO—CR'═CH—R" at a terminal thereof. D is preferably a group in which R is a binding moiety to the charge transporting skeleton and is a bivalent linking group having at least one carbon atom and which is bonded to the structure represented by —O—CO—CR'═CH—R" via R. More preferably, it is a group in which R is an alkylene group and which is bonded to the structure represented by —O—CO—CR'═CH—R" above via the alkylene group. Still more preferably, it is a group that is bonded to a terminal methacryloyl group via alkylene group (i.e., R is an alkylene group, R" is a hydrogen atom, and R' is a methyl group).

As a specific example of D in the Formula (A), $—(CH_2)_d—(O—CH_2—CH_2)_e—O—CO—C(CH_3)═CH_2$ is preferable. Herein, d represents an integer in the range of 1 to 5, suitably an integer in the range of 1 to 4, and more suitably an integer in the range of 1 to 3. e represents 0 or 1.

In the Formula (A) above, c1 to c5 each independently represents 0, 1 or 2, and D is present in a total number of 2 or more. In terms of suppressing deterioration in image quality by improving strength of a cured film, the total number of D is suitably 3 or more, and more suitably 4 or more.

Herein below, specific examples of the reactive charge transporting material (a) are described for each number of the functional groups contained in the structure represented by R—O—CO—CR'═CH—R". However, the reactive charge transporting material (a) is not limited by them. Among the specific examples, Me represents a methyl group, Et represents an ethyl group, Pr represents a propyl group and Bu represents a butyl group.

First, regarding the reactive charge transporting material (a), specific examples in each of which there are four or more functional groups having the structure represented by R—O—CO—CR'═CH—R" will be described (i.e., Compounds A-1 to A-32).

A-1

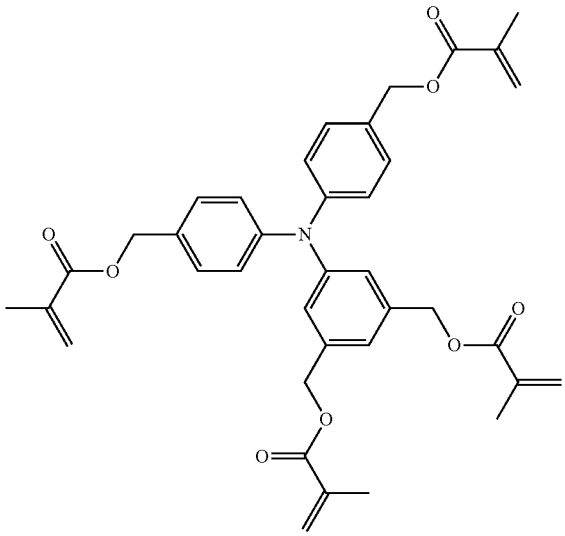

A-2

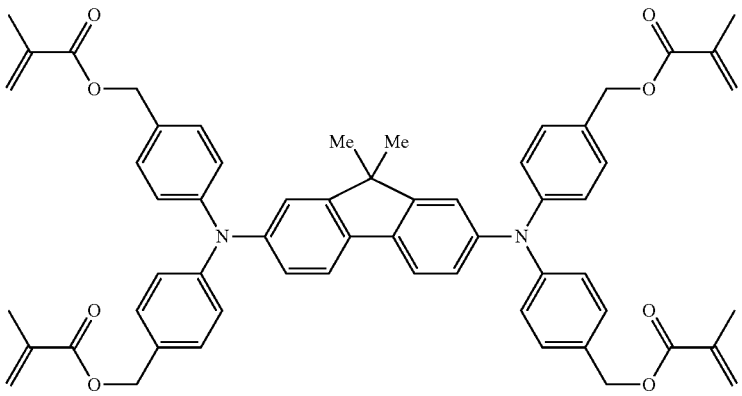

-continued
A-3
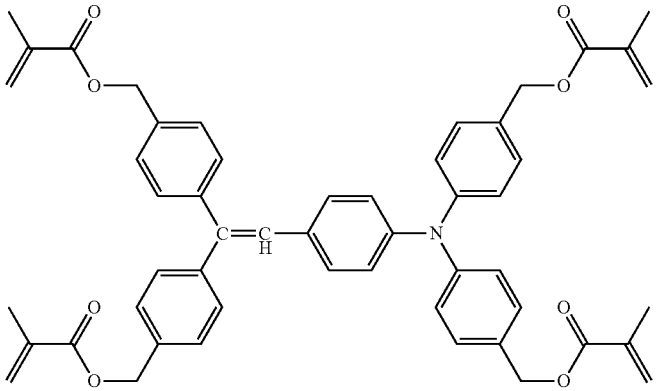
A-4
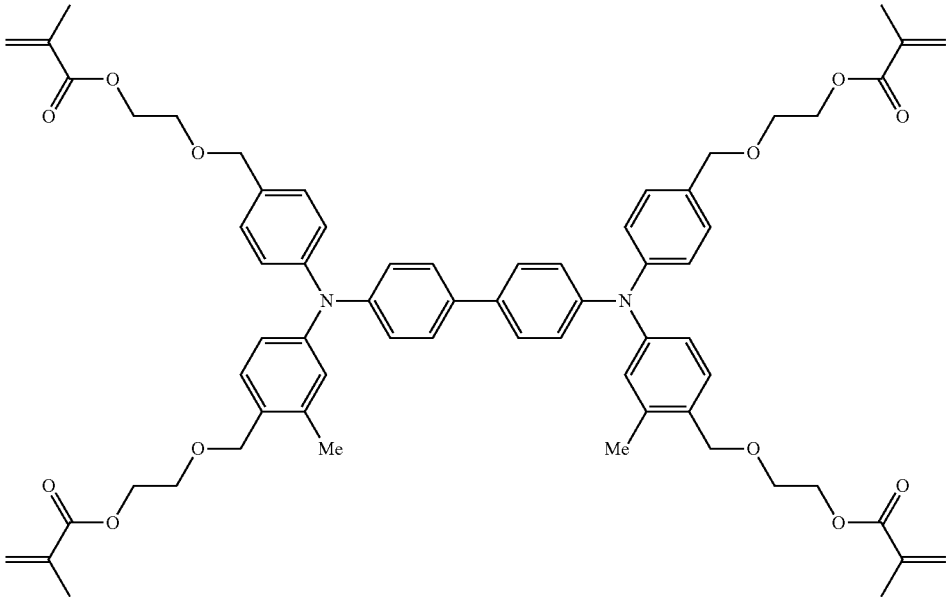
A-5
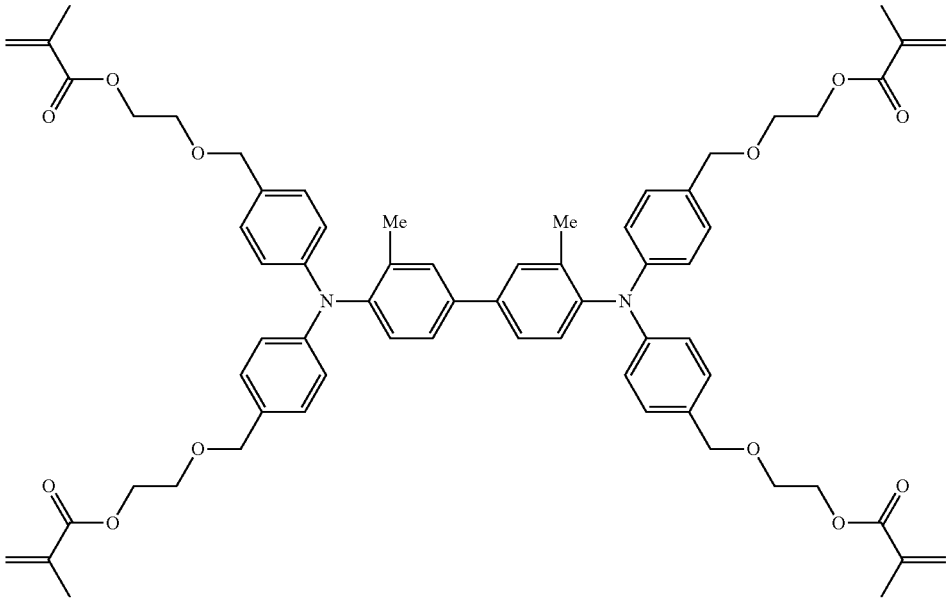

-continued
A-6
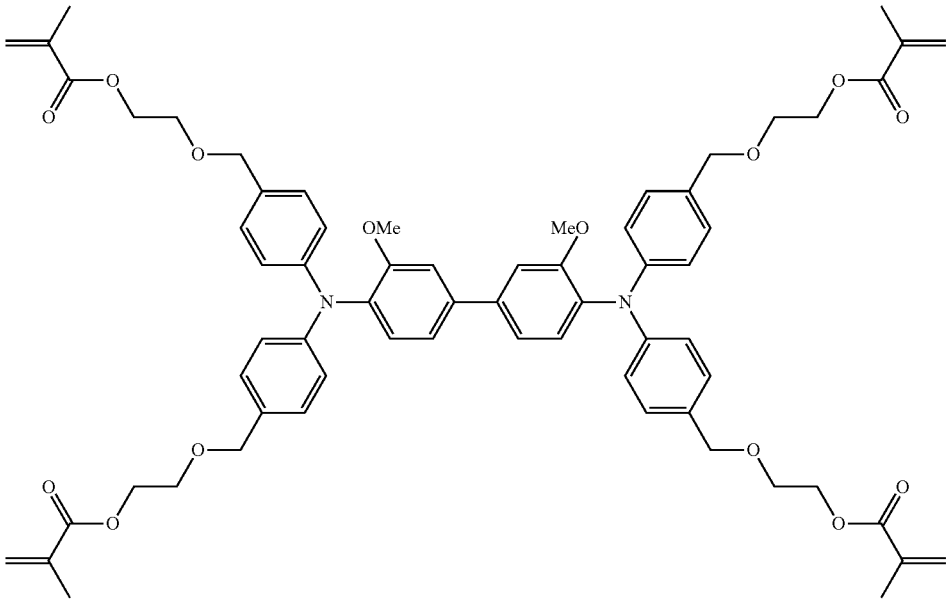
A-7
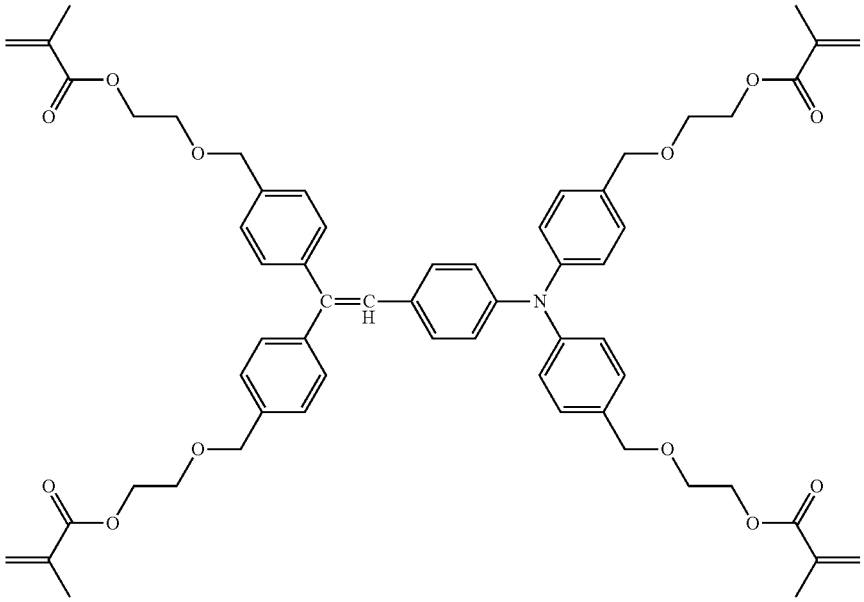

-continued
A-8
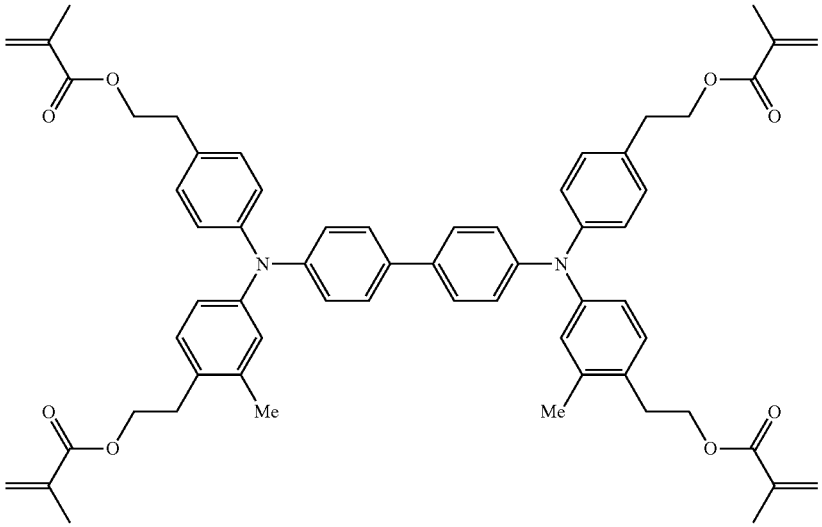
A-9
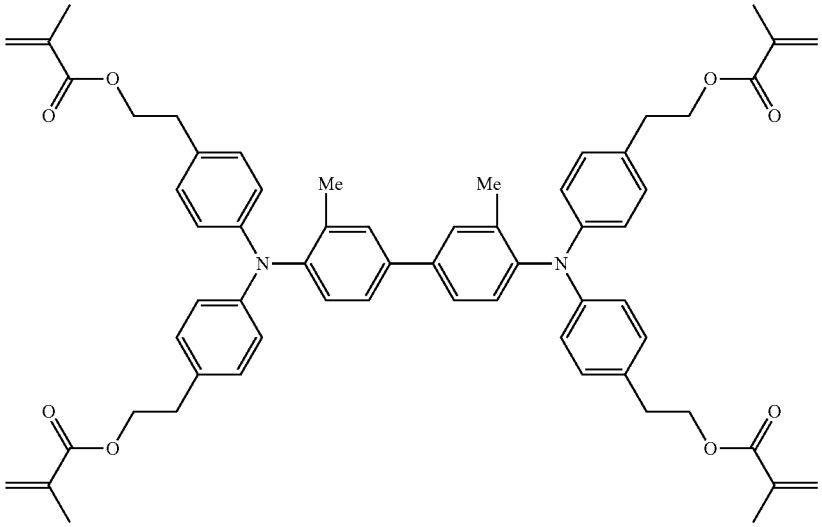
A-10
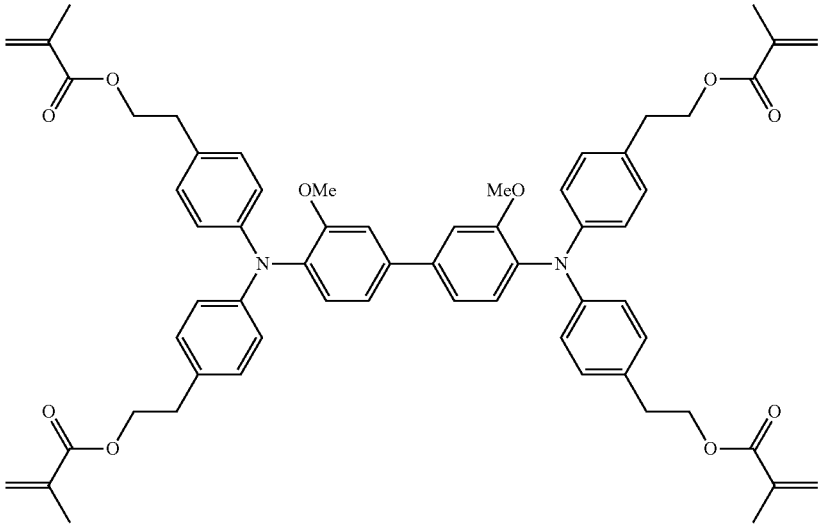

-continued
A-11
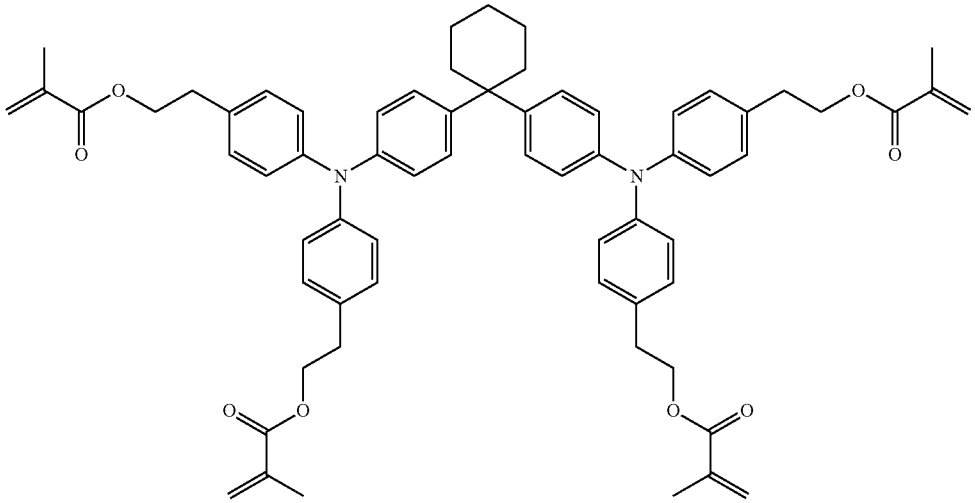
A-12
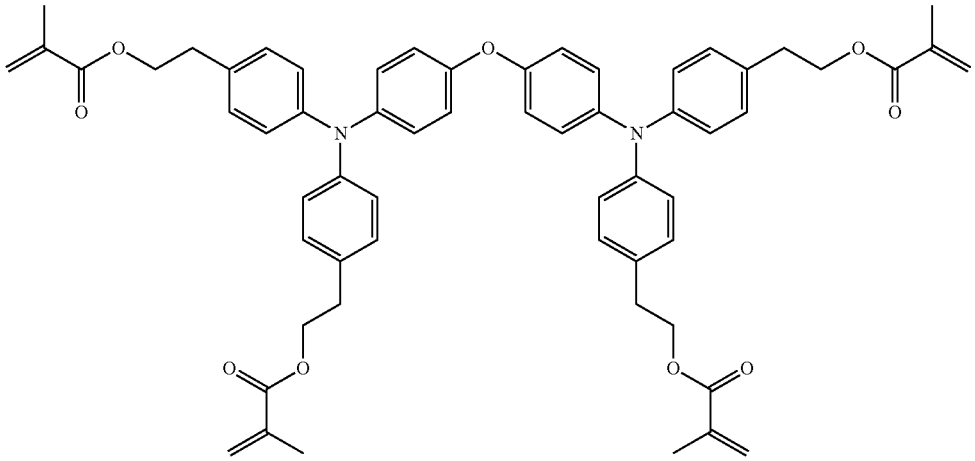
A-13
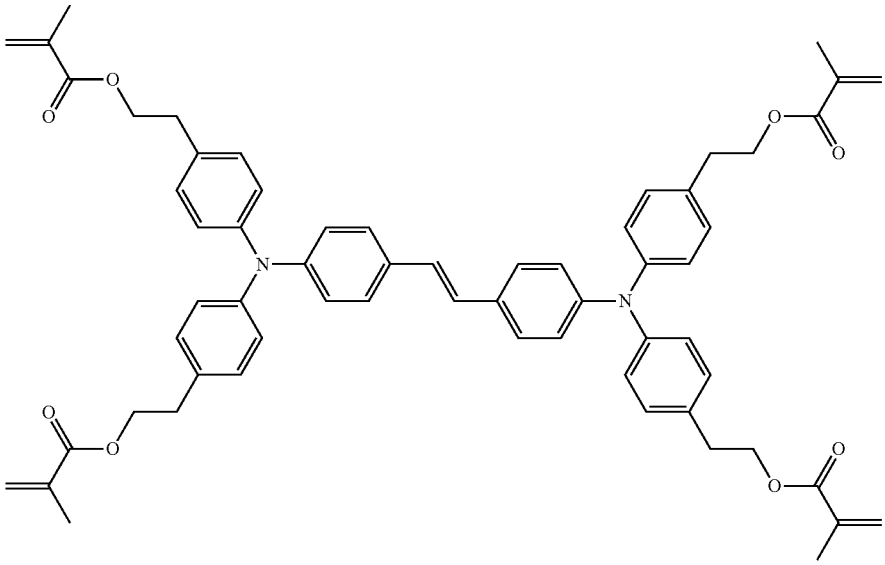

-continued
A-14
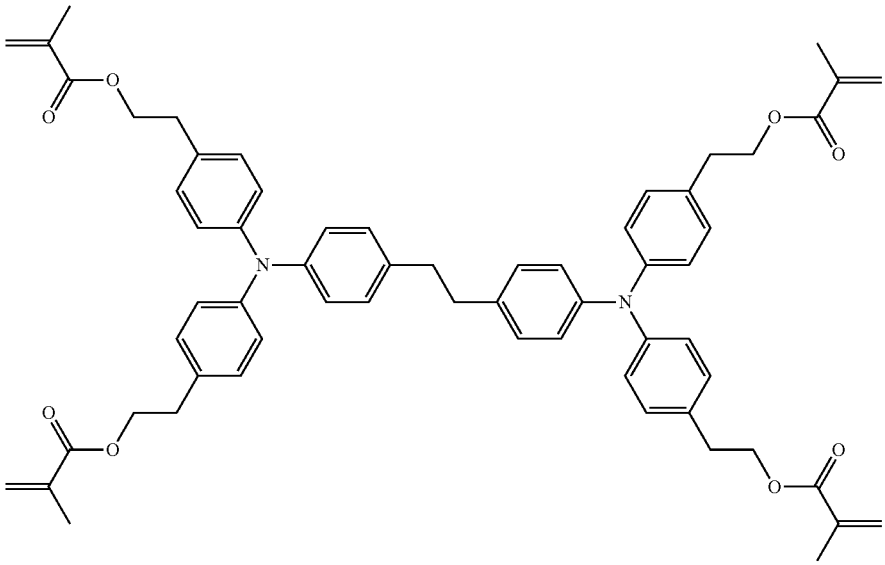
A-15
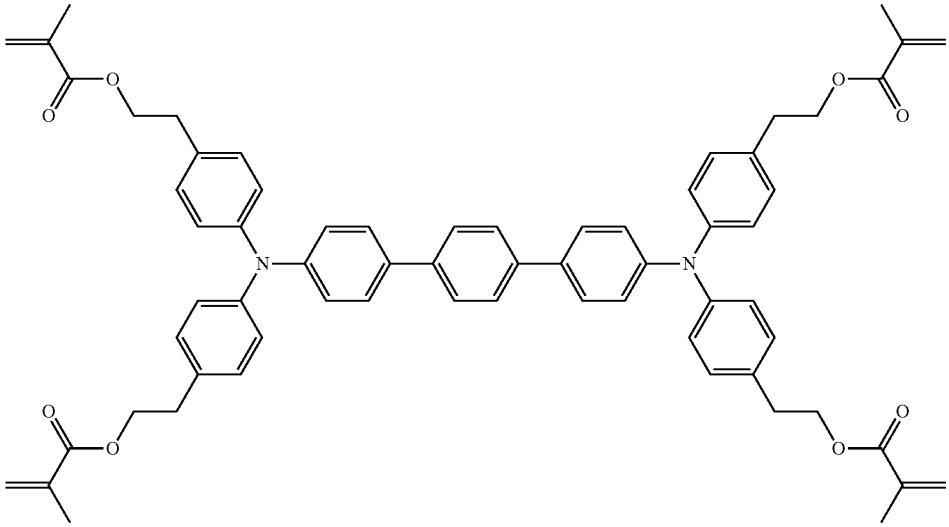
A-16
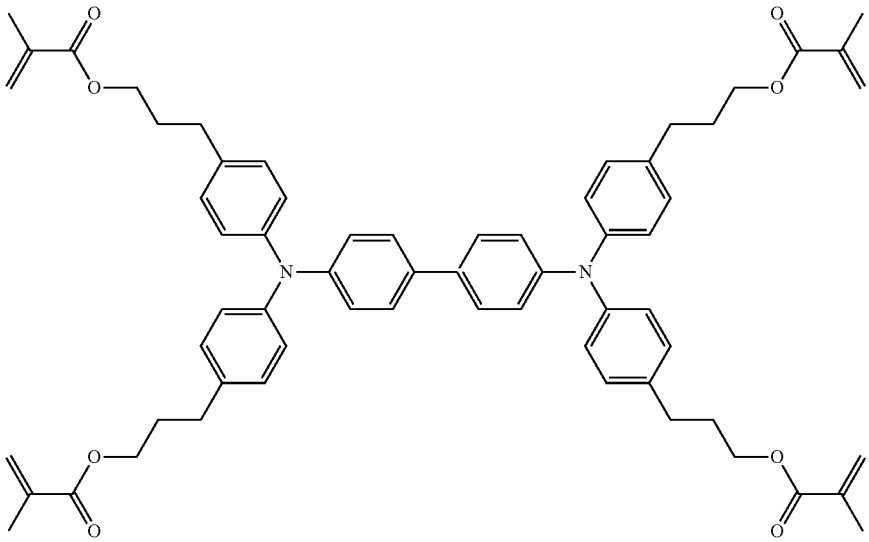

-continued
A-17
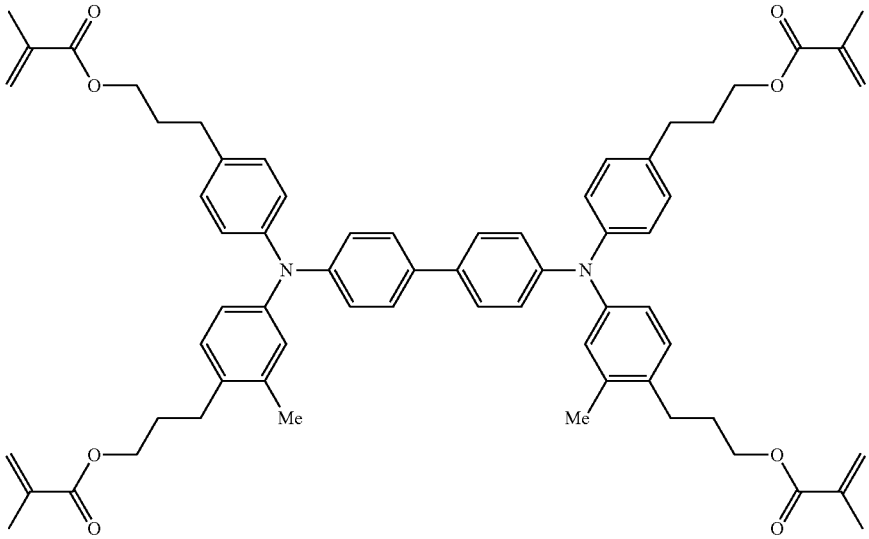
A-18
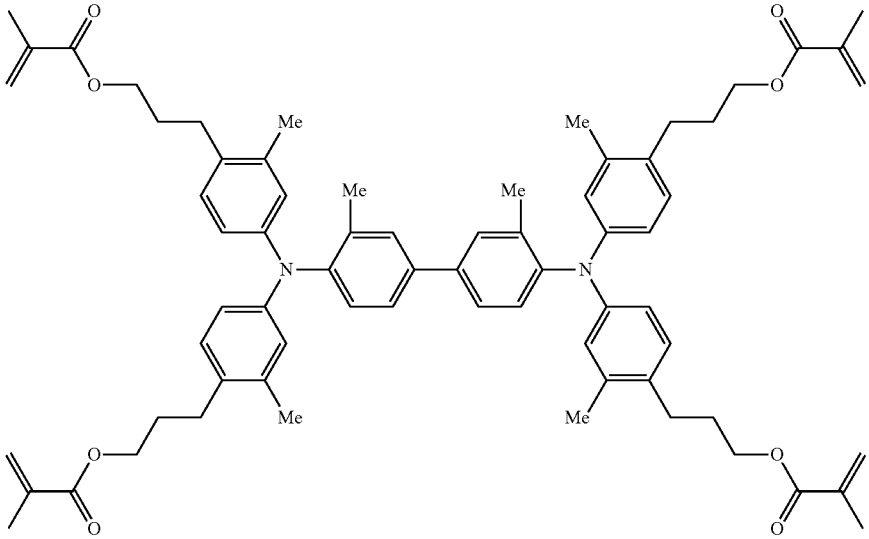
A-19
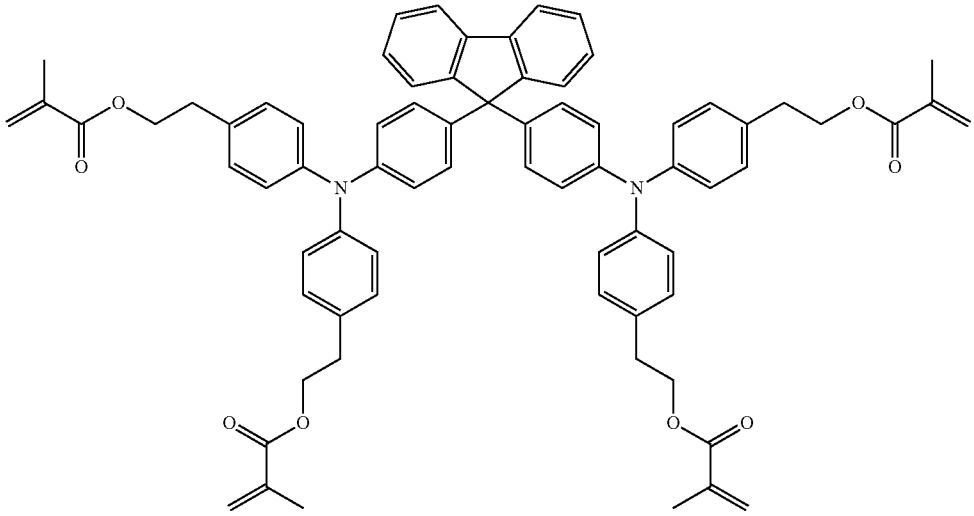

-continued
A-20
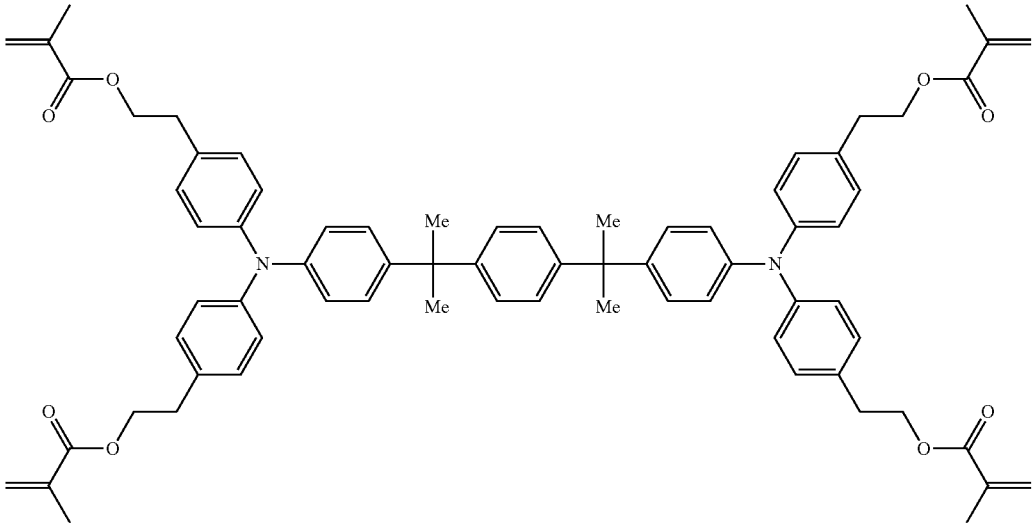
A-21
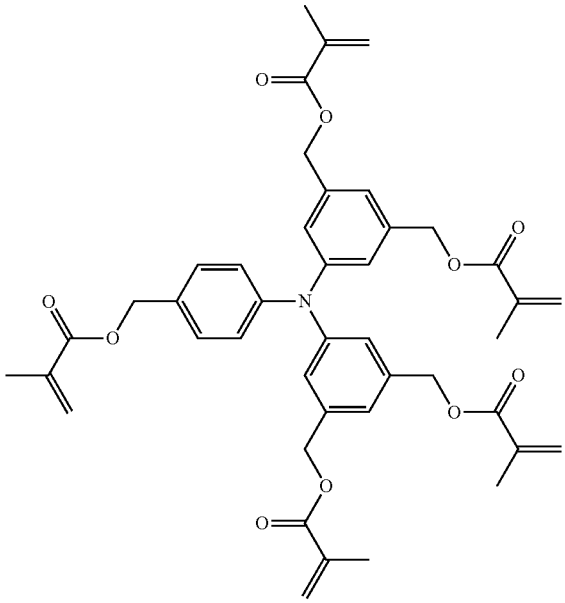
A-22
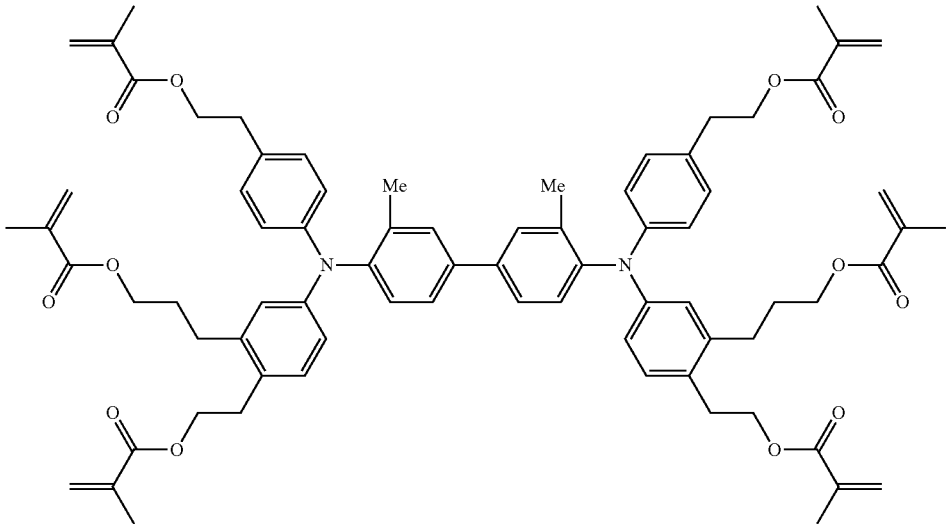

-continued
A-23
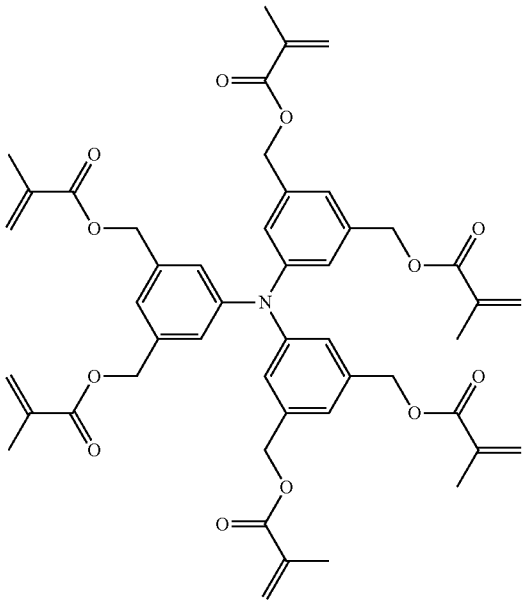
A-24
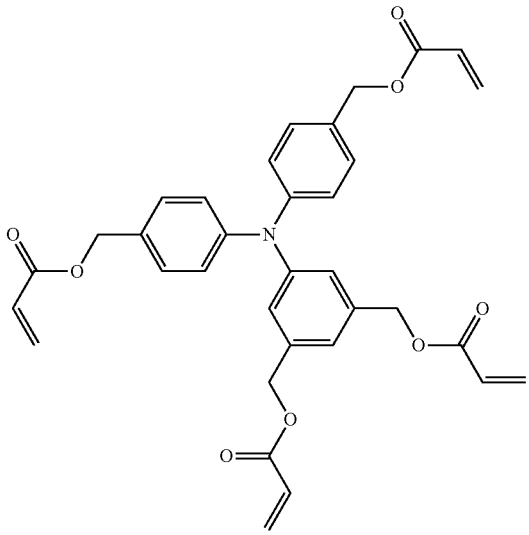
A-25
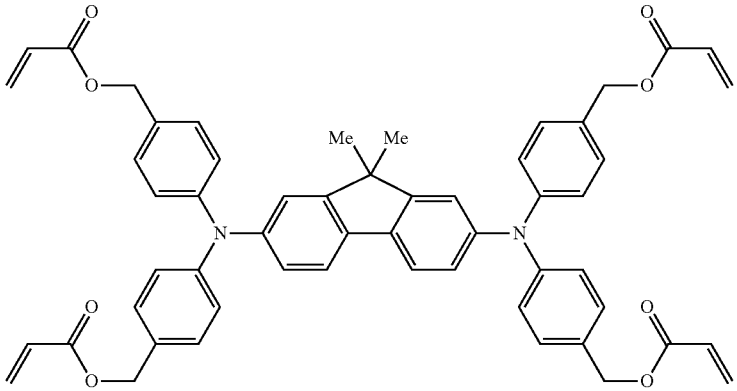
A-26
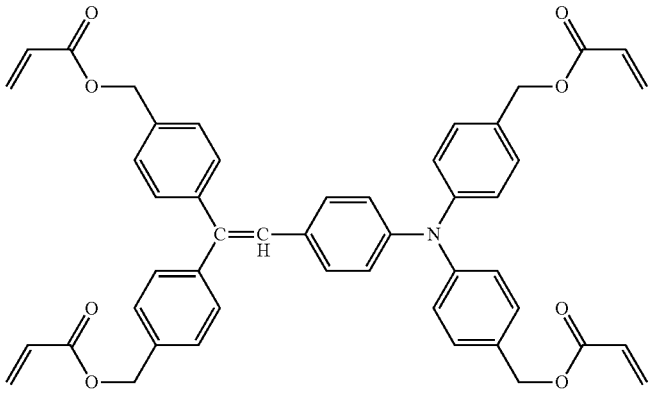

-continued
A-27
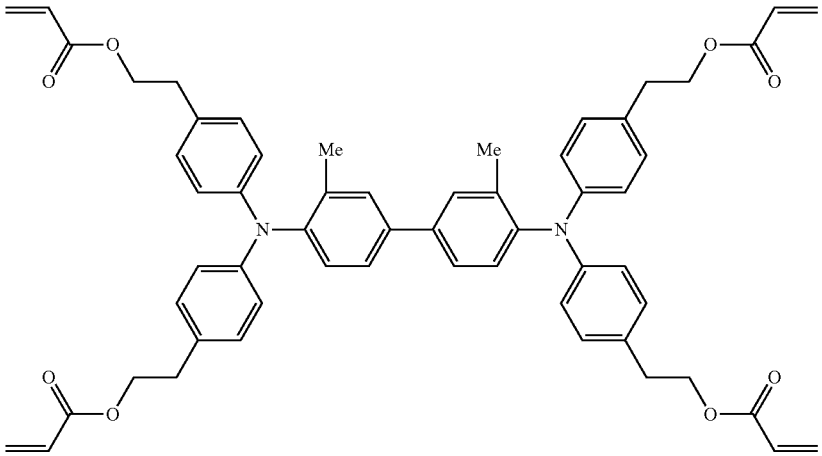
A-28
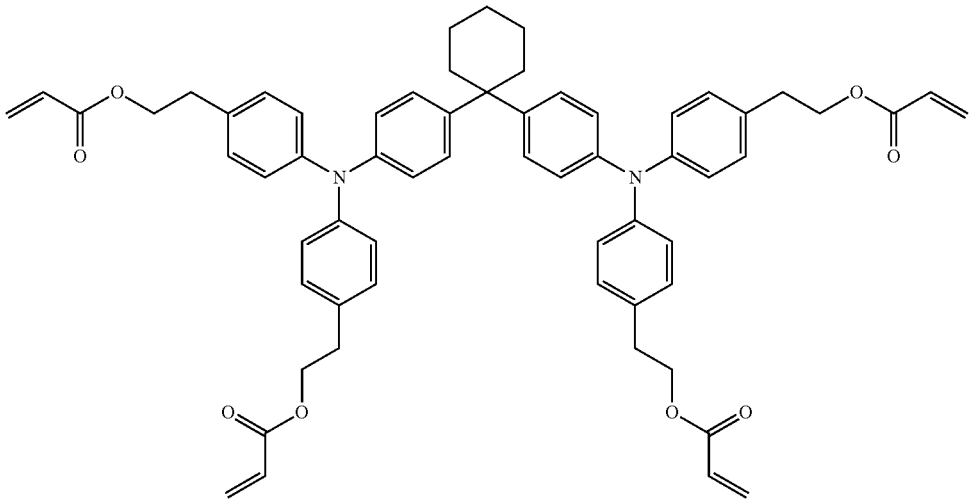
A-29
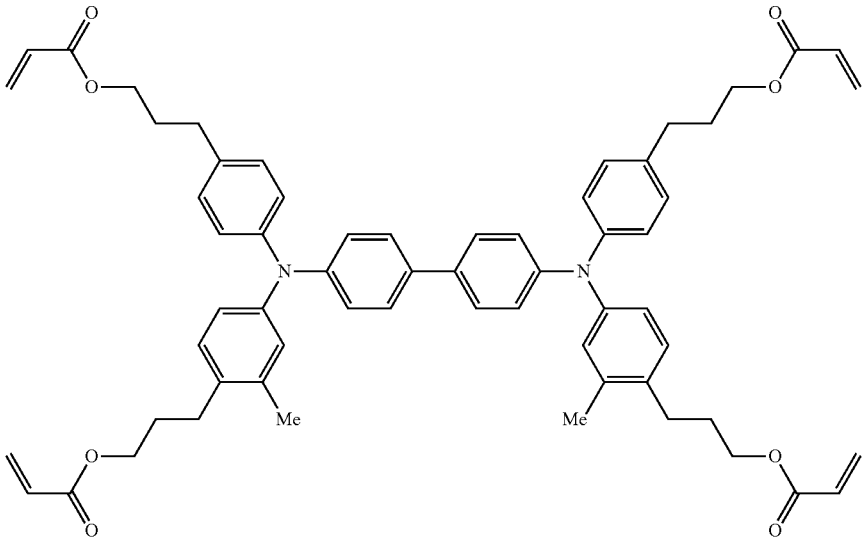

-continued
A-30
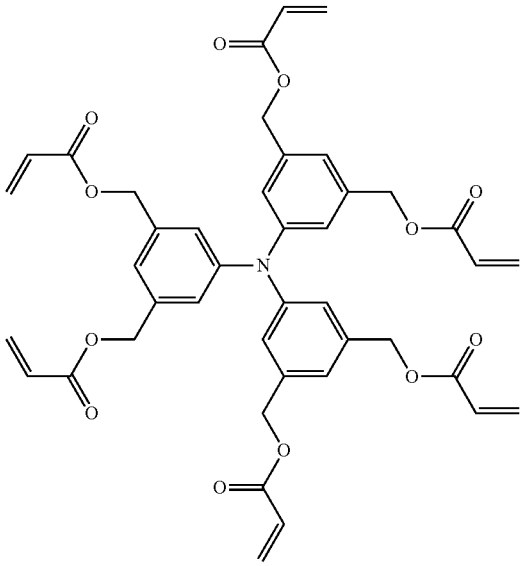
A-31
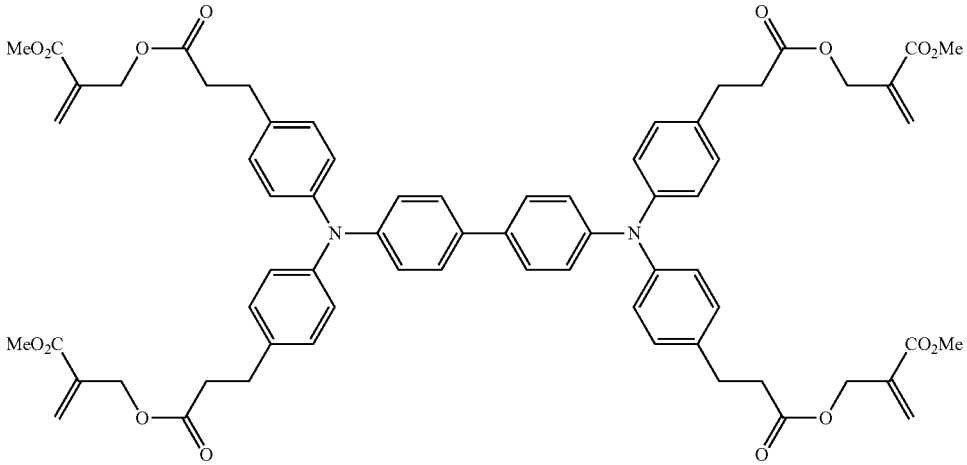
A-32
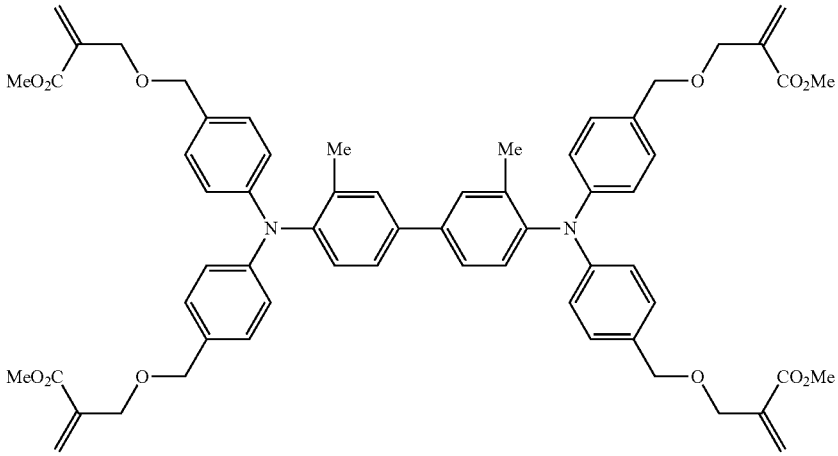

Regarding the reactive charge transporting material (a), specific examples in each of which there are two functional groups having the structure represented by R—O—CO—CR'═CH—R" above will be described (i.e., Compounds A-46 to A-67).
A-46
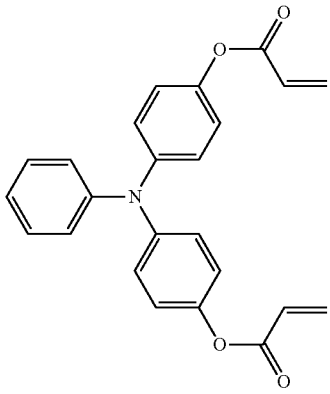
A-47
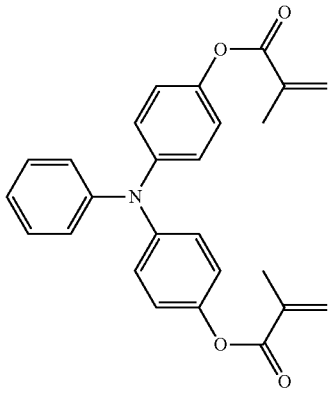
A-48
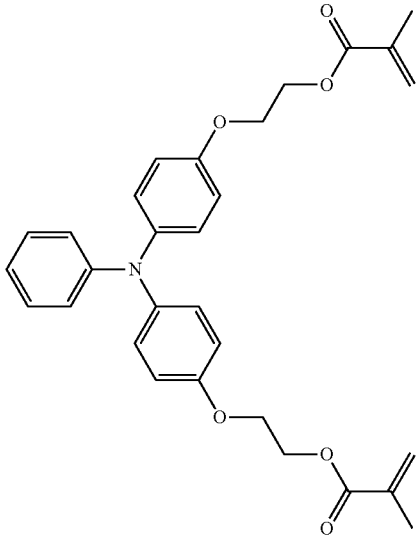
A-49
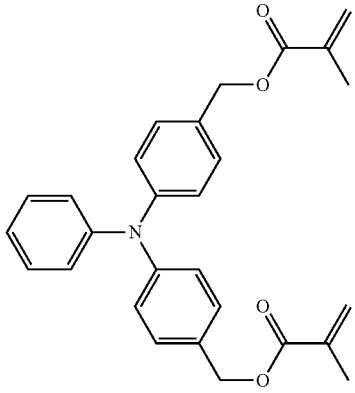
A-50
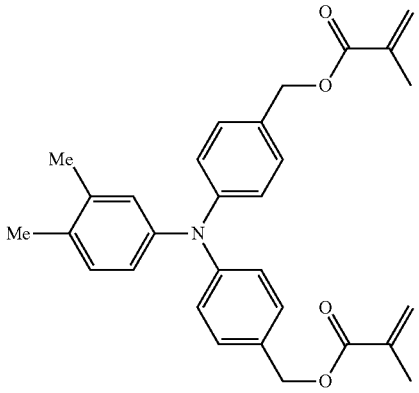
A-51
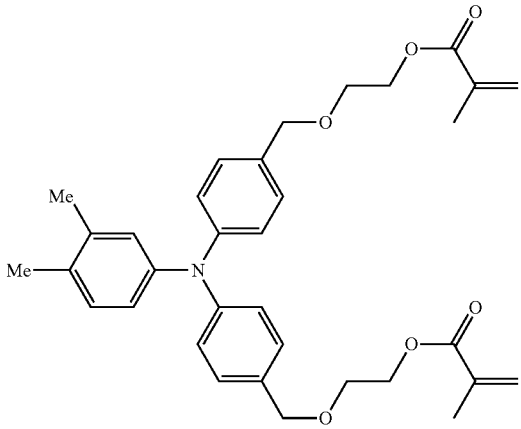

-continued
A-52
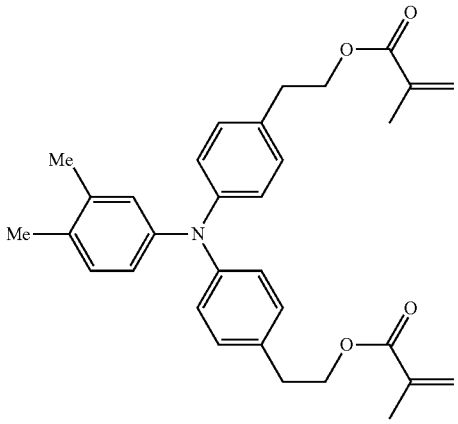
A-53
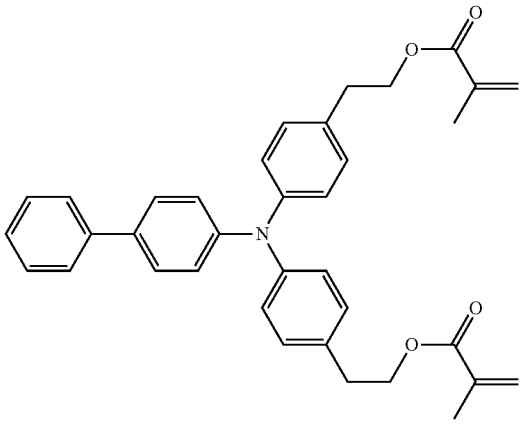
A-54
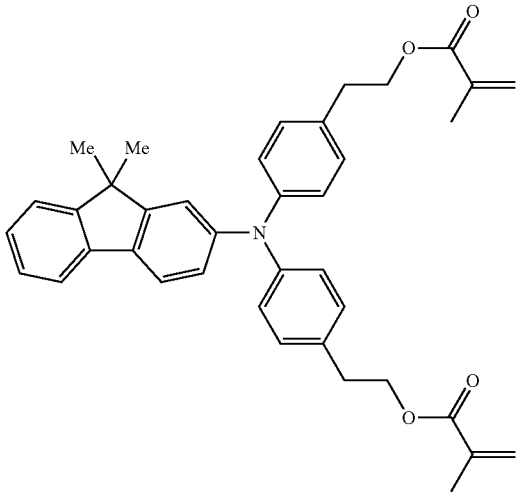
A-55
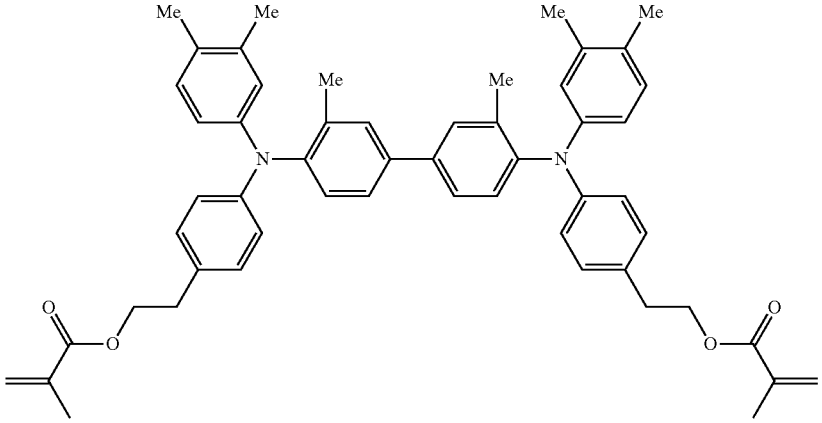

-continued
A-56
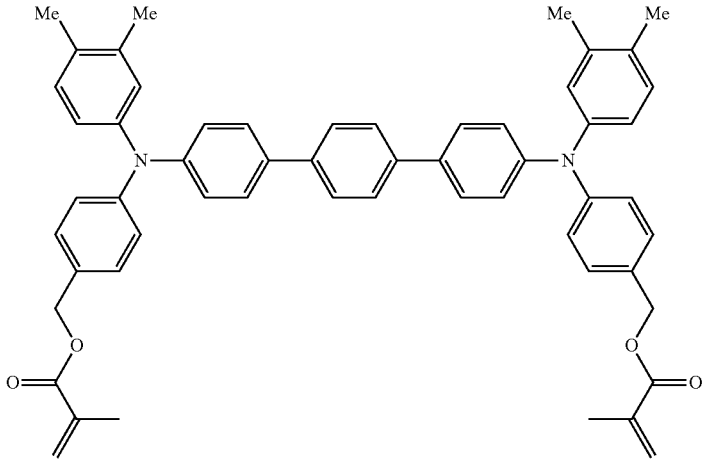
A-57
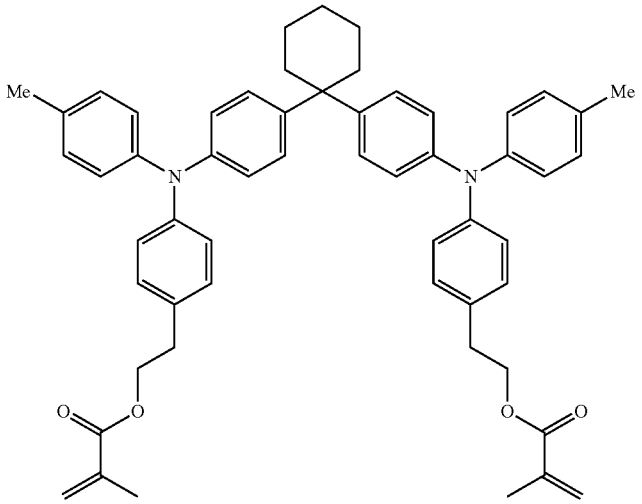
A-58
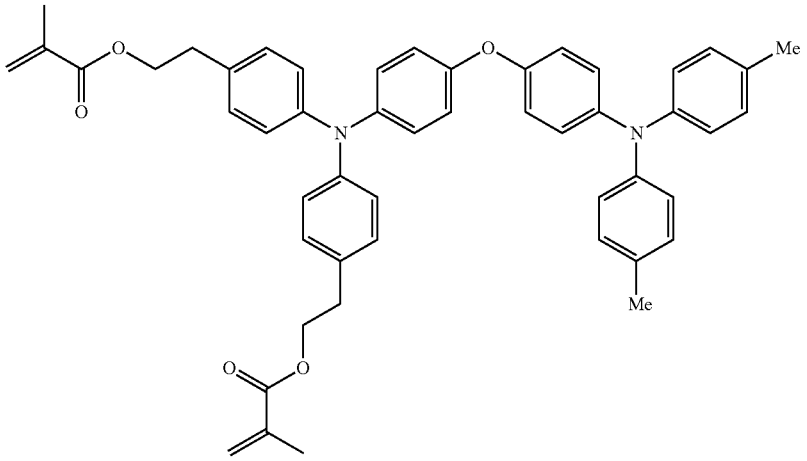

-continued
A-59
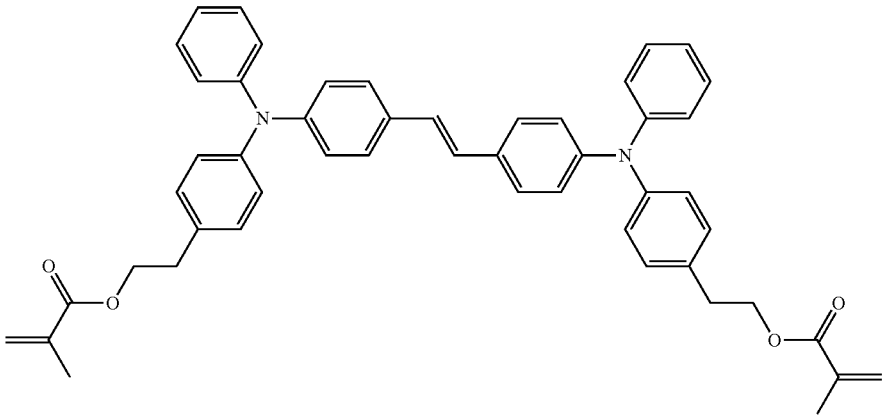
A-60
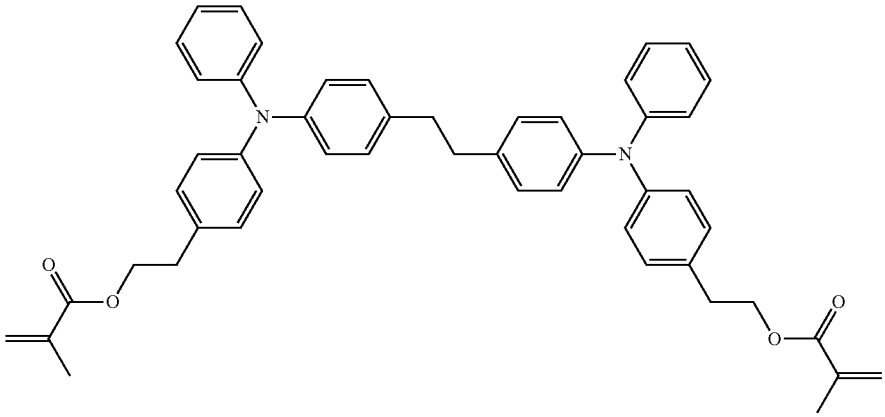
A-61
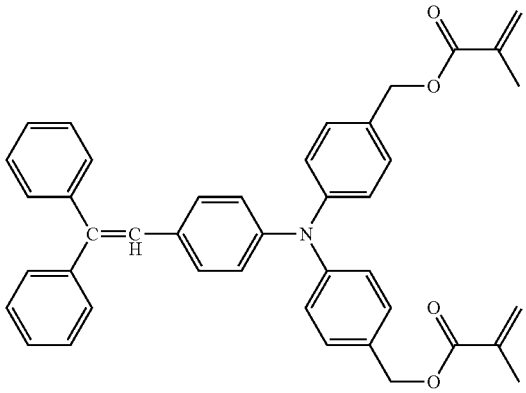
A-62
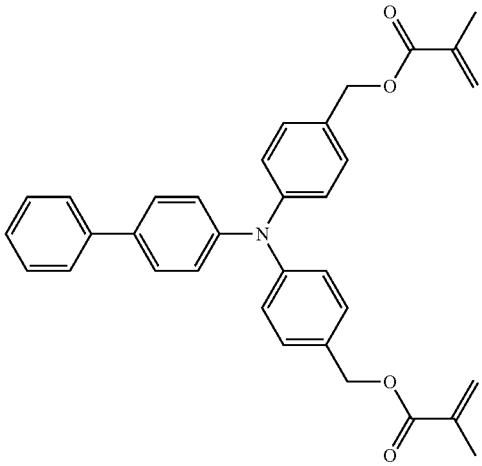

-continued
A-63
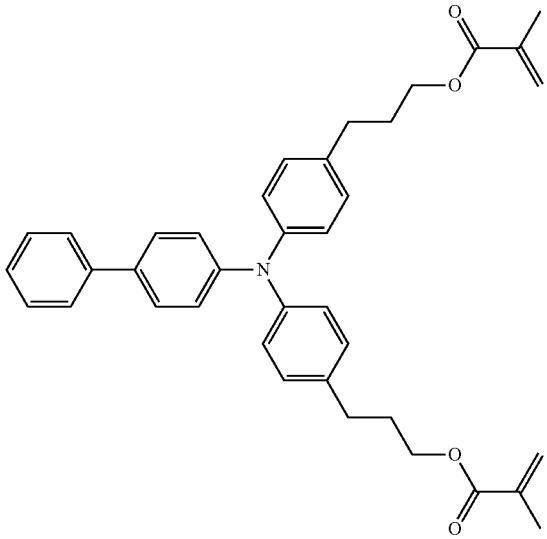
A-64
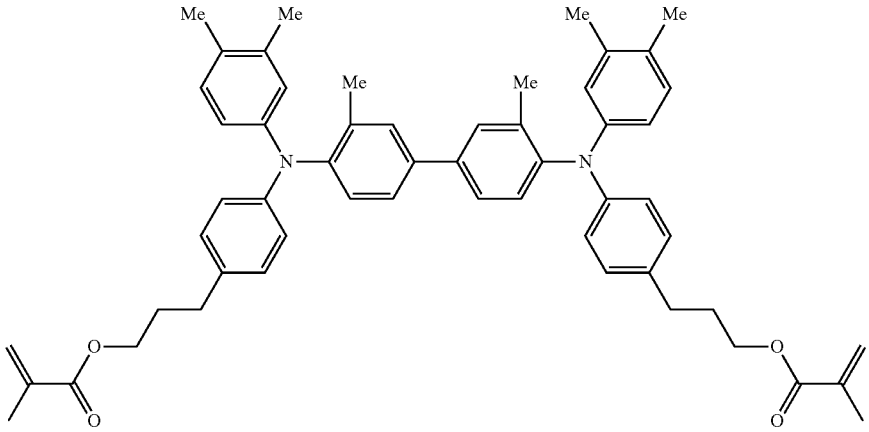
A-65
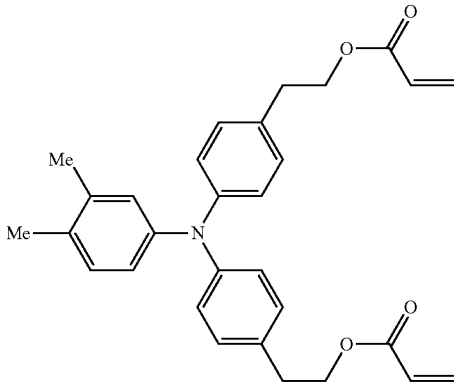

-continued
A-66
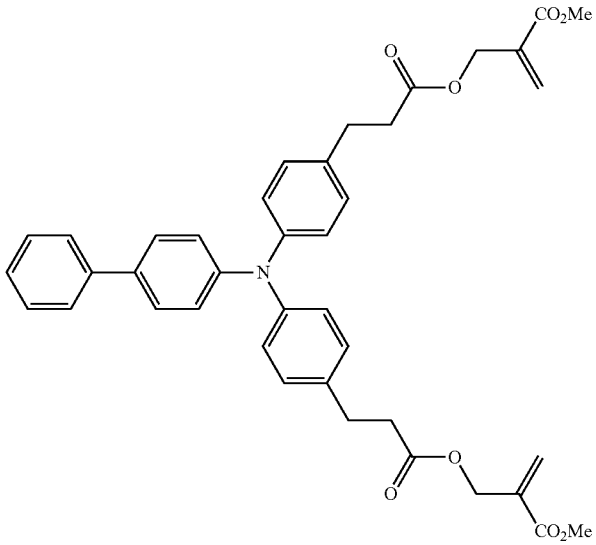
A-67
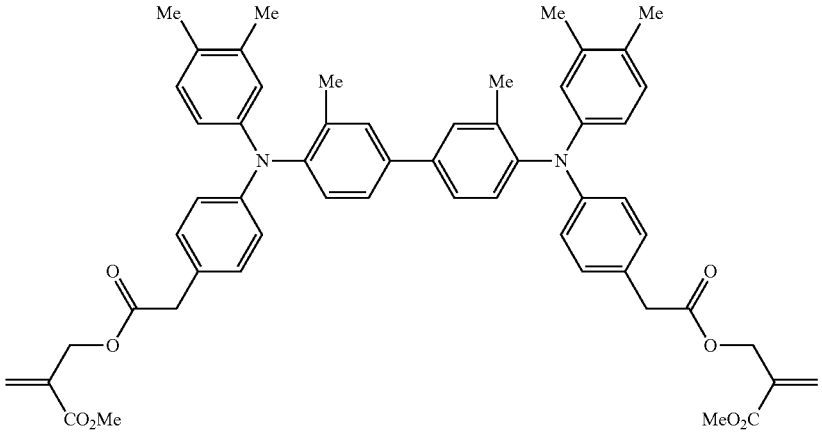
Regarding the reactive charge transporting material (a), specific examples in each of which there are three functional groups having the structure represented by R—O—CO—CR'═CH—R" above will be described (i.e., Compounds A-68 to A-80).
A-68
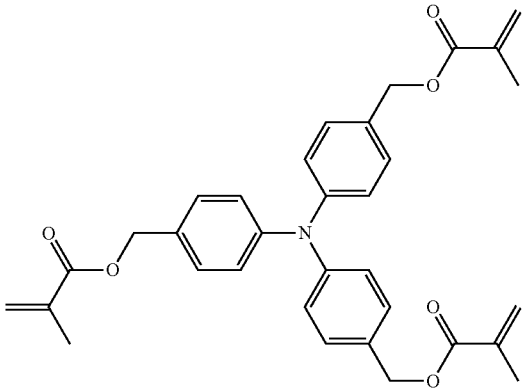
A-69
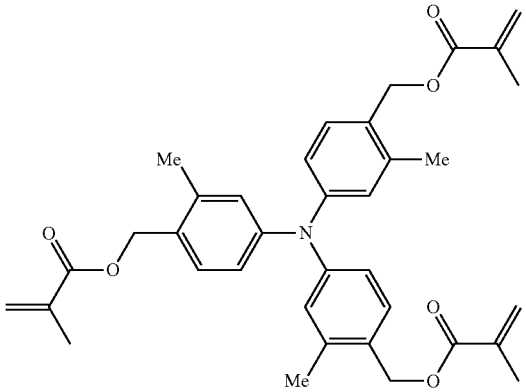

-continued
A-70
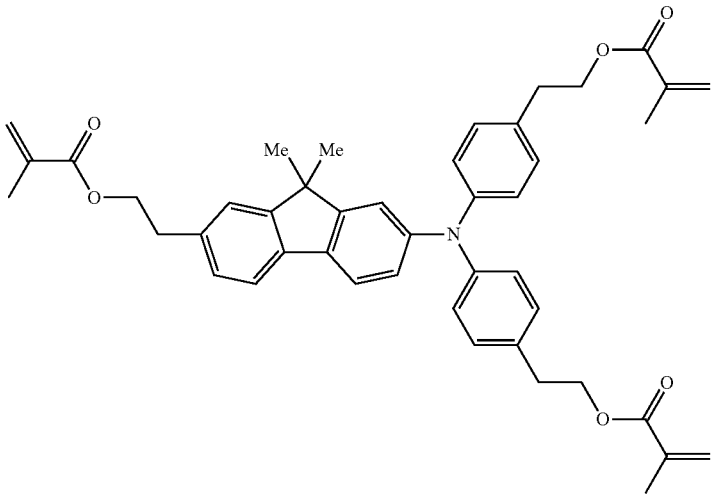
A-71
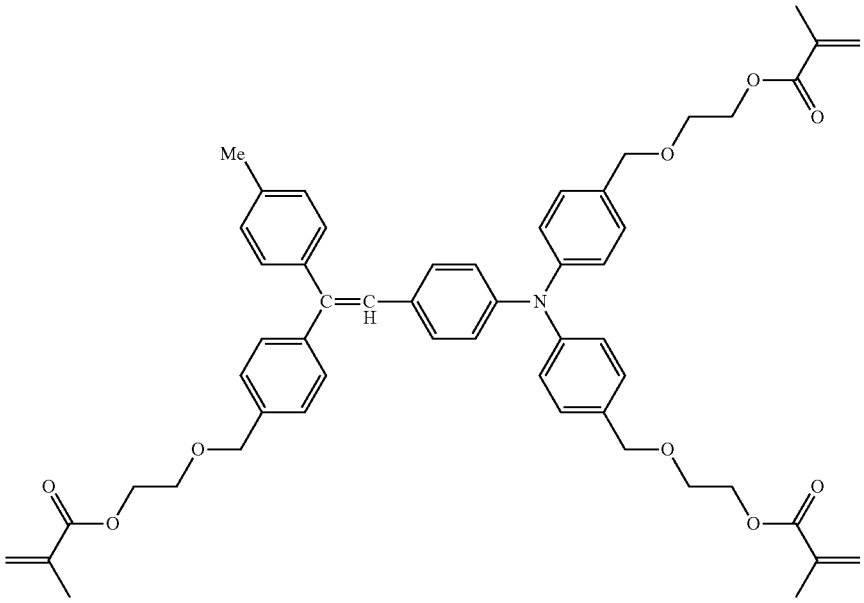
A-72
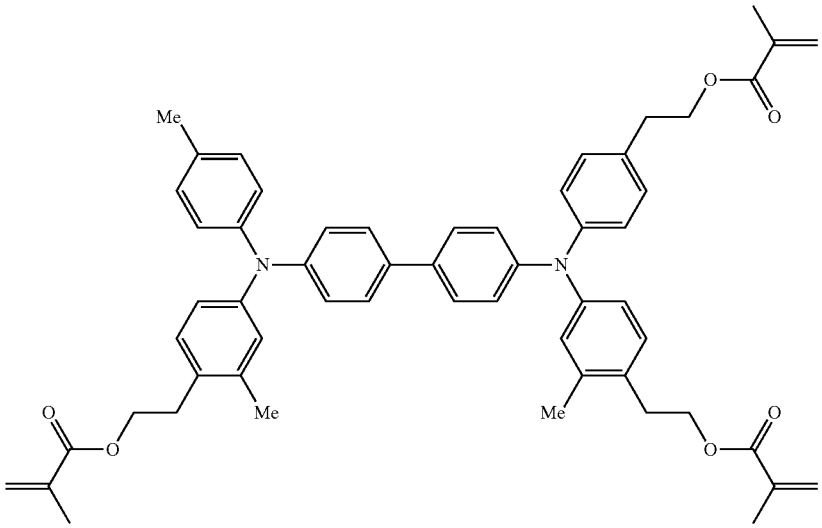

-continued
A-73
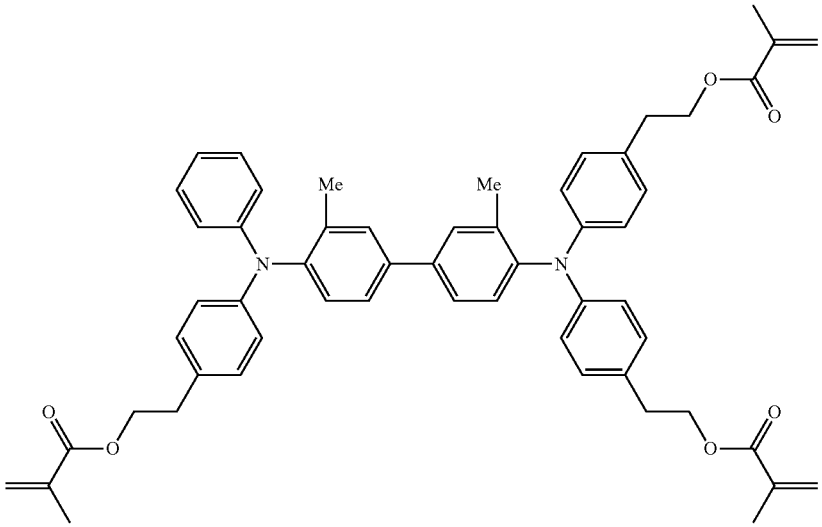
A-74
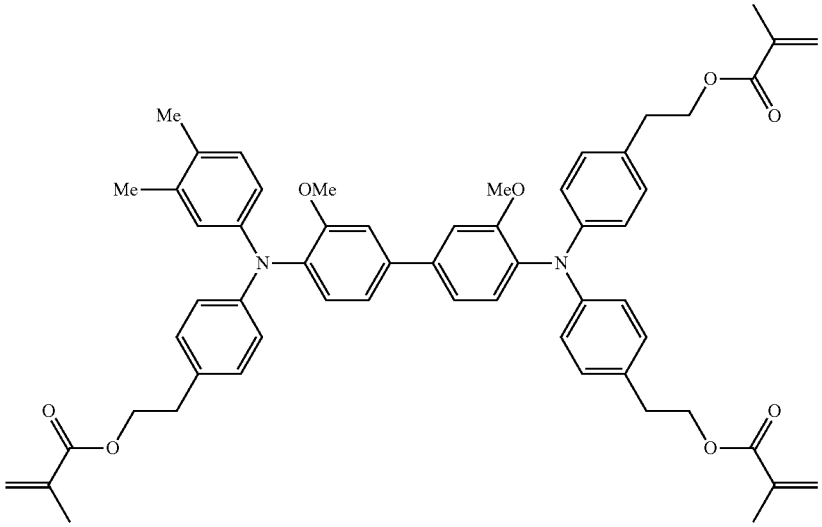
A-75
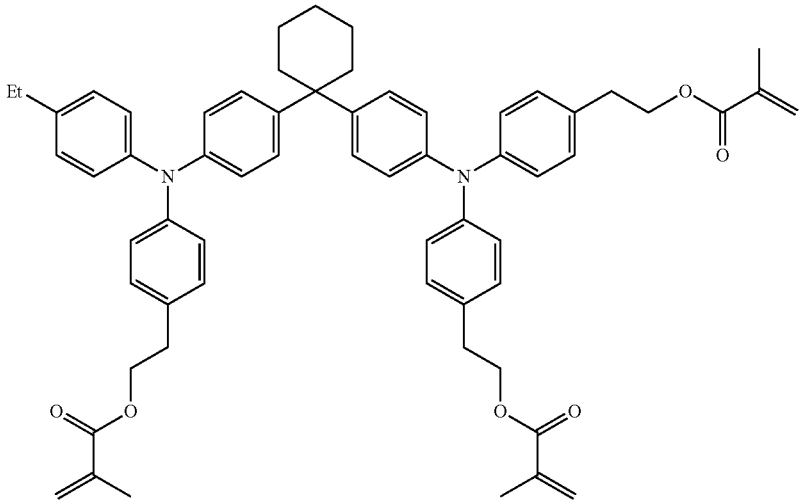

-continued
A-76
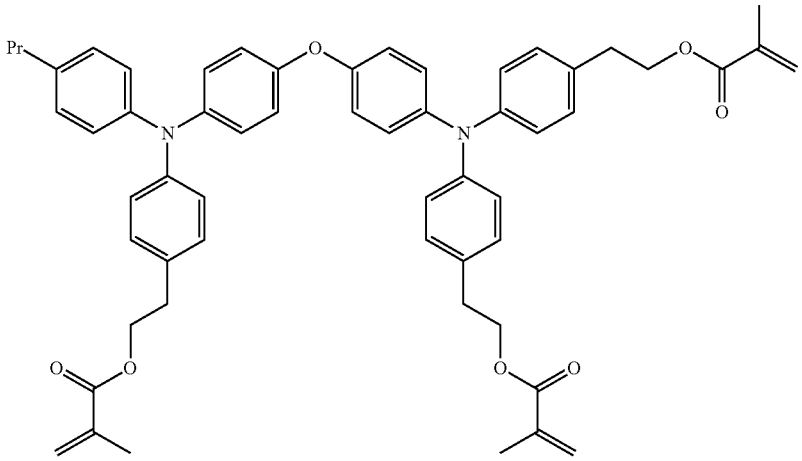
A-77
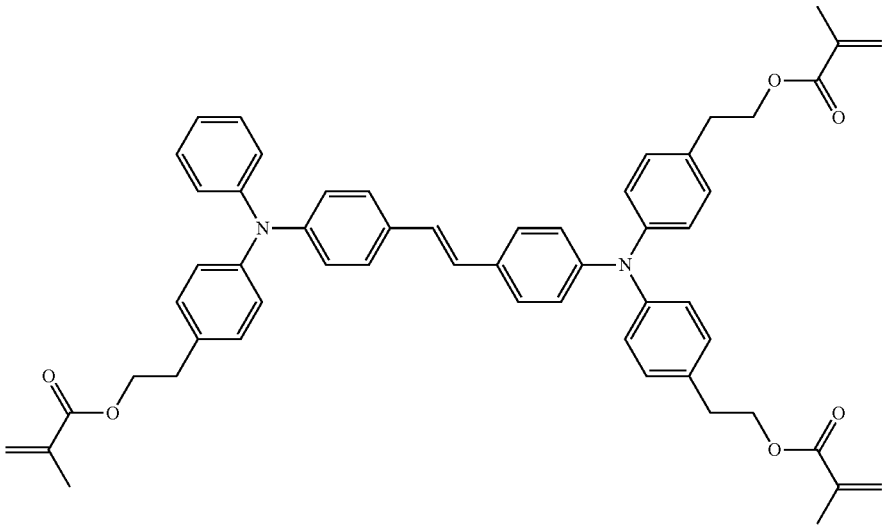
A-78
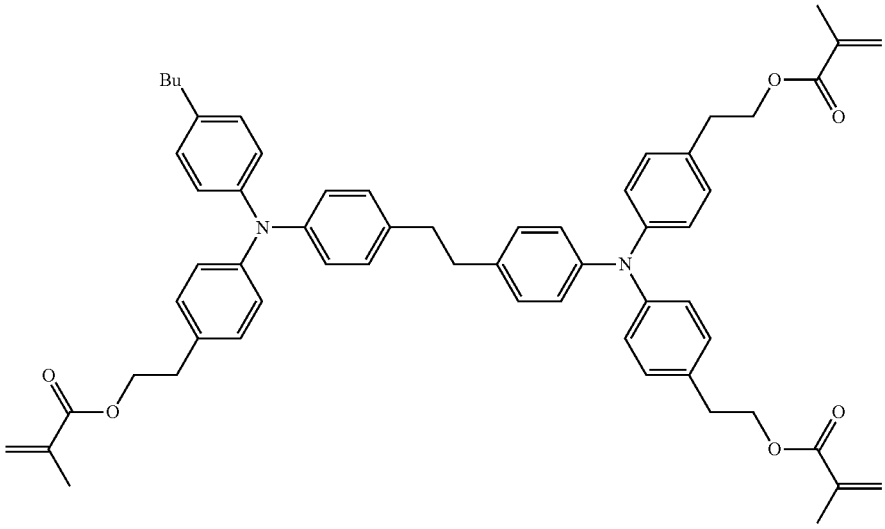

-continued

A-79

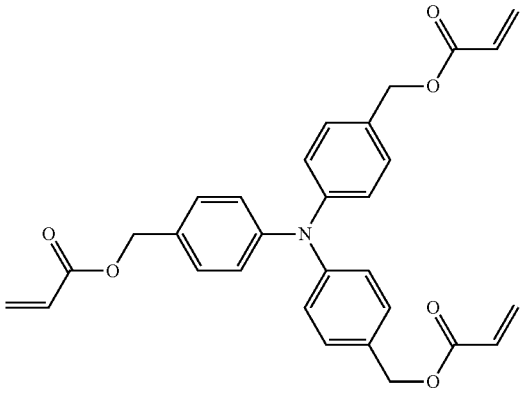

A-80

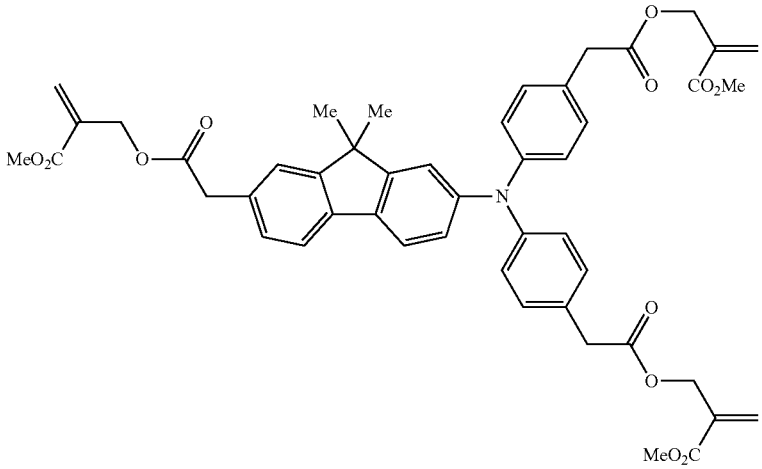

According to this exemplary embodiment, in a case in which the outermost layer contains a compound having two or more functional groups having the structure represented by R—O—CO—CR'═CH—R" above as the reactive charge transporting material (a), a compound having one structure represented by R—O—CO—CR'═CH—R" may be used in combination with the compound having two or more functional groups.

Specific examples of the compound having one structure represented by R—O—CO—CR'═CH—R" will be described below (i.e., Compounds A-33 to A-45).

A-33

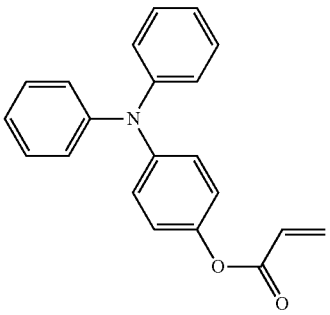

-continued

A-34

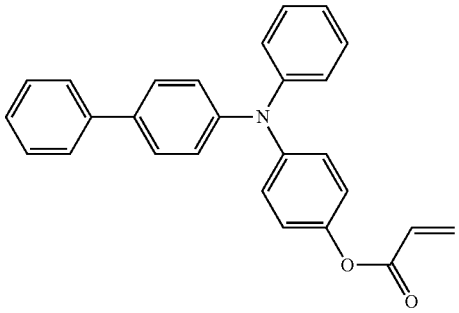

A-35

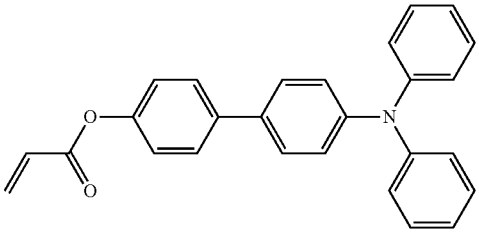

-continued
A-36
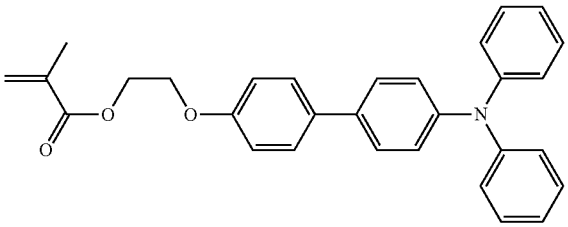
A-37
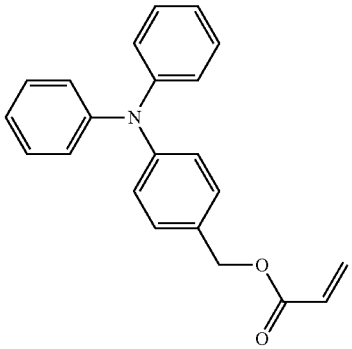
A-38
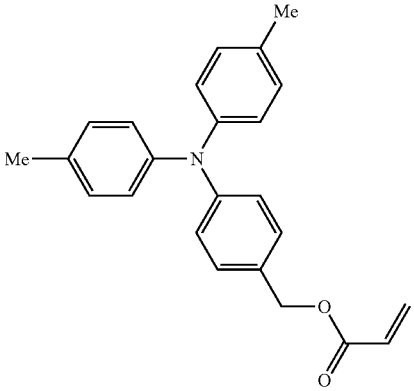
A-39
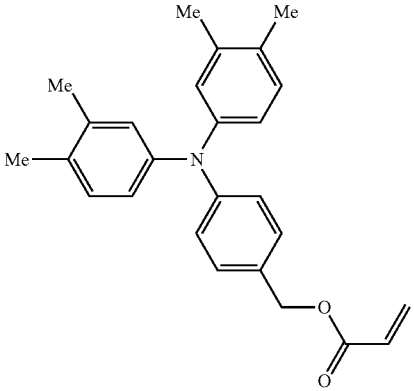
-continued
A-40
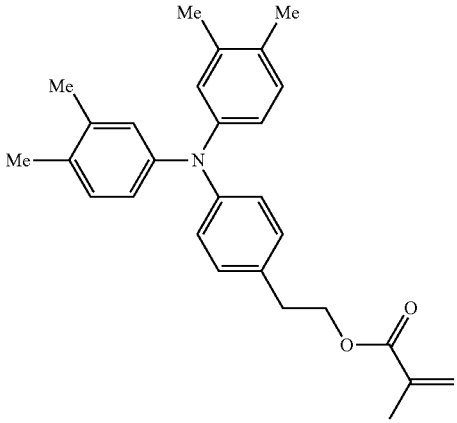
A-41
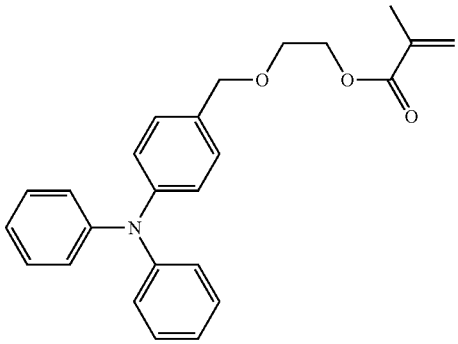
A-42
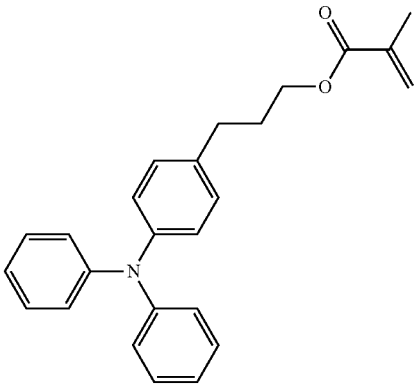

-continued

A-43

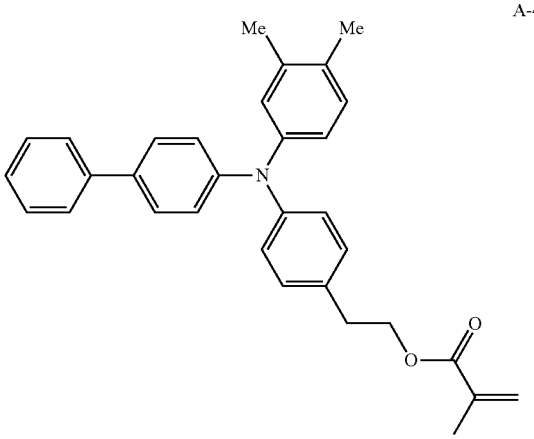

A-44

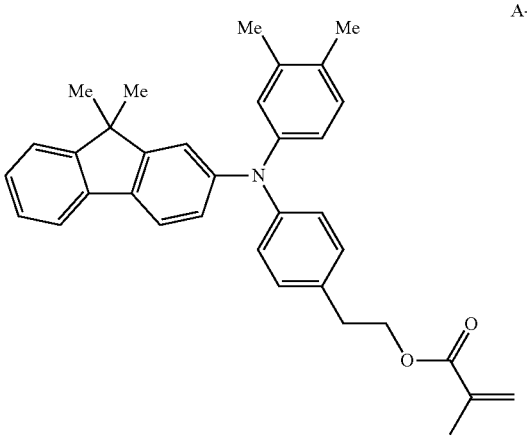

-continued

A-45

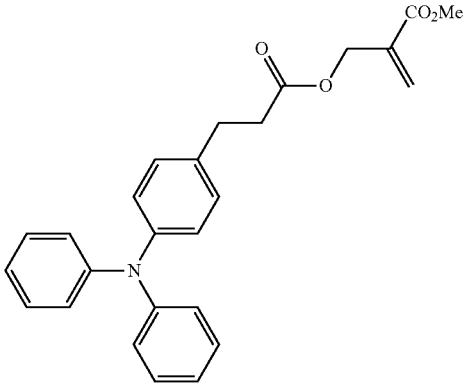

The compound represented by formula (A) is synthesized as follows.

That is, the compound represented by formula (A) can be synthesized by the condensation of alcohol of the precursor and corresponding methacrylic acid, or methacrylic acid halide, or in a case in which alcohol of the precursor is a benzyl alcohol structure, the compound can be synthesized by dehydration etherification with a methacrylic acid derivative having a hydroxy group such as hydroxyethyl methacrylate.

The synthesis routes of Compound A-4 and Compound A-17 for use in this embodiment are shown below as examples, (Synthesis route of Compound A-4)

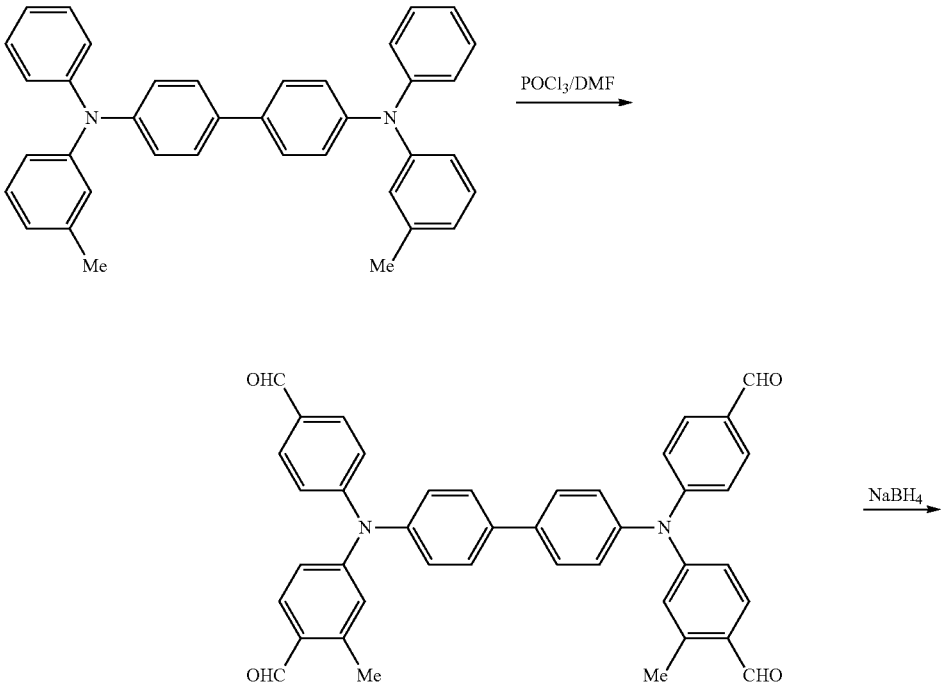

-continued
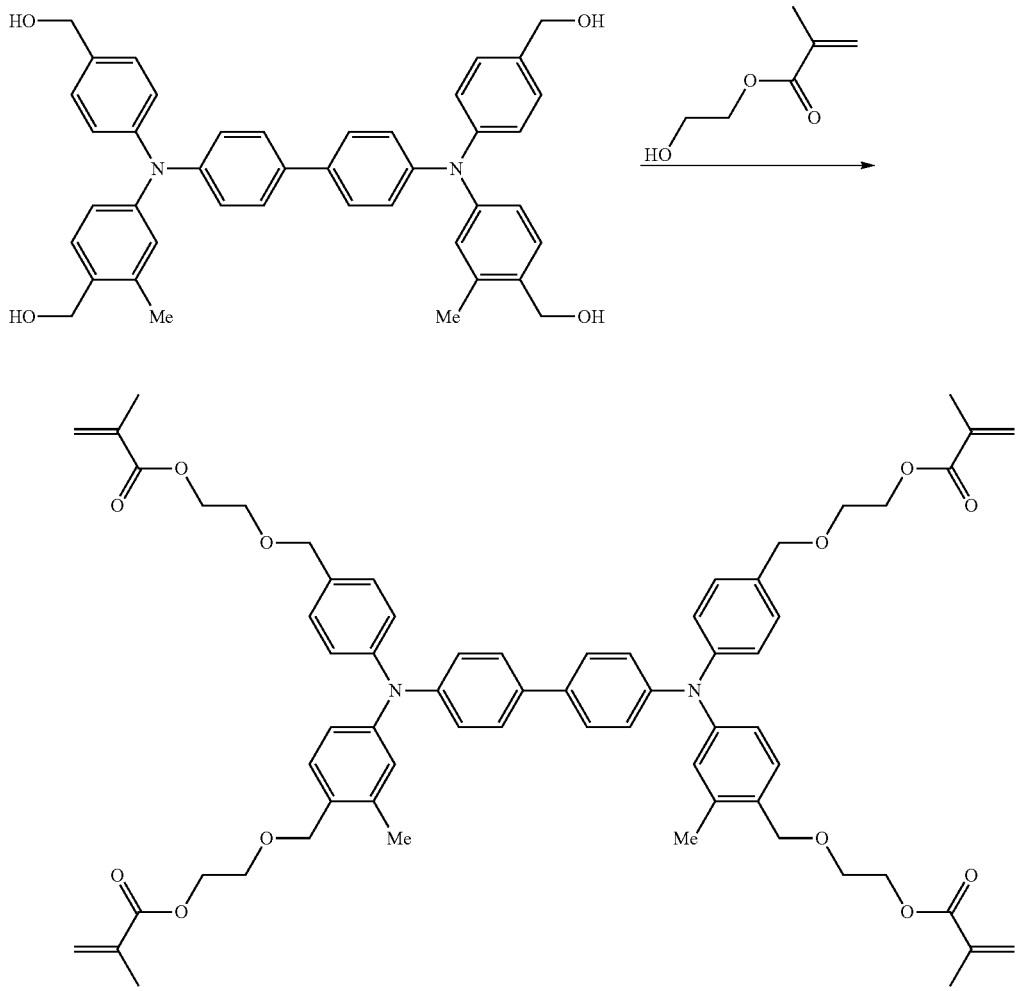
(Synthesis route of Compound A-29)
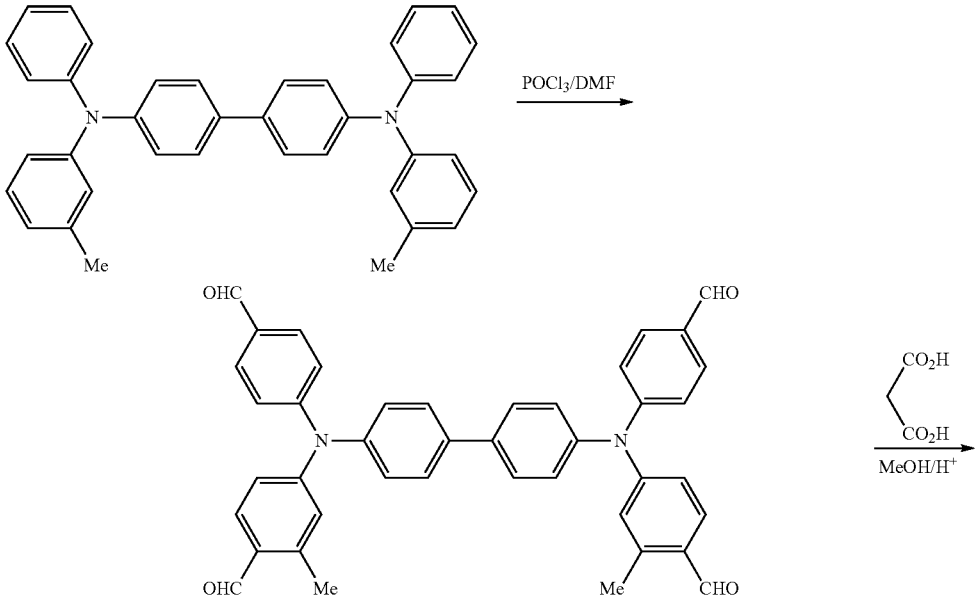

-continued
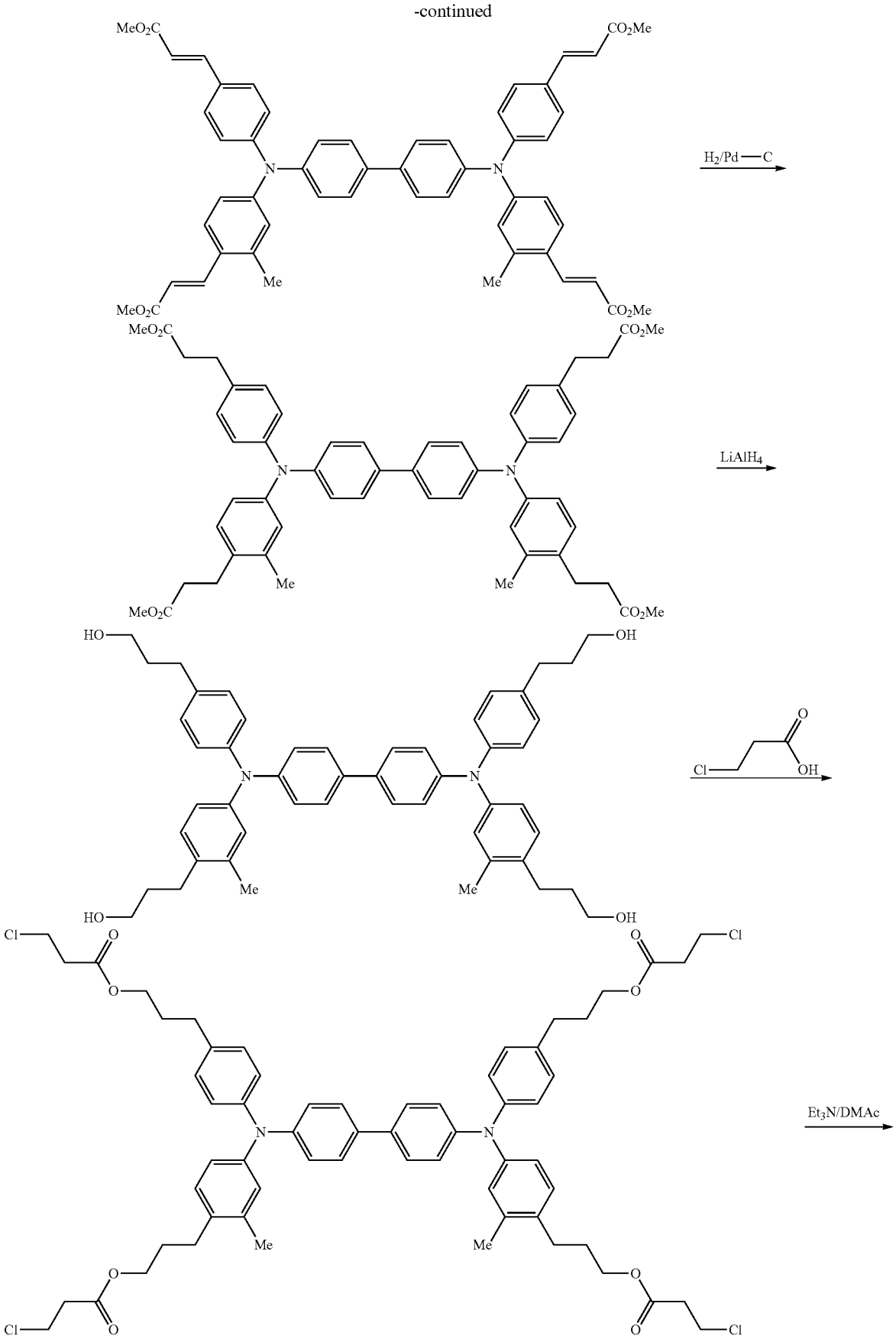

-continued

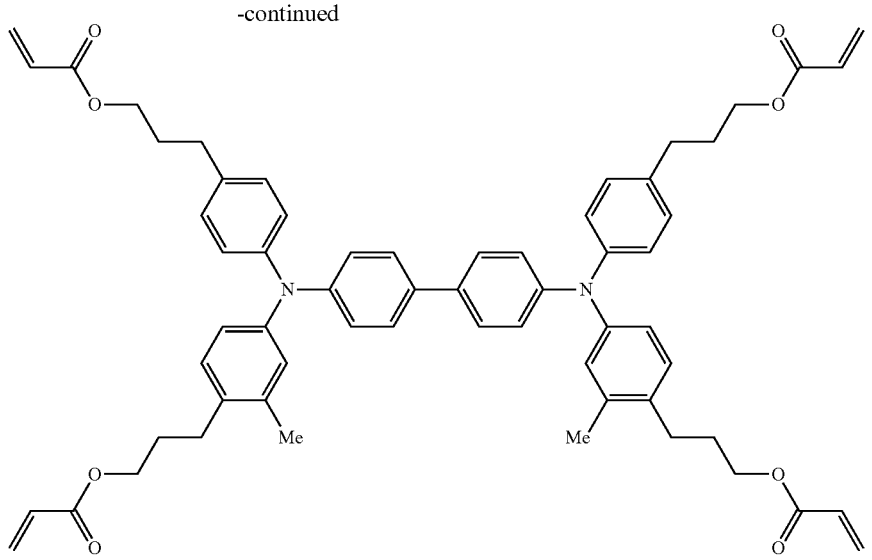

The total content of the charge transporting materials (a) having a reactive group is preferably 25% by weight or more and 95% by weight or less, based on the total solid of the composition for use in forming protective layer 5 (outermost layer), more preferably 25% by weight or more and 80% by weight or less, and even more preferably 40% by weight or more and 60% by weight or less.

When the total content is in this range, a cured film (an outermost layer) having excellent strength and electric characteristics can be obtained and thickening of the cured film is possible.

(Polycarbonate Resin)

The cured film which constitutes the protective layer (the outermost layer) 5 contains the polycarbonate resin. Type of the polycarbonate resin is not specifically limited, and bisphenol Z polycarbonate resin, bisphenol A polycarbonate resin, bisphenol C polycarbonate resin, bisphenol P polycarbonate resin and the like are used. In terms of solubility and pot-life of a coating solution, bisphenol Z polycarbonate resin and bisphenol P polycarbonate resin are preferable. More preferably, bisphenol Z polycarbonate resin is used.

The polycarbonate resins are used singly or in combination of two or more thereof.

The viscosity average molecular weight of the polycarbonate resin is, in terms of viscosity of solution, miscibility, and smoothness of the surface of coated film, preferably from 10,000 to 100,000, more preferably 20,000 to 90,000, and still more preferably from 25,000 to 80,000.

The total content of the polycarbonate resin is, relative to the total solid matter of the composition that is used for forming the protective layer 5 (the outermost layer), preferably from 5% by weight to 70% by weight, more preferably from 5% by weight to 65% by weight, and still more preferably from 5% by weight to 60% by weight.

The blending ratio of the compound with charge transporting property (the compound including charge transporting material (a) and/or (b)) is, in terms of weight ratio, preferably from 95:5 to 40:60, more preferably from 95:5 to 45:55, and still more preferably from 95:5 to 50:50.

(Non-Reactive Charge Transporting Material (b))

The cured film which constitutes the protective layer (the outermost layer) 5 may further contain a non-reactive charge transporting material (b) which has a charge transporting skeleton but no radical polymerizable unsaturated double bond, in addition to the reactive charge transporting material (a) described above. Since the non-reactive charge transporting material (b) does not contain any reactive group that is not responsible for charge transport, when the non-reactive charge transporting material (b) is used for the protective layer 5 (the outermost layer), the concentration of a charge transporting component is actually increased, and therefore it is effective for further improvement in the electric characteristics. Furthermore, by adding the non-reactive charge transporting material (b), cross-linking density may be reduced to control the strength.

As for the charge transporting skeleton of the non-reactive charge transporting material (b), the charge transporting skeleton explained in the above for the reactive charge transporting material (a) above may be also used. In particular, having the same the charge transporting skeleton in the non-reactive charge transporting material (b) as the reactive charge transporting material (a) is preferable in that miscibility between the reactive charge transporting material (a) and the non-reactive charge transporting material (b) is improved, resulting in a further increase in the charge transporting property and film strength.

Furthermore, with respect to the non-reactive charge transporting material (b), the phrase "having the same the charge transporting skeleton as the reactive charge transporting material (a)" means that the structure of the skeleton is identical to each other. On the charge transporting skeleton, a substituent group such as an alkyl group, for example, a methyl group and an ethyl group, and an alkoxy group, for example, a methoxy group and an ethoxy group may be included.

As for the non-reactive charge transporting material (b), a charge transporting material well known in the art may be used. Specifically, a triarylamine compound, a benzidine compound, an arylalkane compound, an aryl-substituted ethylene compound, a stilbene compound, an anthracene compound, a hydroazone compound and the like are used.

Among these, in terms of the mobility, miscibility and the like, a compound having the triphenylamine skeleton is preferably used.

The non-reactive charge transporting material (b) is used, relative to the total solid matter in a coating solution for forming a layer, preferably in an amount of 2% by weight to 50% by weight, more preferably 5% by weight to 45% by weight, and still more preferably 10% by weight to 40% by weight.

(Reactive Compound (c) Having No Charge Transporting Skeleton)

The cured film which constitutes the protective layer (the outermost layer) 5 may contain the reactive compound (c) having two or more structures represented by R—O—CO—CR'═CH—R" but without having a charge transporting skeleton, in addition to the reactive charge transporting material (a) described above to increase film strength by enhancing the cross-linking density. However, as the reactive compound (c) has no charge transporting skeleton, in order not to lower the charge transporting property, it is preferable that the reactive compound (c) is not contained in the cured film which constitutes the protective layer 5 (the outermost layer).

The reactive compound (c) which is used for the cured film constituting the protective layer (the outermost layer) 5 may be in any form including a monomer, an oligomer, and a polymer. Specifically, examples of the monofunctional monomer as the reactive compound (c) include isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxy acrylate, 2-hydroxypropyl acrylate, 4-hydroxybutyl acrylate, methoxy polyethylene glycol acrylate, methoxy polyethylene glycol methacrylate, phenoxy polyethylene glycol acrylate, phenoxy polyethylene glycol methacrylate, hydroxyethyl o-phenylphenol acrylate, and o-phenylphenol glycidyl ether acrylate.

Examples of the bifunctional monomer as the reactive compound (c) include diethylene glycol di(meth)acrylate, polyethylene glycol di(meth)acrylate, polypropylene glycol di(meth)acrylate, neopentyl glycol di(meth)acrylate, and 1,6-hexanediol di(meth)acrylate.

Examples of the trifunctional monomer as the reactive compound (c) include trimethylolpropane tri(meth)acrylate, pentaerythritol tri(meth)acrylate, and aliphatic tri(meth)acrylate.

Examples of the tetrafunctional monomer as the reactive compound (c) include pentaerythritol tetra(meth)acrylate, ditrimethylolpropane tetra(meth)acrylate, and aliphatic tetra (meth)acrylate.

Examples of the pentafunctional or more-functional monomer as the reactive compound (c) include dipentaerythritol penta(meth)acrylate, dipentaerythritol hexa(meth)acrylate and (meth)acrylates having a polyester skeleton, a urethane skeleton or a phosphazene skeleton.

Furthermore, examples of a polymer as the reactive compound (c) include those disclosed in JP-A Nos. 5-216249, 5-323630, 11-52603, and 2000-264961, etc.

When the reactive compound (c) is used, it can be used alone or as a mixture of two or more. The reactive compound (c) is used in an amount of 100% by weight or less, preferably 50% by weight or less and more preferably 30% by weight or less with respect to the total amount of a compound having a charge transporting property. Still more preferably, it is not contained in the cured film which constitutes the protective layer 5 (the outermost layer).

(Other Resins)

In the cured film which constitutes the protective layer (the outermost layer) 5 satisfying the requirements described above, the miscibility between the charge transporting compound (a) and the polycarbonate resin is excellent, so that a non-reactive binder resin having no structure represented by R—O—CO—CR'═CH—R" above may be also added. Thus, for the purpose of obtaining resistance to discharge gas, adhesiveness, mechanical strength, resistance to scratch, particle dispersability, viscosity control, torque reduction, abrasion amount control, and extension of pot-life, etc., a non-reactive binder resin may be added. By using a non-reactive binder resin, viscosity of the composition is improved and the protective layer (the outermost layer) 5 having excellent surface properties can be produced. Furthermore, it also contributes to improvement in the gas barrier property, which prevents intrusion of gas into the outermost layer, and enhanced adhesiveness to the underlying layer.

Examples of the non-reactive binder resin may include publicly well known resins such as polyester resin, polyacrylate resin, methacrylate resin, acrylate resin, polyvinyl chloride resin, polyvinylidene chloride resin, and polystyrene resin.

Furthermore, for the purpose of obtaining resistance to discharge gas, mechanical strength, resistance to scratch, particle dispersability, viscosity control, torque reduction, abrasion amount control, and extension of pot-life, etc. of the protective layer 5 (the outermost layer), a resin which is soluble in alcohols may be also added.

The non-reactive binder resin is used, relative to the total amount of a compound having charge transporting property, in an amount of 100% by weight or less, preferably 50% by weight or less, and more preferably 30% by weight or less.

(Thermal Polymerization Initiator)

For forming the protective layer (the outermost layer) 5, a photocurable catalyst or a thermal polymerization initiator may be used. As for the curing catalyst and thermal polymerization initiator, a publicly well known photocurable catalyst or thermal polymerization initiator can be used.

(Photo-Curing Catalysts)

As photo-curing catalysts, intramolecular cleavage type and hydrogen drawing type curing catalysts are exemplified.

As the intramolecular cleavage type curing catalysts, benzyl ketal-based, alkylphenone-based, aminoalkylphenone-based, phosphine oxide-based, titanocene-based, and oxime-based curing catalysts.

Example of the benzyl ketal-based curing catalyst includes 2,2-dimethoxy-1,2-diphenylethan-1-one.

Example of the alkylphenone-based photo-curing catalysts includes 1-hydroxycyclohexyl phenyl ketone, 2-hydroxy-2-methyl-1-phenylpropan-1-one, 1-[4-(2-hydroxyethoxy)phenyl]-2-hydroxy-2-methyl-1-propan-1-one, 2-hydroxy-1-{4-[4-(2-hydroxy-2-methylpropionyl)benzyl]phenyl}-2-methylpropan-1-one, acetophenone, and 2-phenyl-2-(p-toluenesulfonyloxy)-acetophenone.

Example of the aminoalkylphenone-based curing catalysts includes p-dimethylaminoacetophenone, p-dimethylaminopropiophenone, 2-methyl-1-(4-methylthiophenyl)-2-morpholinopropan-1-one, and 2-benzyl-2-dimethylamino-1-(4-morpholinophenyl)-butanone-1,2-(dimethylamino)-2-[(4-methylphenyl)methyl]-1-[4-(4-morpholinyl)phenyl]-1-butanone.

Example of the phosphine oxide-based curing catalysts includes 2,4,6-trimethylbenzoyl-diphenyl phosphineoxide, and bis(2,4,6-trimethylbenzoyl)phenyl phosphineoxide.

Example of the titanocene-based curing catalyst includes bis(η5-2,4-cyclopentadien-1-yl)-bis[2,6-difluoro-3-(1H-pyrrol-1-yl)-phenyl]titanium.

Example of the oxime-based curing catalysts includes 1,2-octanedione, 144-(phenylthio)-, 2-(O-benzoyloxime), ethanone, 1-[9-ethyl-6-(2-methylbenzoyl)-9H-carbazol-3-yl]-, 1-(O-acetyloxime).

As the hydrogen drawing type curing catalysts, benzophenone-based, thioxanthone-based, benzyl-based, and Michler's ketone-based catalysts are exemplified.

A specific example of the benzophenone-based catalysts includes 2-benzoyl benzoic acid, 2-chlorobenzophenone, 4,4'-dichlorobenzo-phenone, 4-benzoyl-4'-methyldiphenyl sulfide, and p,p'-bisdiethylaminobenzophenone.

Example of the thioxanthone-based curing catalysts includes 2,4-diethylthioxanthen-9-one, 2-chlorothioxanthone, and 2-isopropylthioxanthone.

Example of the benzyl-based curing catalysts includes benzyl, (±)-camphor-quinone, and p-anisyl.

These photo-curing catalysts may be used alone, or in a combination of two or more kinds.

—Thermal Polymerization Initiator—

Examples of the commercially available thermal polymerization initiator include an azo type initiator such as V-30, V-40, V-59, V601, V65, V-70, VF-096, VE-73, Vam-110, Vam-111 (trade names, all manufactured by Wako Pure Chemicals Industries, Ltd.), OTAzo-15, OTazo-30, AIBM, AMBN, ADVN, ACVA (trade names, all manufactured by Otsuka Chemical Co., Ltd.), etc; and Pertetra A, Perhexa HC, Perhexa C, Perhexa V, Perhexa 22, Perhexa MC, Perbutyl H, Percumyl H, Percumyl P, Permenta H, Perocta H, Perbutyl C, Perbutyl D, Perhexyl D, Peroyl IB, Peroyl 355, Peroyl L, Peroyl SA, NYPER BW, NYPER BMT-K40/M, Peroyl IPP, Peroyl NPP, Peroyl TCP, Peroyl OPP, Peroyl SBP, Percumyl ND, Perocta ND, Perhexyl ND, Perbutyl ND, Perbutyl NHP, Perhexyl PV, Perbutyl PV, Perhexa 250, Perocta O, Perhexyl O, Perbutyl O, Perbutyl L, Perbutyl 355, Perhexyl I, Perbutyl I, Perbutyl E, Perhexa 25Z, Perbutyl A, Perhexyl Z, Perbutyl ZT, Perbutyl Z (trade names, all manufactured by NOF CORPORATION), Kayaketal AM-055, Trigonox 36-C75, Laurox, Perkadox L-W75, Perkadox CH-50L, Trigonox TMBH, Kaya cumen H, Kaya butyl H-70, Perkadox BC-FF, Kaya hexa AD, Perkadox 14, Kaya butyl C, Kaya butyl D, Kaya hexa YD-E85, Perkadox 12-XL25, Perkadox 12-EB20, Trigonox 22-N70, Trigonox 22-70E, Trigonox D-T50, Trigonox 423-C70, Kaya ester CND-C70, Kaya ester CND-W50, Trigonox 23-C70, Trigonox 23-W50N, Trigonox 257-C70, Kaya ester P-70, Kaya ester TMPO-70, Trigonox 121, Kaya ester 0, Kaya ester HTP-65W, Kaya ester AN, Trigonox 42, Trigonox F-050, Kaya butyl B, Kaya carbon EH-C70, Kaya carbon EH-W60, Kaya carbon 1-20, Kaya carbon BIC-75, Trigonox 117, Kayaren 6-70 (trade names, all manufactured by Kayaku Akzo), Luperox 610, Luperox 188, Luperox 844, Luperox 259, Luperox 10, Luperox 701, Luperox 11, Luperox 26, Luperox 80, Luperox 7, Luperox 270, Luperox P, Luperox 546, Luperox 554, Luperox 575, Luperox TANPO, Luperox 555, Luperox 570, Luperox TAP, Luperox TBIC, Luperox TBEC, Luperox JW, Luperox TAIC, Luperox TAEC, Luperox DC, Luperox 101, Luperox F, Luperox DI, Luperox 130, Luperox 220, Luperox 230, Luperox 233, and Luperox 531 (trade names, all manufactured by ARKEMA Yoshitomi).

Among these, by using the azo type polymerization initiator having a molecular weight of 250 or more, a homogenous reaction occurs at a low temperature, enabling the obtainment of a high-strength film having excellent miscibility between the reactive charge transporting material (a) and the polycarbonate resin. More suitably, the molecular weight of the azo type polymerization initiator is 250 or more, and still more suitably 300 or more.

The total content of a photocurable catalyst or a thermal polymerization initiator is from 0.1% to 10% by weight, preferably from 0.1% to 8% by weight, and more preferably from 0.1% to 5% by weight with respect to the total solid matter contained in a coating solution that is used for forming a layer.

(Other Additives)

For the purpose of controlling a film forming property, flexibility, lubricating property, and adhesiveness, the cured film which constitutes the protective layer (the outermost layer) 5 may be also used in the form of a mixture with other coupling agents, in particular a fluorine-containing coupling agent. Examples of such compounds include various silane coupling agents and commercially available silicone hard-coating agents.

Examples of the silane coupling agent include vinyltrichlorosilane, vinyltrimethoxysilane, vinyltriethoxysilane, γ-glycidoxypropylmethyldiethoxysilane, glycidoxypropyltrimethoxysilane, γ-aminopropyltriethoxysilane, aminopropyltrimethoxysilane, γ-aminopropylmethyldimethoxysilane, N-β-(aminoethyl)-γ-aminopropyltriethoxysilane, tetramethoxysilane, methyltrimethoxysilane, and dimethyldimethoxysilane.

Examples of the commercially available hard coating agent include agents KP-85, X-40-9740, and X-8239 (each manufactured by Shin-Etsu Chemical Co., Ltd.), and agents AY42-440, AY42-441, and AY49-208 (each manufactured by Dow Corning Toray Co., Ltd.).

In order to give water repellency and others thereto, a fluorine-containing compound may be added thereto, examples of the compound including (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H, 1H,2H,2H-perfluoroalkyltriethoxysilane, 1H,1H,2H,2H-perfluorodecyltriethoxysilane, and 1H,1H, 2H,2H-perfluorooctyltriethoxysilane.

Silane coupling agents can be used in an optional amount, but the amount of fluorine-containing compounds is preferably 0.25 times or less by weight to compounds not containing fluorine from the viewpoint of a film forming ability of a crosslinked film. Further, reactive fluorine-containing compounds disclosed in JP-A No. 2001-166510 may be blended.

In order to prevent a deterioration owing to oxidizing gases, such as ozone, which are generated in a device for electrifying the protective layer (outermost layer) 5, an anti-deterioration agent may be desirably added to a cured film which configurates the protective layer (outermost layer) 5. As the mechanical strength of the surface of any photoreceptor is enhanced and the lifespan of the photoreceptor becomes longer, the photoreceptor contacts oxidizing gases for a longer period. Accordingly, there is a case where a stronger oxidization resistance is required than in the prior art.

The anti-deterioration agent is preferably a hindered phenol-based compound or hindered amine-based compound, and a known antioxidant such as an organic sulfur antioxidant, a phosphite antioxidant, a dithiocarbamic acid salt antioxidant, a thiourea antioxidant, or a benzimidazole antioxidant may be used as the anti-deterioration agent. The addition amount of the anti-deterioration agent is preferably 20% or less by weight with respect to the total weight of the cured film for forming the protective layer, and more preferably 10% or less by weight thereof.

Examples of the hindered phenol antioxidant include agents "IRGANOX 1076", "IRGANOX 1010", "IRGANOX 1098", "IRGANOX 245", "IRGANOX 1330", "IRGANOX 3114", and "IRGANOX 1076", and 3,5-di-t-butyl-4-hydroxybiphenyl.

Examples of the hindered amine antioxidant include agents "SANOL LS2626", "SANOL LS765", "SANOL LS770", "SANOL LS744", "TINUVINE 144", "TINUVINE 622LD", "MARK LA57", "MARK LA67", "MARK LA62", "MARK LA68", and "MARK LA63". Examples of the thioether antioxidant include agents "SUMIRIZER TPS", and "SUMIRIZER TP-D". Examples of the phosphite antioxidant include agents "MARK 2112", "MARK PEP-8", "MARK PEP-24G", "MARK PEP-36", "MARK 329K", and "MARK HP-10".

Furthermore, in order to lower residual potential or to improve the strength, conductive particles or organic or inorganic particles may be added to the cured film which constitutes the protective layer (the outermost layer) 5.

An example of the particles includes silicon-containing particles. The silicon-containing particles are the particles containing silicon therein as a constituting element, and specific examples of the silicon-containing particles include colloidal silica and silicone particles. The colloidal silica used as the silicon-containing particles is selected from dispersions in each of which silica having an average particle diameter of 1 nm to 100 nm, preferably 10 nm to 30 nm is dispersed in an acidic or alkali water dispersion liquid or an organic solvent such as such as alcohol, ketone, and ester. As for the particles, commercially available particles may be also used.

The content of solid matter content of the colloidal silica in the surface layer is not specifically limited. However, in terms of a film forming property, electrical characteristics and strength, the content of solid matter is in the range of 0.1% to 50% by weight, and preferably 0.1% to 30% by weight, with respect to the total amount of solid matter in the protective layer 5.

The silicone particles used in the silicon-containing particles are selected from silicone resin particles, silicone rubbery particles, and silicone surface-treated silica particles. Generally and commercially available silicon-containing particles may be used. The silicone particles are in a spherical form, and the average particle diameter thereof is desirably from 1 nm to 500 nm, and more preferably from 10 nm to 100 nm. The silicone particles are chemically inactive small-diameter particles having excellent resin-dispersion property. Furthermore, the content by percentage thereof necessary for obtaining a satisfactory property is low. For these reasons, the surface property of the electrophotographic photoreceptor is improved without hindering the crosslinking reaction. In other words, by the particles cause, the lubricating property and the water repellency of the electrophotographic photoreceptor surface is improved in the state that the particles are uniformly taken in the strong crosslinked structure. Thus, good abrasion resistance and contamination adhesion resistance of the electrophotographic photoreceptor are kept over a long term.

The content by percentage of the silicone particles in the protective layer 5 is preferably from 0.1% by weight to 30% by weight of the whole of solids in the protective layer 5, and more preferably from 0.5% by weight to 10% by weight thereof.

Other examples of the particles include particles of fluorine-containing compounds such as ethylene tetrafluoride, ethylene trifluoride, propylene hexafluoride, vinyl fluoride, or vinylidene fluoride; particles made of a resin obtained by copolymerizing a fluorocarbon-based monomer and a monomer having a hydroxyl group, as described in "8$^{th}$ Polymeric Material Forum Lecture, Proceedings, p. 89"; and particles made of a semiconductive metal oxide such as $ZnO—Al_2O_3$, $SaO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, or MgO.

For a similar purpose, an oil such as silicone oil may be added to the protective layer (outermost layer) 5. Examples of the silicone oil include ordinary silicone oils such as dimethylpolysiloxane, diphenylpolysiloxane, and phenylmethylsiloxane; reactive silicone oils such as amino-modified polysiloxane, epoxy-modified polysiloxane, carboxyl-modified polysiloxane, carbitol-modified polysiloxane, methacrylic modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as 3-(3,3,3-trifluoropropyl)-1-methylcyclotrisiloxane; hydrosilyl-group-containing cyclosiloxanes such as a methylhydrosiloxane mixture, pentamethylcyclopentasiloxane, and phenylhydrocyclosiloxane; and vinyl-group-containing cyclosiloxanes such as pentavinylpentamethylcyclopentasiloxane.

A metal, a metal oxide, carbon black and/or some other material may be added to the protective layer (outermost layer) 5. Examples of the metal include aluminum, zinc, copper, chromium, nickel, silver, and stainless steel. A product wherein such a metal is evaporated onto the surfaces of plastic particles may be added to the layer 5. Examples of the metal oxide include zinc oxide, titanium oxide, tin oxide, antimony oxide, indium oxide, bismuth oxide, indium oxide doped with tin, tin oxide doped with antimony or tantalum, and zirconium oxide doped with antimony. These may be used alone or in combination of two or more kinds. When two or more of the oxides are used in combination, they may be simply mixed with each other, or may be made into the form of a solid solution or a melted body. The average particle diameter of the conductive particles is preferably 0.3 μm or less, and more preferably 0.1 μm or less from the viewpoint of the transparency of the protective layer.

(Composition)

It is preferred that the composition containing the specific reactive charge transporting materials (a) and a polycarbonate resin, which are used for forming protective layer 5 is prepared as a coating solution for forming a protective layer.

The coating solution for forming a protective layer may be free of solvents, or the solution is prepared with an aromatic solvent, e.g., toluene or xylene, a ketone solvent, e.g., methyl ethyl ketone, methyl isobutyl ketone, or cyclohexanone, an ester solvent, e.g., ethyl acetate or butyl acetate, an ether solvent, e.g., tetrahydrofuran or dioxane, a cellosolve solvent, e.g., ethylene glycol monomethyl ether, or an alcohol solvent, e.g., isopropyl alcohol or butanol, alone or as a mixed solvent.

When the above-mentioned components are caused to react with each other to obtain the coating solution, the individual components may be merely mixed with each other, so as to dissolve the solid components. The individual components may be heated under the conditions of temperature ranging preferably from room temperature to 100° C., and more preferably from 30 to 80° C. and heating period ranging preferably from 10 minutes to 100 hours, and more preferably from 1 to 50 hours. In this time, ultrasonic waves may be applied to the individual components.

In this way, uniformity of the coating solution is enhanced, and thereby a coated film suppressed coat defects is easily obtained.

(Formation of Protective Film 5)

A coating solution for forming the protective film, which is made of the composition containing the reactive charge transporting material (a) and the polycarbonate resin, is applied onto the charge transporting layer 3, the surface of which constitutes a surface to which the coating solution is to be applied, by an ordinary coating method such as blade coating, wire bar coating, spray coating, dip coating, bead coating, air knife coating, or curtain coating.

Thereafter, heat, light or electron beam is supplied to the resultant coat to cause radical polymerization. In this way, the polymerizable component(s) in the coat is/are polymerized so as to cure the coat.

When the coated film is polymerized and cured by heat, the temperature for the heating may be preferably 50° C. or more. If the heating temperature is less than 50° C., the lifespan of the cured film unfavorably becomes short. The heating temperature is in particular preferably from 100 to 180° C. from the viewpoints of the strength, electric characteristics and the surface evenness of the photoreceptor.

When the coated film is polymerized and cured by light, light is irradiated from a known light irradiating device such as a mercury lamp or a metal halide lamp.

The polymerization and curing reaction are conducted in a vacuum, an inert gas atmosphere, or an low-oxygen-concentration environment in order not to inactivate radicals generated by the heat, light or electron beam. The concentration of oxygen is preferably 10% or less, more preferably 5% or less, even more preferably 2% or less, and most preferably 500 ppm or less.

In this exemplary embodiment, based on the reason that cross-linking and heterogeneity and wrinkles may be likely to form on the film and thereby it is difficult to achieve structure relaxation of a coated film when the reaction proceeds too fast, a thermal curing method by which generation of radicals occurs relatively slow is adopted. In particular, in the case of using the reactive charge transporting material (a) having a methacryloyl group having a lower reactivity than an acryloyl group, by combining this methacryloyl group with the thermal curing, structure relaxation of a coated film is promoted, and as a result the protective layer 5 (the outermost layer) having excellent surface properties is obtained.

Film thickness of the protective layer 5 is preferably from 5 μm to 40 μm, and more preferably from 7 μm to 35 μm.

(Physical Properties)

In this exemplary embodiment, when the protective layer 5 (the outermost layer) is measured by IR absorption spectrum, the ratio ($I_A/I_C$) between the absorption peak intensity ($I_C$) resulting from stretching vibration of a carbonyl group originating from the polycarbonate resin and the absorption peak intensity ($I_A$) resulting from stretching vibration of a carbonyl group originating from the structure R—O—CO—CR'═CH—R" contained in the charge transporting material (a) is from 0.5 or about 0.5 to 10 or about 10.

In a case in which the absorption peak intensity ratio ($I_A/I_C$) is within the range described above, the miscibility between the polycarbonate resin and the charge transporting compound (a) is improved, and therefore the outermost layer having both good electrical characteristics and sufficient strength is obtained.

With respect to the absorption peak intensity ratio ($I_A/I_C$), from the viewpoints of obtaining both good electrical characteristics and sufficient strength and suppressing deterioration in quality after repetitive use, it is suitably from 0.5 or about 0.5 to 10 or about 10, more preferably from 0.5 or about 0.5 to 9 or about 9, and still more preferably from 0.5 or about 0.5 to 8 or about 8.

Control of the absorption peak intensity ratio ($I_A/I_C$) is carried out by adjusting the blending ratio of the charge transporting compound (a) and the polycarbonate resin that are contained in a composition for forming the protective layer (the outermost layer) 5. The blending ratio is not specifically defined because it changes depending on the number of carbonyl groups contained in the charge transporting compound (a) and the number of carbonyl groups contained in the polycarbonate resin. However, in general, the ratio of the charge transporting compound (a) to the polycarbonate resin is preferably in the range of 95:5 to 40:60 in terms of weight ratio. More preferably, it is in the range of 95:5 to 45:55, and more preferably in the range of 95:5 to 50:50.

Furthermore, in the IR absorption spectrum of the protective layer (outermost layer) 5, the width at half maximum of the absorption peak of the absorption peak intensity ($I_A$) resulting from stretching vibration of the carbonyl group based on the structure R—O—CO—CR'═CH—R" contained in the charge transporting material (a) is 25 $cm^{-1}$ or about 25 $cm^{-1}$ or more. A wider width at half maximum of the absorption peak of the absorption peak intensity ($I_A$) is preferable, and the width at half maximum is more preferably 26 $cm^{-1}$ or about 26 $cm^{-1}$ or more, and is still more preferably 27 $cm^{-1}$ or about 27 $cm^{-1}$ or more.

The wider the width at half maximum of the absorption peak of the absorption peak intensity ($I_A$), the stronger the interaction with other functional groups in the outermost layer stronger and the more improved the mixing state of the charge transporting material (a) are performed. As a result, a film having excellent electrical characteristics and mechanical strength is obtained.

The width at half maximum of the absorption peak of the absorption peak intensity ($I_A$) described above may be controlled by adjusting the structure of the charge transporting material (a), the amount ratio relative to the polycarbonate resin, type of the polymerization initiator and the polymerization condition.

Specifically, by the combination capable of facilitating the miscibility of the structure of the reactive charge transporting material (a) and the structure of the polycarbonate resin, the width at half maximum of the absorption peak of the absorption peak intensity ($I_A$) may be more easily increased.

Furthermore, when polymerization and curing of a coating film, that is formed by applying the composition containing both the reactive charge transporting material (a) and the polycarbonate resin, is carried out at a temperature from 100° C. to 180° C., progress of the reaction is rather slow so that the width at half maximum of peak absorption $I_A$ increases. In particular, when the coating film is cured and polymerized by using the azo type polymerization initiator having a molecular weight of 250 or more, a homogenous reaction occurs at low temperature. Thus, it is effective for increasing the width at half maximum of the absorption peak of the absorption peak intensity ($I_A$).

Furthermore, when a polymerization initiator having a molecular weight of less than 250 is used, the width at half maximum of the absorption peak of the absorption peak intensity ($I_A$) increases as the temperature for polymerization and curing of the coating film increases. Thus, in a case in which a polymerization initiator having a molecular weight of less than 250 is used, it is preferable to carry out the polymerization and curing of the coating film at the temperature from 120° C. to 180° C.

Furthermore, the width at half maximum of the absorption peak of the absorption peak intensity ($I_A$) increases as the oxygen concentration decreases during polymerization. Specifically, the oxygen concentration is preferably 10% or less, more preferably 5% or less, even more preferably 2% or less and still more preferably 500 ppm or less.

Herein, a method of obtaining the absorption peak intensities $I_A$ and $I_C$ from the IR absorption spectrum will be explained.

By using a Fourier-transformed IR spectrophotometer, the IR absorption spectrum is measured for the protective layer (the outermost layer) 5 based on micro-ATR method using ATR prism and Ge. The obtained IR absorption spectrum is corrected by advanced ATR and the noise originating from water vapor is removed. Spectrum baseline is a line obtained by connecting the points having the lowest absorption intensities between the spectrum peak to be measured and the neighboring peak. Based on this baseline, the absorption peak intensities $I_A$ and $I_C$ are obtained. Furthermore, the width of absorption spectrum between the points at which the absorption intensity is the half intensity is obtained as the width at half maximum of the absorption peak.

Film thickness of the protective layer (the outermost layer) 5 is preferably from 5 μm to 40 μm, and more preferably 7 μm to 35 μm.

Herein above, an example of a function-separated photosensitive layer is explained in view of the electrophotographic photoreceptor 7A shown in FIG. 1. The same applies to the function separating type electrophotographic photoreceptor 7B shown in FIG. 2. Furthermore, in the case of the monolayer photosensitive layer 6 of electrophotographic photoreceptor 7C shown in FIG. 3, the following embodiment is preferable.

The content of the charge generating material (a) in monolayer photosensitive layer 6 is, from the viewpoint of film strength, 5% to 50% by weight, preferably 10% to 40% by weight, and still more preferably 15% to 35% by weight with respect to the total solid matter of the composition that is used for forming the protective layer (the outermost layer) 5.

The content of the charge generating material including the charge generating material (a) is 10% to 85% by weight, and preferably 20% to 50% by weight with respect to the total solid matter of the composition that is used for forming the protective layer (the outermost layer) 5. In addition, the content of the charge transporting material is preferably from 5% to 50% by weight.

Method of forming the monolayer type photosensitive layer 6 is the same as the method of forming the charge generating layer 2 or the charge transporting layer 3. Film thickness of the monolayer type photosensitive layer 6 is preferably from 5 μm to 50 μm or so, and more preferably 10 μm to 40 μm.

In the above-mentioned exemplary embodiment, its outermost layer, which is a cured membrane made of a composition containing a reactive charge transporting material (a) and a polycarbonate resin, is the protective layer 5. However, in another case where the exemplary embodiment has a layer structure which does not have the protective layer 5, its outermost layer is the charge transporting layer, which is positioned in the outermost surface in the layer structure.

When the outermost layer is the charge transporting layer, the thickness of this layer is preferably from 7 to 70 μm, and more preferably from 10 to 60 μm.

<Electroconductive Substrate>

The electroconductive substrate 4 may be a metallic plate, metallic drum or metallic belt made of aluminum, copper, zinc, stainless steel, chromium, nickel, molybdenum, vanadium, indium, gold, platinum or some other metal, or an alloy containing such a metal. The electroconductive substrate 4 may be a paper piece, a plastic film or a belt on which the following is painted, evaporated or laminated: an electroconductive polymer, an electroconductive compound such as indium oxide, a metal such as aluminum, palladium, or gold, or an alloy containing such a metal.

The term "electroconductive" herein means that the volume resistivity is less than $10^{13}$ Ω·cm.

When the electrophotographic photoreceptor 7A is used as a laser printer, the surface of the electroconductive substrate 4 may be made rough to have a centerline average roughness Ra of 0.04 μm to 0.5 μm in order to prevent interference fringes generated when a laser ray is irradiated thereto. When the roughness Ra is in the range of from 0.04 μm to 0.5 μm, the interference-preventing effect tends to become sufficient, and thereby an image quality tends to be suppressed to become rough when a coat is formed thereon. When an incoherent light ray is used as a light source, it is not particularly necessary to make the surface rough to prevent interference fringes. In this case, defects are prevented from being generated by irregularities in the electroconductive substrate 4 surface; thus, the case is suitable for making the lifespan of the electrophotographic photoreceptor longer.

Desired examples of the method for roughening the surface include wet honing performed by spraying a suspension wherein an abrasive agent is suspended in water onto the support, centerless grinding, wherein the support is brought into contact with a rotating grinding stone under pressure to attain grinding continuously, and anodic oxidation treatment.

An additional desired example of the surface-roughening method is a method of dispersing electroconductive or semi-electroconductive powder into a resin, and making the powder-dispersed product into a layer on the support surface, thereby making the electroconductive substrate 4 rough through the particles dispersed in the layer without roughening the substrate 4 surface directly.

The surface-roughening treatment based on anodic oxidation is a treatment of using aluminum as an anode to conduct anodic oxidation in an electrolytic solution, thereby forming an oxide film on the aluminum surface. Examples of the electrolytic solution include a sulfuric acid solution, and an oxalic acid solution. However, the porous anodic oxide film, which is formed by the anodic oxidation, is chemically active, is easily contaminated, and the resistance thereof is largely varied in accordance with the environment unless the film is subjected to any treatment. Thus, it is desired to conduct a pore-sealing treatment of sealing the fine pores in the anodic oxide film by volume expansion based on hydration reaction in pressured water vapor or boiling water, to which a salt of a metal such as nickel may be added, thereby changing the oxide to a hydrated oxide, which is more stable.

The film thickness of the anodic oxide film may be from 0.3 μm to 15 μm. When this film thickness is in the range of from 0.3 μm to 15 μm, the barrier property against the injection is effectual, and increment of the residual potential tends to be suppressed when the electrophotographic photoreceptor is repeatedly used.

The electroconductive substrate 4 may be subjected to a treatment with an aqueous acidic solution or boehmite treatment. A treatment with an acidic treating solution containing phosphoric acid, chromic acid, and hydrofluoric acid is conducted as follows: First, an acidic treatment solution is prepared. With respect to the blend ratio among phosphoric acid, chromic acid, and hydrofluoric acid in the acidic treatment solution, the amount of phosphoric acid, that of chromic acid, and that of hydrofluoric acid may be from 10% by weight to 11% by weight, from 3% by weight to 5% by weight, and form 0.5% by weight to 2% by weight, respectively, and the sum total concentration of these acids is preferably from 13.5% by weight to 18% by weight. The treatment temperature is preferably from 42° C. to 48° C. When the treatment temperature is kept at such a high temperature, a thicker coat is more rapidly formed. The thickness of the coat is preferably from 0.3 μm to 15 μm. When the thickness is in the range of from 0.3 μm to 15 μm, the barrier property against the injection tends to be effectual and, an increment of the residual potential tends to be suppressed when the electrophotographic photoreceptor is repeatedly used.

The boehmite treatment is conducted by immersing the electroconductive substrate 4 into pure water of 90° C. to 100° C. temperature for 5 to 60 minutes, or by bringing the substrate 4 into contact with heated water vapor of 90° C. to 120° C. for 5 to 60 minutes. The thickness of the coat may be preferably from 0.1 μm to 5 μm. The resultant may be further subjected to anodic oxidation treatment with an electrolyte solution containing an adipic acid, boric acid, borate (salt), phosphate (salt), phthalate (salt), maleate (salt), benzoate (salt), tartarate (salt) or citrate (salt) having lower coat-solubility.

<Undercoating Layer>

The undercoating layer 1 is, for example, a layer containing inorganic particles in a binder resin.

The inorganic particles may be preferably particles having a powder resistivity (volume resistivity) of $10^2$ Ω·cm to $10^{11}$ Ω·cm since the undercoating layer 1 is preferable to obtain an appropriate resistance to gain leakage resistance and carrier blocking property. When the resistivity of the inorganic particles is in the range of $10^2$ Ω·cm to $10^{11}$ Ω·cm, a sufficient leakage resistance may be obtained, and increment of the residual potential may be suppressed.

Among these inorganic particles having a resistivity in the range, inorganic particles such as tin oxide, titanium oxide, zinc oxide, or zirconium oxide are preferably used, and in particular zinc oxide particles are preferably used.

The inorganic particles may be subjected to surface treatment. Two or more inorganic particle species different from each other in applied surface treatment or in particle diameter may be used in a mixture form.

A specific surface area of the inorganic particles is preferably 10 $g/m^2$ or more as determined by the BET method. When the specific surface area is 10 $m^2/g$ or more, decline of the electric chargeability may be suppressed.

The volume-average particle diameter of the inorganic particles is preferably from 50 nm to 2000 nm, and more preferably from 60 nm to 1000 nm.

Furthermore, by incorporating an acceptor compound together with the inorganic particles into the undercoating layer, excellent long-term stability of electric characteristics and excellent carrier blocking property are given to the layer.

The acceptor compound is not limited as far as the undercoating layer gains the characteristic. Preferable examples thereof include quinone compounds such as chloranil, and bromoanil; tetracycanoquinodimethane compounds; fluorenone compounds such as 2,4,7-trinitrofluorenone, and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole and 2,5-bis(4-diethylaminophenol)-1,3,4-oxadiazole; xanthone compounds; thiophene compounds; diphenoquinone compounds such as 3,3',5,5'-tetra-t-butyldiphenoquinone; and other electron transporting materials. In particular, compounds having an anthraquinone structure are desired. Additional desired examples thereof include hydroxyanthraquinone compounds, aminoanthraquinone compounds, aminohydroxyanthraquinone compounds, and acceptor compounds having an anthraquinone structure. Specific examples thereof include anthraquinone, alizarin, quinizarin, anthrarufin, and purpurin.

The content by percentage of the acceptor compound is not restricted as far as the undercoating layer gains the characteristic. The content may be from 0.01% by weight to 20% by weight of the inorganic particles. The inorganic particles is preferably used in an adding content range of from 0.05% by weight to 10% by weight, from the viewpoints of preventing accumulation of electric charges and preventing aggregation of the inorganic particles. According to prevention of the aggregation of the inorganic particles, unevenness of forming electroconductive paths may be suppressed. Additionally, deterioration of the characteristic-maintaining performance such as increment of the residual potential may be suppressed, when the photoreceptor is repeatedly used. Besides, image quality defects, such as black spots, may be suppressed.

The acceptor compound may be added to an undercoating layer forming coating solution, or may be applied onto the surfaces of the inorganic particles to adhere it beforehand.

The method for applying the acceptor compound onto the inorganic particle surfaces may be a wet method or a dry method.

When this surface treatment is conducted by the dry method, the treatment is attained without dispersing the acceptor compound unevenly by stirring the inorganic particles by means of a mixer or the like that gives a large shearing force while dropping the acceptor compound directly thereon or dropping the acceptor compound dissolved in an organic solvent thereon, or spraying the compound or the compound dissolved in an organic solvent thereon together with dry air or nitrogen gas. The addition or spraying is conducted preferably at a temperature of the boiling point or less of the solvent. When the spraying is conducted at a temperature of the boiling point or less of the solvent, an eccentric location of the acceptor compound therein may be suppressed. After the addition or spraying, the resultant may be subjected to baking at 100° C. or more. The baking is performed at any temperature in any period as far as a desired electrophotographic characteristic is obtained.

In the wet method, the inorganic particles are stirred in a solvent, and dispersed therein by use of ultrasonic waves, a sand mill, an attriter, a ball mill or the like. The acceptor compound is added thereto, and stirred or dispersed, and then the solvent is removed, thereby conducting the treatment without dispersing the acceptor compound unevenly. The method for removing the solvent is filtration, or separation by distillation. After the removal of the solvent, the resultant may be subjected to baking at 100° C. or more. A temperature condition for the baking or a period condition for the baking is not restricted as far as a desired electrophotographic characteristic is obtained. In the wet method, water contained in the inorganic particles may be removed before the addition of a surface treatment agent. The method for the removal is, for example, a method of removing the water while the particles are stirred and heated in the solvent used in surface treatment, or a method of removing the water by boiling the water and the solvent azeotropically.

The inorganic particles may be subjected to surface treatment before the acceptor compound is supplied to the particles. The agent for the surface treatment may be any agent as far as the undercoating layer gains a desired characteristic, and may be selected from known materials. Examples of the agent include a silane coupling agent, a titanate based coupling agent, an aluminum based coupling agent, and a surfactant. In particular, a silane coupling agent is desirably used since the agent gives good electrophotographic characteristics. A silane coupling agent having an amino group is desirably used since the agent gives a good blocking property to the undercoating layer 1.

The silane coupling agent having an amino group may be any agent as far as a desired electrophotographic characteristic is obtained. Specific examples thereof include γ-aminopropyltriethoxysilane, N-β-(aminoethyl)-γ-aminopropyltrimethoxysilane, N-—-(aminoethyl)-γ-aminopropylmethyldimethoxysilane, and N,N-bis(β-hydroxyethyl)-γ-aminopropyltrithoxysilane. However, the agent is not limited to these examples.

About the silane coupling agent, two or more species thereof may be used in a mixture form. Examples of a silane coupling agent which may be used together with the silane coupling agent having an amino group include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrirnethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane. However, the agent is not limited to these examples.

The method for the surface treatment using these surface treatment agents may be any known method. It is advisable to use a dry method or wet method. It is allowable to conduct the supply of the acceptor compound and the surface treatment with the surface treatment agent such as a coupling agent, simultaneously.

The content by percentage of the silane coupling agent to the inorganic particles in the undercoating layer 1 is not limited as far as a desired electrophotographic characteristic is obtained. The content may be from 0.5% by weight to 10% by weight of the inorganic particles from the viewpoint of an improvement in the dispersibility thereof.

The undercoating layer 1 may contain a binder resin.

The binder resin contained in the undercoating layer 1 may be any binder resin that may form a good film and give a desired property. Examples thereof include known polymeric compounds such as acetal resins (for example, polyvinyl butyral), polyvinyl alcohol resin, casein, polyamide resin, cellulose resin, gelatin, polyurethane resin, polyester resin, methacrylic resin, acrylic resin, polyvinyl chloride resin, polyvinyl acetate resin, vinyl chloride/vinyl acetate/maleic anhydride resin, silicone resin, silicone-alkyd resin, phenol resin, phenol-formaldehyde resin, melamine resin, and urethane resin; and a known material such as a zirconium chelate compound, a titanium chelate compound, an aluminum chelate compound, a titanium alkoxide compound, an organic titanium compound, or a silane coupling agent.

Furthermore, as a binder resin that is contained in the underlying layer 1, a charge transporting resin having a charge transporting group, or a conductive resin such as polyaniline may be used. Among these, a resin which is insoluble in a solvent of coating solution for the upper layer is appropriate. In particular, a phenol resin, a phenol formaldehyde resin, a melamine resin, a urethane resin, an epoxy resin and the like are preferable. When these are used in combination of two or more, the mixing ratio is determined depending on the requirements.

In a coating solution for forming the undercoating layer, the ratio of the inorganic particles having their surfaces provided with the acceptor compound (acceptor-property-provided metal oxide) to the binder resin, or the ratio of the inorganic particles to the binder resin may be appropriately set as far as a desired electrophotographic characteristic is obtained.

Various additives may be added to the undercoating layer 1 to improve the electric characteristics, the environmental stability, or the image quality.

As the additives, it is possible to use any known materials such as an electron transporting pigment (for example, a condensed polycyclic pigment or an azo pigment), a zirconium chelate compound, a titanium chelate compound, an aluminum chelate compound, a titanium alkoxide compound, an organic titanium compound, or a silane coupling agent. The silane coupling agent is used for the surface treatment of the inorganic particles as described above; however, the agent may be added, as an additive, into the undercoating-layer-forming coating solution.

Specific examples of the silane coupling agent as the additive include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane.

Examples of the zirconium chelate compound include zirconiumbutoxide, zirconiumethyl acetoacetate, zirconiumtriethanolamine, acetylacetonate zirconiumbutoxide, ethyl acetoacetate zirconiumbutoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconiumbutoxide, stearate zirconiumbutoxide, and isostearate zirconiumbutoxide.

Examples of the titanium chelate compound include tetraisoprpyl titanate, tetra-n-butyl titanate, butyl titanate dimer, tetra(2-ethylhexyl) titanate, titanium acetylacetonate, polytitanium acetylacetonate, titaniumoctylene glycolate, an ammonium salt of titanium lactate, titanium lactate, an ethyl ester of titanium lactate, titaniumtriethanol aminate, and polyhydroxytitanium stearate.

Examples of the aluminum chelate compound include aluminum isopropionate, monobutoxyaluminum diisopropionate, aluminum butyrate, ethylacetoacetate aluminum diisopropionate, and aluminum tris(ethylacetoacetate).

These compounds may be used alone, or in the form of a mixture of two or more thereof or in the form of a polycondensate from two or more thereof.

The solvent for forming the undercoating layer-forming coating solution may be selected arbitrarily from known solvents such as alcoholic solvents, aromatic solvents, halogenated hydrocarbon solvents, ketone solvents, ketone alcohol solvents, ether solvents, and ester solvents.

The solvent may be an ordinary organic solvent, specific examples thereof including methanol, ethanol, n-propanol, iso-propanol, n-butanol, benzyl alcohol, methylcellosolve, ethylcellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

These solvents may be used alone or in the form of a mixture of two or more thereof. Any solvents may be used as a mixed solvent as far as the mixed solvent is able to dissolve a binder resin.

As the method for dispersing the inorganic particles when the undercoating layer-forming coating solution is prepared, it is possible to use any known methods such as a roll mill, a ball mill, a vibrating ball mill, an attriter, a sand mill, a colloid mill, or a paint shaker.

The coating method used to form the undercoating layer 1 may be an ordinary coating method such as blade coating, wire bar coating, spray coating, dip coating, bead coating, air knife coating or curtain coating.

The undercoating layer-forming coating solution obtained as described above is used to form the undercoating layer 1 on the electroconductive substrate.

The Vickers hardness of the undercoating layer 1 may be 35 or more.

The thickness of the undercoating layer 1 may be set into any value as far as a desired property is obtained. Specifically, the thickness is preferably 15 μm or more, and more preferably from 15 μm to 50 μm.

When the thickness of the undercoating layer 1 is in a range of from 15 μm to 50 μm, sufficient property for the leakage resistance may be improved, and residual potential may be lowered when the photoreceptor is used for a long period. As a result, an image density abnormality may be suppressed.

In order to prevent occurrence of a more fringe, the surface roughness (ten-point average roughness) of the undercoating layer 1 is adjusted in the range from ¼n of the wavelength of a radiating laser to be used, wherein n represents the refractive index of the overlaying layer to ½λ.

In order to adjust the surface roughness, particles made of a resin or the like may be added to the undercoating layer. The resin particles may be silicone resin particles, crosslinkable polymethyl methacrylate resin particles, or the like.

The surface of the undercoating layer may be polished to adjust the surface roughness.

The method, for the polishing may be buff polishing, sandblast treatment, wet honing, grinding treatment or the like.

The undercoating layer 1 is obtained by drying the undercoating layer-forming coating solution applied onto the electroconductive substrate 4. Usually, the drying is conducted at a temperature permitting the solvent to be evaporated so as to attain film-formation.

<Charge Generating Layer>

The charge generating layer 2 is a layer containing a charge generating material and a binder resin.

Examples of the charge generating material include azo pigments such as bisazo and trisazo pigments, condensed aromatic pigments such as dibromoanthanthrone, perylene pigments, pyrrolopyrrole pigments, phthalocyanine pigments, zinc oxide, and trigonal selenium. Among these materials, metal phthalocyanine pigments and metal-free phthalocyanine pigments are desirably used as the charge generating material so that the photoreceptor can be used for the radiation of a laser ray having a near infrared wavelength. Particularly, gallium hydroxyphthalocyanine disclosed in JP-A Nos. 5-263007 and 5-279591, and others, gallium chlorophthalocyanine disclosed in JP-A No. 5-98181 and others, tin dichlorophthalocyanine disclosed in JP-A Nos. 5-140472 and 5-140473, and others, and titanylphthalocyanine disclosed in JP-A Nos. 4-189873 and others are desirably used. In order to cause the photoreceptor to cope with the radiation of a laser ray having a near ultraviolet wavelengths, it is more desired to use, as the charge generating material, a condensed aromatic pigment such as dibromoanthanthrone; a thioindigo pigment, a porphyrazine compound, zinc oxide, trigonal selenium; bisazo pigments disclosed in JP-A Nos. 2004-78147 and 2005-181992; or the like.

The binder resin used in the charge generating layer 2 is selected from a wide range of insulating resins, or may be selected from organic photoconductive polymers such as poly-N-vinylcarbazole, polyvinylanthracene, polyvinylpyrene, and polysilane. Desired examples of the binder resin include polyvinyl butyral resin, polyarylate resin (such as a polyeondensate made from a bisphenol and an aromatic bivalent carboxylic acid), polycarbonate resin, polyester resin, phenoxy resin, vinyl chloride/vinyl acetate copolymer, polyamide resin, acrylic resin, polyacrylamide resin, polyvinyl pyridine resin, cellulose resin, urethane resin, epoxy resin, casein, polyvinyl alcohol resin, and polyvinyl pyrrolidone resin. These binder resins may be used alone or in the form of a mixture of two or more thereof. The blend ratio by weight of the charge generating material to the binder resin may be from 10/1 to 1/10. The word "insulating" herein means $10^{13}$ Ω·cm or more in terms of volume resistivity.

The charge generating layer 2 is formed using a charge generating layer-forming coating solution wherein the above-mentioned charge generating material and binder resin are dispersed in a predetermined solvent.

Examples of the solvent used for dispersion include methanol, ethanol, n-propanol, n-butanol, benzyl alcohol, methyl cellosolve, ethylcellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or in the form of a mixture of two or more thereof.

The method for dispersing the charge generating material and the binder resin into the solvent may be an ordinary method, such as a ball mill dispersing method, an attriter dispersing method, or a sand mill dispersing method. According to such a method, the crystal form of the charge generating material is prevented from being changed by dispersion.

At the time of the dispersion, it is effective to adjust the average particle diameter of the charge generating material to be 0.5 μm or less, preferably 0.3 μm or less, and more preferably 0.15 μm or less.

When the charge generating layer 2 is formed, an ordinary coating method is used, examples thereof including blade coating, Meyer bar coating, spray coating, dip coating, bead coating, air knife coating and curtain coating.

The film thickness of the thus-obtained charge generating layer 2 is preferably from 0.1 to 5.0 μm, and more preferably from 0.2 to 2.0 μm.

<Charge Transporting Layer>

In a case where the electrophotographic photo receptor is configurated with a protective layer including the charge transporting material (a) and the polycarbonate resin, the charge transporting layer 3 is formed so as to contain a charge transporting material and a binder resin, or a polymeric charge transporting material.

Examples of the charge transporting material include quinone compounds (for example, p-benzoquinone, chloranil, bromanil and anthraquinone), tetracyanoquinodimethane compounds, fluorenone compounds (for example, 2,4,7-trinitrofluorenone), xanthone compounds, benzophenone compounds, cyanovinyl compounds, ethylene compounds, and other electron transporting compounds; and triarylamine compounds, benzidine compounds, arylalkane compounds, aryl-substituted ethylene compounds, stylbene compounds, anthracene compounds, hydrazone compounds, and other hole transporting compounds; however, the charge transporting material is not limited thereto. These charge transporting materials may be used alone or in a combination of two or more thereof.

From the viewpoint of charge mobility, the charge transporting material is preferably a triarylamine derivative represented by a structural formula (a-1) illustrated below or a benzidine derivative represented by a structural formula (a-2) illustrated below.

(a-1)

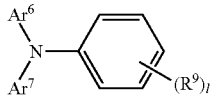

In the structural formula (a-1), $R^9$(s) (each) represent a hydrogen atom or methyl group; 1 represents 1 or 2; $Ar^6$ and $Ar^7$ each independently represent a substituted or unsubstituted aryl group, $—C_6H_4—C(R^{10})=C(R^{11})(R^{12})$, or $—C_6H—CH=CH—CH=C(R^{13})R^{14}$ wherein $R^{10}$, $R^{11}$, $R^{12}$, $R^{13}$ and $R^{14}$ each independently represent a hydrogen atom, a substituted or unsubstituted alkyl group, or a substituted or unsubstituted aryl group.

Examples of the substituent of each of the groups include halogen atoms, alkyl groups having 1 to 5 carbon atoms, alkoxy groups having 1 to 5 carbon atoms, and substituted amino groups each substituted with an alkyl group having 1 to 3 carbon atoms.

(a-2)

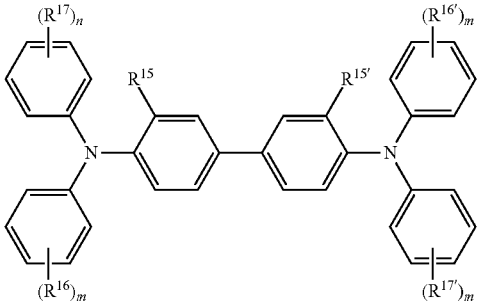

In the structural silicon (a-2), $R^{15}$ and $R^{15'}$ each independently represent a hydrogen atom, a halogen atom, an alkyl group having 1 to 5 carbon atoms, or an alkoxy group having 1 to 5 carbon atoms; $R^{16}$(s), $R^{16'}$(s), $R^{17}$(s) and $R^{17'}$(s) each independently represent a hydrogen atom, a halogen atom, an alkyl group having 1 to 5 carbon atoms, an alkoxy group having 1 to 5 carbon atoms, an amino group substituted with an alkyl group having one or two carbon atoms, a substituted or unsubstituted aryl group, $—C(R^{18})=C(R)^{19})(R^{20}$, or $—CH=CH—CH=C(R^{21})(R^{22})$ wherein $R^{18}$, $R^{19}$, $R^{20}$, $R^{21}$ and $R^{22}$ each independently represent a hydrogen atom, a substituted or unsubstituted alkyl group, or a substituted or unsubstituted aryl group; and m and n each independently represent an integer of 0 to 2.

Among triarylamine derivatives each represented by the structural formula (a-1) and benzidine derivatives each represented by the structural formula (a-2), triarylamine derivatives each having "$—C_6H_4—CH=CH—CH=C(R^{13})(R^{14})$" and benzidine derivatives each having $—CH=CH—CH=C(R^{21})(R^{22})$ are particularly preferred from the viewpoints that they are excellent in charge mobility, adhesive property to the protective layer, resistance to the residual image that occurs owing to the remaining hysteresis of a previous images (hereinafter also referred to as a ghost), and others.

Examples of the binder resin used in the charge transporting layer 3 include polycarbonate resin, polyester resin, polyarylate resin, methacrylic resin, acrylic resin, polyvinyl chloride resin, polyvinylidene chloride, polystyrene resin, polyvinyl acetate resin, styrene/butadiene copolymer, vinylidene chloride/acrylonitrile copolymer, vinyl chloride/vinyl acetate copolymer, vinyl chloride/vinyl acetate/maleic anhydride copolymer, silicone resin, silicone alkyd resin, phenol-formaldehyde resin, styrene-alkyd resin, poly-N-vinylcarbazole, and polysilane. A charge transporting material according to a polyester-based polymer described in Japanese Patent Application Laid-Open (JP-A) No. 8-176293, or JP-A No. 8-208820, may be also used. Among these resins, polycarbonate resin or polyarylate resin is preferable since the resins are excellent in compatibility with the charge transportable materials or the charge transporting material.

These binder resins may be used alone or in a combination of two or more thereof. The blend ratio by weight of the charge transporting material to the binder resin may be from 10/1 to 1/5.

The viscosity-average molecular weight of the binder resin used in the charge transporting layer 3 is preferably 50000 or more, and more preferably 55000 or more when the photoreceptor has, on the charge transporting layer 3, the protective layer (outermost layer), which is a cured film made of a composition containing a reactive charge transporting material (a) and a polycarbonate resin. When the binder resin having such a molecular weight is used the binder resin gives the layer 3 excellent adhesive property and crack resistance when the protective layer (outermost layer) is formed thereon, and others.

The upper limit of the viscosity-average molecular weight of the binder resin used in the charge transporting layer 3 may be 100000 or less from the viewpoint of the evenness of the coat (the dripping property of the coating solution).

The viscosity-average molecular weight of the binder resins in this exemplary embodiment is a value obtained by measurement using a capillary viscometer.

When the outermost layer is a charge transporting layer, the viscosity-average molecular weight of a binder resin contained in the layer disposed under the layer 3 is desirably in the same range as the range described above for the same reason.

As the charge transporting material, a polymeric charge transporting material may be used. The polymeric charge transporting material may be a known polymeric material which has charge transporting property, such as poly-N-vinylcarbazole or polysilane. Among these materials, polyester polymeric charge transporting materials disclosed in JP-A Nos. 8-176293 and 8-208820, and others are particularly desired since the material has a higher charge transporting property than others. The polymeric charge transporting material may be formed into a film by itself, or may be mixed with the binder resin to form a film.

The charge transporting layer 3 is formed using a charge transporting layer-forming coating solution containing the above-mentioned constituting materials.

As the solvent used for the charge transporting layer-forming coating solution, ordinary organic solvents may be used alone or in the form of mixture of two or more thereof, examples of the solvents including aromatic hydrocarbons such as benzene, toluene, xylene and chlorobenzene, ketones such as acetone and 2-butanone, halogenated aliphatic hydrocarbons such as methylene chloride, chloroform, and ethylene chloride, and cyclic or linear ethers such as tetrahydrofuran and ethyl ether. As the method for dispersing the constituting materials, a known method may be used.

As the method for applying the charge transporting layer-forming coating solution onto the charge generating layer 2, it is possible to use an ordinary coating method such as blade coating, Meyer bar coating, spray coating, dip coating, bead coating, air knife coating, or curtain coating.

The film thickness of the charge transporting layer 3 is preferably from 5 μm to 50 μm, and more preferably from 10 μm to 30 μm. As the charge transporting layer, materials for the surface layer of the exemplary embodiment of the invention, may be used.

[Image Forming Apparatus/Process Cartridge]

Figure 4:
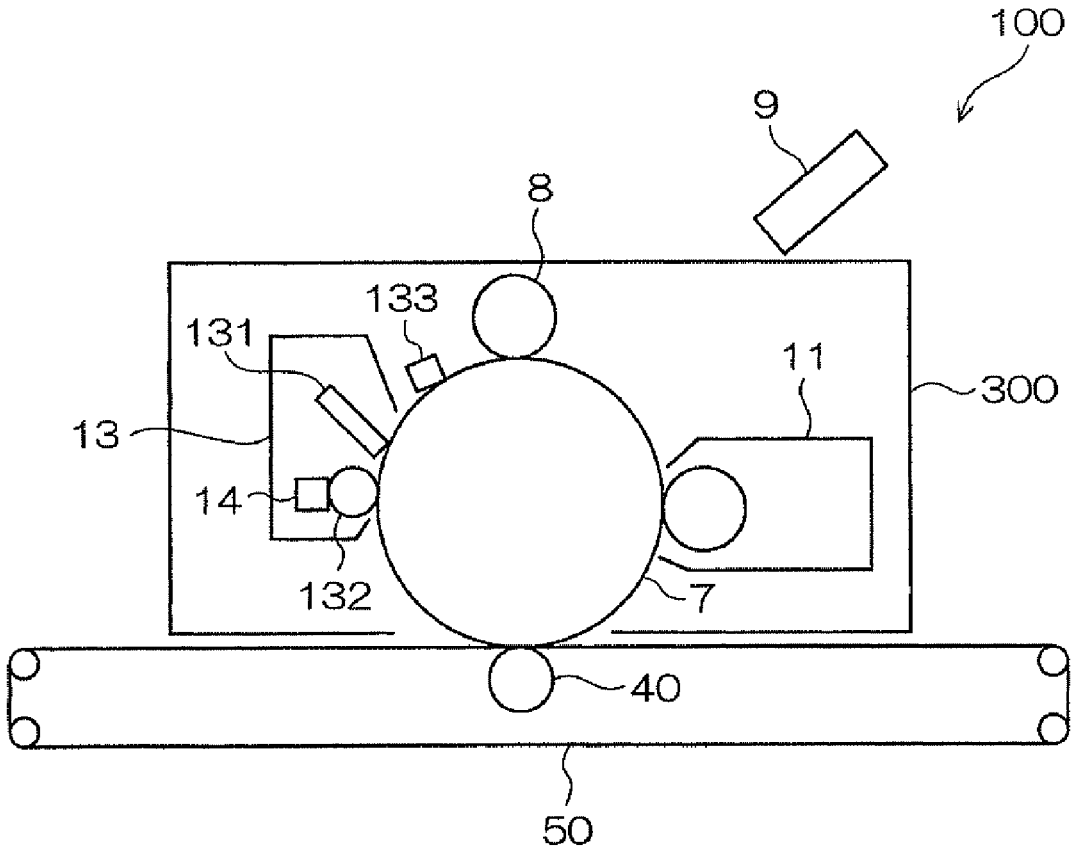
FIG. 4 is a cross-sectional view illustrating a process cartridge of the invention.

FIG. 4 is a schematic structural view illustrating an image forming apparatus 100 according to an exemplary embodiment of the invention.

The image forming apparatus 100 is provided with a process cartridge 300 having an electrophotographic photoreceptor 7, an exposure device (electrostatic latent image forming unit) 9, a transfer device (transferring unit) 40, and an intermediate transferring medium 50. In the image forming apparatus 100, the unit 9 is arranged at a position where the unit 9 may radiate light onto the electrophotographic photoreceptor 7 through an opening in the process cartridge 300, and the transferring unit 40 is arranged at a position opposite to the photoreceptor 7 by the intermediary of the intermediate transferring medium 50 between the transferring unit 40 and the photoreceptor 7. The intermediate transferring medium 50 is arranged to contact partially the photoreceptor 7.

The process cartridge 300 in FIG. 4 installs, in house, the electrophotographic photoreceptor 7, an electrifier (electrifying unit) 8, a developing device (developing unit) 11, and a cleaner 13 as a unit. The cleaner 13 has a cleaning blade (cleaning member) 131, and the cleaning blade 131 is arranged so as to contact the surface of the photoreceptor 7. The cleaning member may not be the cleaning blade 131, and may be an electroconductive or insulating fibrous member. This may be used alone, or may be used together with a blade.

In FIG. 4, the cleaner 13 has a fibrous member 132 (in a roll form) for supplying a lubricant material 14 onto the surface of the photoreceptor 7, and a fibrous member 133 (in a flat brush form) for assisting cleaning is used; however these members are used as the need arises.

The electrifier 8 is, for example, a contact type electrifier using a conductive or semiconductive electrifying roll, electrifying brush, electrifying film, electrifying rubber blade or electrifying tube, or the like. The electrifier 8 may be a non-contact type roller electrifier, in which the electrifying roll is used in neighborhood to the photoreceptor 7, a scorotron or corotron electrifier using corona discharge, or any other known electrifier.

Furthermore, when a scorotron charger is used, an apparatus which forms a blocking structure against the electrophotographic photoreceptor may be provided in order to prevent discharge products which have been adsorbed onto the charger from being emitted to the electrophotographic photoreceptor while the charger is not in use.

In order to improve the stability of images, a photoreceptor-heating member, which is not illustrated, may be arranged around the electrophotographic photoreceptor 7 to raise the temperature of the photoreceptor 7 to decrease the relative temperature difference.

The exposure device 9 may be an optical instrument for radiating a light ray into a desired image form onto the surface of the photoreceptor 7. The light ray may be a semiconductor laser ray, an LED ray, a liquid crystal shutter ray, or the like. The wavelength(s) of the light source may be a wavelength or wavelengths in the range of the spectral sensitivity wavelengths of the photoreceptor 7. As the wavelengths of semiconductor lasers, near infrared wavelengths that are laser-emission wavelengths near 780 nm are predominant. However, the wavelength of the laser ray to be used is not limited to such a wavelength, and a laser having an emission wavelength near 600 nm, or a blue laser having any emission wavelength in the range of 400 nm to 450 nm may be used. In order to form a color image, it is effective to use a plane-emissive type laser light source capable of attaining a multi-beam output.

The developing device 11 may be an ordinary developing device, which has a function of developing a latent image with a one-component developing agent or two-component developing agent by bringing the developing agent in contact or non-contact with the image. The developing device is not particularly limited as far as the developing device has the function, and is appropriately selected from various developing devices in accordance with the intended use of the developing device. As the developing device, it is possible to use, for example, a known developing device having a function of making one-component developing unit or two-component developing agent adhere onto the photoreceptor 7 using a brush, a roll or the like.

A toner used in the developing device 11 will be described hereinafter.

About the toner, the average shape coefficient ($=ML^2/A\times(\pi/4)\times100$ wherein ML represents the largest length of the toner particles and A represents the projected area of the toner particles) is preferably from 100 to 150, more preferably from 105 to 145, even more preferably from 110 to 140. Furthermore, the volume-average particle diameter of the toner is preferably from 3 μm to 12 μm, more preferably from 3.3 μm to 10 μm, and even more preferably from 3.5 μm to 9 μm. According to the use of the toner satisfying the average shape coefficient and volume-average particle diameter requirements, a higher developing property, a higher transferring property and a higher-quality image are obtained than the use of other toners.

The toner may be a toner produced by any method as far as the toner satisfies the average shape coefficient and volume-average particle diameter requirements. The toner may be, for example, a toner produced by the following method: a kneading pulverizing method of kneading a binder resin, a colorant, a releasing agent, and optional components such as a charge control agent, and pulverizing these components, and classifying the resultant particles; a method of changing the shape of the particles obtained by the kneading pulverizing method by mechanical impact force or thermal energy; an emulsion polymerization aggregation method of emulsion-polymerizing a polymerizable monomer for obtaining a binder resin, mixing the produced liquid dispersion and a liquid dispersion containing a colorant, a releasing agent, and optionally a charge control agent and others with each other, aggregating the mixture, and heating/melt-bonding the aggregated particles to obtain toner particles; a suspension polymerization method of suspending a polymerizable monomer for obtaining a binder resin, a colorant, a releasing agent, and optionally a solution of a charge control agent and others into an aqueous solvent and polymerizing the monomer; or a dissolution suspension method of suspending a solution of a binder resin, a colorant, a releasing agent, and an optionally a charge control agent and others into an aqueous solution to produce particles.

It is allowable to use some other known method, such as a production method of using the toner obtained by a method as described above as a core, causing aggregated particles to adhere onto (the particles of) the core, and then heating/melt-bonding the core particles and the shell particles whereby a core-shell structure is formed. Among these methods for producing the toner the suspension polymerization method, or the emulsion polymerization aggregation method or the dissolution suspension method, wherein the toner is produced in an aqueous solvent is particularly preferable from the viewpoints of controlling a shape or a particle diameter distribution.

Mother particles of the toner are composed of a binder resin, a colorant, a releasing agent, and optional components such as silica, a charge control agent.

The binder resin used in the mother particles of the toner may be a homopolymer or a copolymer made from a styrene compound such as styrene or chlorostyrene; a monoolefin such as ethylene, propylene, butylene or isoprene; a vinyl ester such as vinyl acetate, vinyl propionate, vinyl benzoate or vinyl butyrate; an α-methylene aliphatic monocarboxylic acid ester such as methyl acrylate, ethyl acrylate, butyl acrylate, dodecyl acrylate, octyl acrylate, phenyl acrylate, methyl methacrylate, ethyl methacrylate, butyl methacrylate or dodecyl methacrylate; a vinyl ether such as vinyl methyl ether, vinyl ethyl ether or vinyl butyl ether; a vinyl ketone such as vinyl methyl ketone, vinyl hexyl ketone, vinyl isopropenyl ketone; and/or the like. The binder resin may be a polyester resin obtained by copolymerizing a dicarboxylic acid and a dial.

Particularly typical examples of the binder resin include polystyrene, styrene/alkyl acrylate copolymer, styrene/alkyl methacrylate copolymer, styrene/acrylonitrile copolymer, styrene/butadiene copolymer, styrene/maleic anhydride copolymer, polyethylene, polypropylene, polyester, polyurethane, epoxy resin, silicone resin, polyamide, modified rosin, and paraffin wax.

Typical examples of the colorant include magnetic powder of magnetite or ferrite, carbon black, aniline blue, chalcoil blue, chromium yellow, ultramarine blue, Du Pont oil red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, and C.I. Pigment Blue 15:3.

Typical examples of the releasing agent include low molecular weight polyethylene, low molecular weight polypropylene, Fischer Tropsch wax, montanoic wax, carnauba wax, rice wax, and candelilla wax.

The charge control agent includes a known charge control agent, such as an azo metal complex compound, a metal complex compound of salicylic acid, or a resin type charge control agent having a polar group. When the toner is produced by a wet process, materials slightly soluble in water may be used in order to control the ion strength and decrease contaminations in waste water. The toner may be a magnetic toner in which a magnetic material is contained, or a nonmagnetic toner in which no magnetic material is contained.

The toner used in the developing device 11 is produced by mixing mother particles of the toner and the external additives with a Henschel mixer, a V blender or the like. When the mother particles of the toner are produced by a wet process, the external additives may be externally added in a wet manner.

The toner used in the developing device 11 may include particles including a fluorine atom.

Examples of the material of the particles including a fluorine atom include a fluoride carbon wherein fluorine is bonded to black lead or graphite, polytetrafluoroethylene resin (PTFE), perfluoroalkoxy/fluorine resin (PFA), tetrafluoroethylene/hexafluoropropylene copolymer (FEP), ethylene/tetrafluoroethylene copolymer (ETFE), polychlorotrifluoroethylene (PCTFE), polyvinylidene fluoride (PVDF), and polyvinyl fluoride (PVF).

A volume-average particle diameter of the particles including a fluorine atom is preferably in a range of from 0.1 μm to 10 μm. The particles having any one of the above-mentioned chemical structures may be pulverized into uniform particle diameters. An addition amount thereof to the toner is preferably from 0.05% by weight to 2.0% by weight, and more preferably from 0.05% by weight to 1.5% by weight. When the volume-average particle diameter of the particles and the addition amount thereof are in the range above respectively, a friction coefficient of the toner is in a preferable range, and an occurrence of the ghost may be suppressed. Further, a generation of a toner having reverse polarity may be suppressed according to adequate charging characteristics of the toner.

Slipping particles may be added to the toner used in the developing device 11. Examples of the material of the slipping particles include solid lubricants such as graphite, molybdenum disulfide, talc, aliphatic acids, and aliphatic acid metal salts; low molecular weight polyolefins such as polypropylene, polyethylene, and polybutene; silicones having a softening point when heated; aliphatic amides such as oleic amide, erucic amide, ricinoleic amide, and stearic amide; plant waxes such as carnauba wax, rice wax, candelilla wax, Japan wax (Japan tallow), and jojoba oil; animal waxes such as beeswax; mineral or petroleum waxes such as montanoic wax, ozocerite, cerasin, paraffin wax, microcrystalline wax, and Fischer-Tropsch wax; and modified products of these materials. These may be used alone or in combination of two or more thereof.

A volume-average particle diameter of the slipping particles is preferably from 0.1 μm to 10 μm. The particles having any one of the above-mentioned chemical structures may be pulverized into uniform particle diameters. The addition amount of the slipping particles to the toner is preferably from 0.05% by weight to 2.0% by weight, and more preferably from 0.1% by weight to 1.5% by weight.

Inorganic particles, organic particles or hybrid particles composed of inorganic particles adhered onto organic particles may be added to the toner used in the developing device 11 in order to remove adhering substances or deteriorated substances on the surface of the electrophotographic photoreceptor, or to attain some other purpose.

Proper examples of the material of the inorganic fine particles include various inorganic oxides, nitrides and carbides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride and boron nitride.

The inorganic particles may be treated with a titanium coupling agent such as tetrabutyl titanate, tetraoctyl titanate, isopropyltriisostearoyl titanate, isopropyltridecylbenzenesulfonyl titanate, or bis(dioctylpyrophosphate)oxyacetate titanate; or a silane coupling agent such as γ-(2-aminoethyl) aminopropyltrimethoxysilane, γ-(2-aminoethyl)aminopropylmethyldimethoxysilane, γ-methacryloxypropyltrimethoxysilane, a hydrochloride of N-β-(N-vinylbenzylaminoethyl)-γ-aminopropyltrimethoxysilane, hexamethyldisilazane, methyltrimethoxysilane, butyltrimethoxysilane, isobuytltrimethoxysilane, hexyltrimethoxysilane, octyltrimethoxysialne, decyltrimethoxysilane, dodecyltrimethoxysilane, phenyltrimethoxysilane, o-methylphenyltrimethoxysilane, or p-methylphenyltrimethoxysilane. The inorganic particles may be subjected to hydrophobicity-imparting treatment with silicone oil, or a higher aliphatic acid metal salt such as aluminum stearate, zinc stearate or calcium stearate.

Examples of the material of the organic fine particles include styrene resin, styrene-acryl resin, polyester resin, polyurethane resin, polytetrafluoroethylene resin (PIPE), perfluoroalkoxy/fluorine resin (PFA), tetrafluoroethylene/hexafluoropropylene copolymer (FEP), ethylene/tetrafluoroethylene copolymer (FIFE), polychlorotrifluoroethylene (PCTFE), polyvinylidene fluoride (PVDF), and polyvinyl fluoride (PVF).

The number-average particle diameter of the particles is preferably from 5 nm to 1000 nm, more preferably from 5 nm to 800 nm, and even more preferably from 5 nm to 700 nm. When the number-average particle diameter is in the range above, the particles tend to have an excellent polishing capability, and tend to suppress effectively occurrence of scratch at the electrophotographic photoreceptor surface. The total addition amount of the organic or inorganic particles and the slipping particles may be 0.6% or more by weight.

It is possible to use, as other inorganic oxides added to the toner, a small-size inorganic oxide having a particle diameter of 40 nm or less for controlling the powder fluidity, the charging characteristic, and the like, and further a larger-size inorganic oxide for decreasing the adhesive force and controlling the charging characteristic. Particles of these inorganic oxides may be known particles. In order to control the charging characteristic precisely, silica and titanium oxide may be used together.

When the small-size inorganic particles are surface-treated, the dispersibility is enhanced so that an effect of raising the powder fluidity is improved. In order to remove electric discharge products, a carbonate such as calcium carbonate or magnesium carbonate, or an inorganic mineral such as hydrotalcite may be added.

When the toner is a color toner for electrophotography, the toner is used in the form of a mixture with a carrier. Examples of the carrier include iron powder, glass beads, ferrite powder, nickel powder, and a product wherein the surface of such a carrier is coated with a resin. The blend ratio of the toner to the carrier may be set appropriately.

The transfer unit 40 may be a known transferring electrifier, for example, a contact type transferring electrifier using a belt, a roll, a film, a rubber blade or the like, or a scorotron transferring electrifier or corotron transferring electrifier using corona discharge.

The intermediate transferring medium 50 may be a belt (intermediate transferring belt) made of polyimide, polyamideimide, polycarbonate, polyarylate, polyester or a rubber, to each of which semi-conductivity is given. The form of the intermediate transferring medium 50 may be a drum form as well as the belt form.

The image forming apparatus 100 may have, for example, an optical charge eraser for optically erasing a charge on the photoreceptor 7 besides the above-mentioned individual units.

Figure 5:
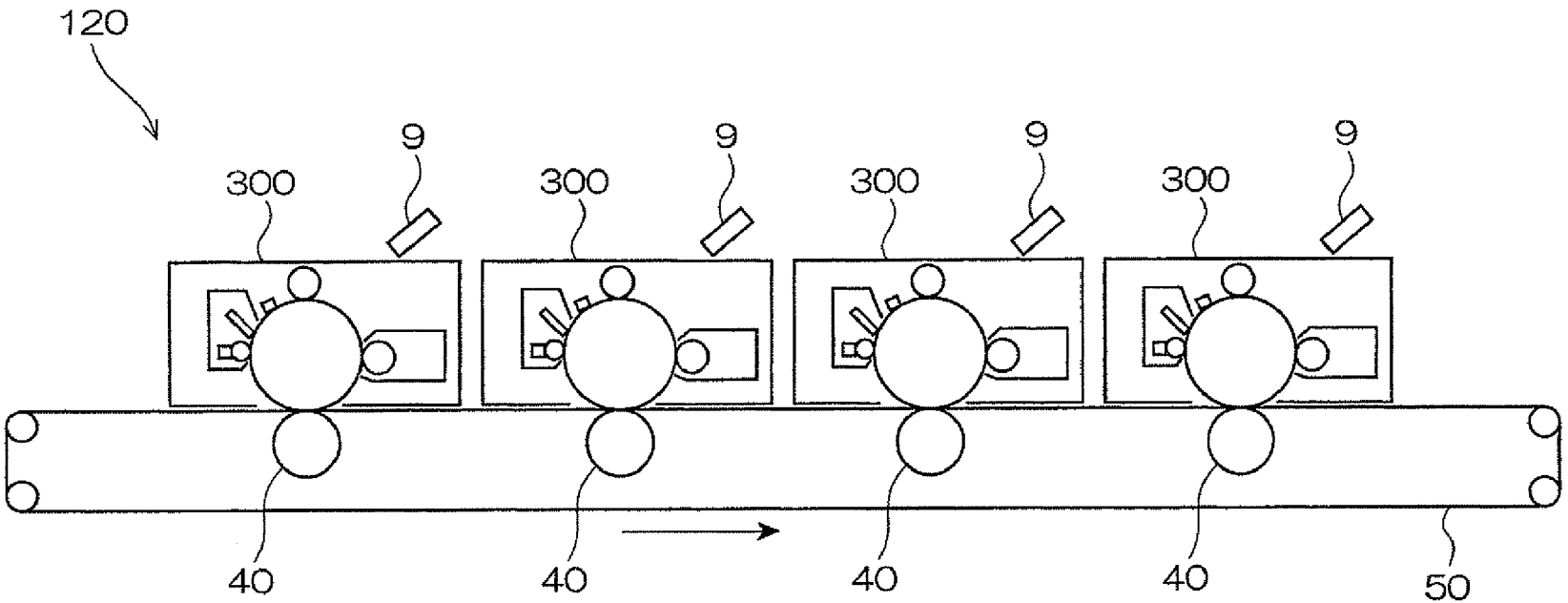
FIG. 5 is a cross-sectional view illustrating a tandem-type image forming apparatus of the invention.

FIG. 5 is a schematic sectional view illustrating an image forming apparatus 120 according to another exemplary embodiment of the invention.

The image forming apparatus 120 is a full color image forming apparatus, in a tandem manner, on which four process cartridges are mounted.

In the image forming apparatus 120, the four process cartridges 300 are arranged in parallel with each other on an intermediate transferring medium 50, and one electrophotographic photoreceptor is used per color. The image forming apparatus 120 has the same structure as the image forming apparatus 100 except that the apparatus 120 is in a tandem manner.

When the electrophotographic photoreceptor is applied to a tandem type image forming apparatus, since electrical characteristics of four photoreceptors are stabilized, an image having excellent color balance over a long period of time can be obtained.

EXAMPLES

Herein below, the invention will be explained in further detail in view of Examples. However, it is evident that the invention is not limited thereto.

Synthesis Example 1

Synthesis of Compound A-4

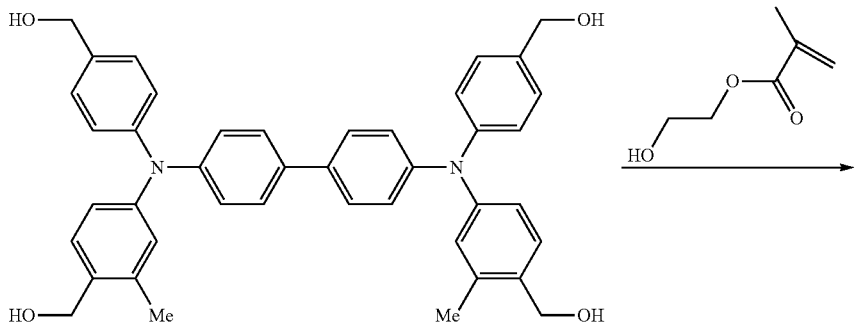

(1)

-continued

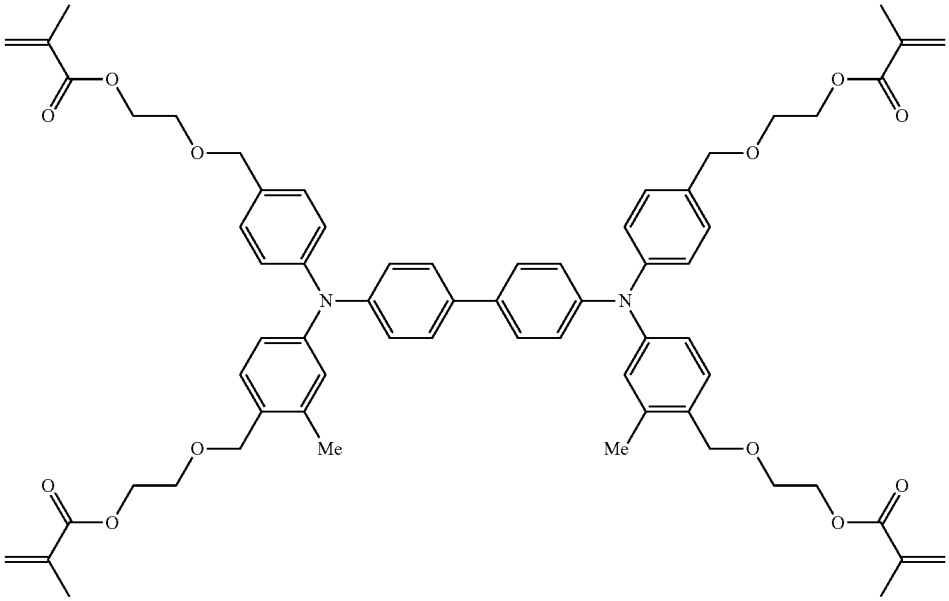

(A-4)

10 g of Compound (1), 50 g of hydroxyethylmethacrylate, 20 mL of tetrahydrofuran and 0.5 g of Amberlyst 15E (trade name, manufactured by Japan Organo, Ltd.) are put into a 200 mL flask and are mixed at the room temperature for 24 hrs. Upon the completion of the reaction, 100 mL of methanol is added and the resulting oily matter is collected by decanting. The oily matter is purified by silica gel column chromatography to obtain 12 g of Compound (A-4) as an oily matter.

Synthesis Example 2

Synthesis of Compound A-17

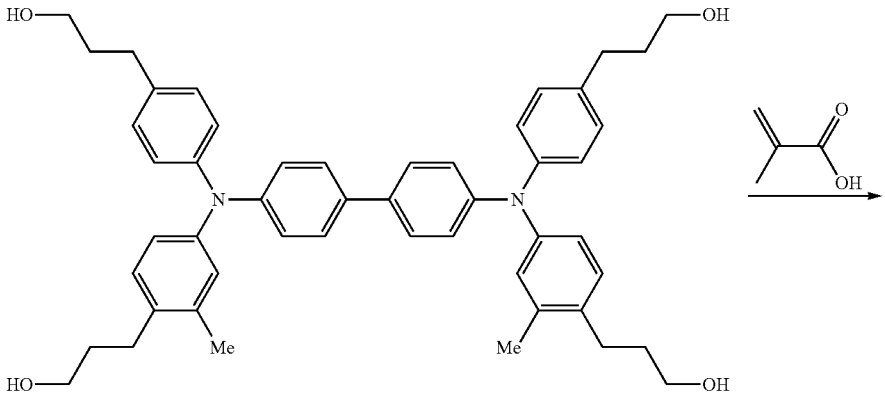

(2)

-continued

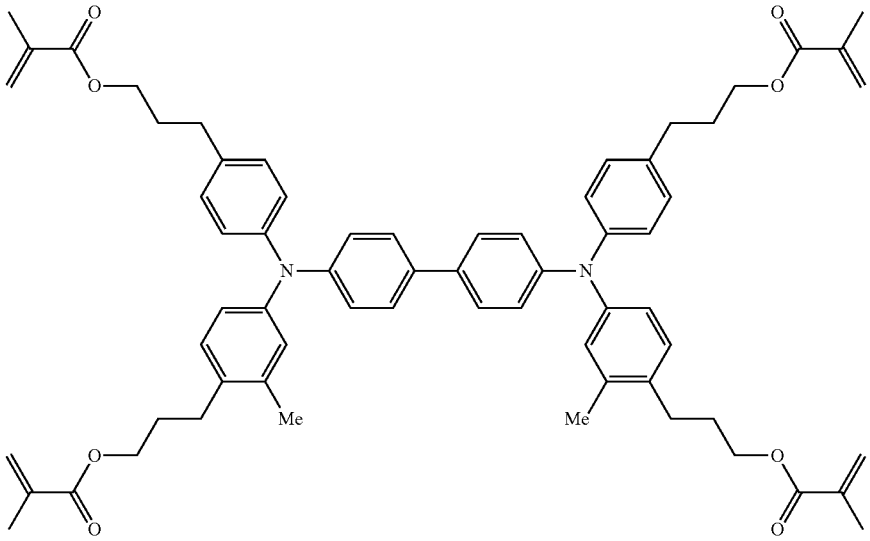

(A-17)

36 g of Compound (2), 75 g of methacrylic acid, 300 mL of toluene and 2 g of p-toluene sulfonic acid are put into a 200 mL flask and are refluxed under heating for 10 hrs. After the reaction, the mixture is cooled. By adding 2000 mL of water, washing is carried out, followed by further washing with water. A toluene layer is dried over anhydrous sodium sulfate and purified by silica gel column chromatography to obtain 30 g of Compound (A-17).

Synthesis Example 3

Synthesis of Compound A-18)

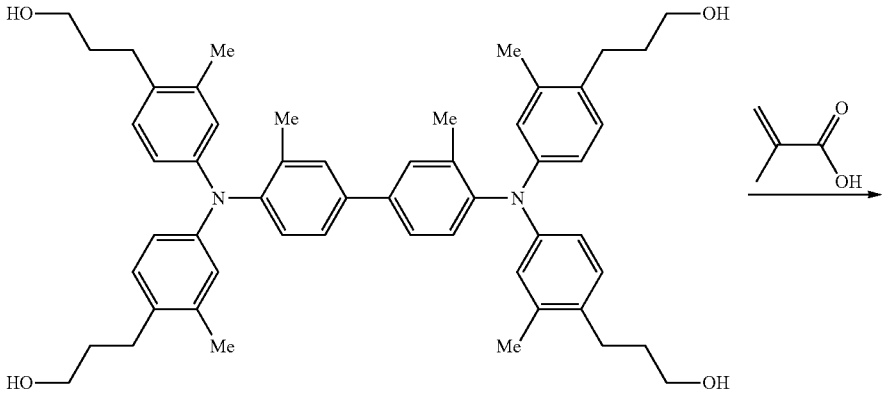

(3)

-continued

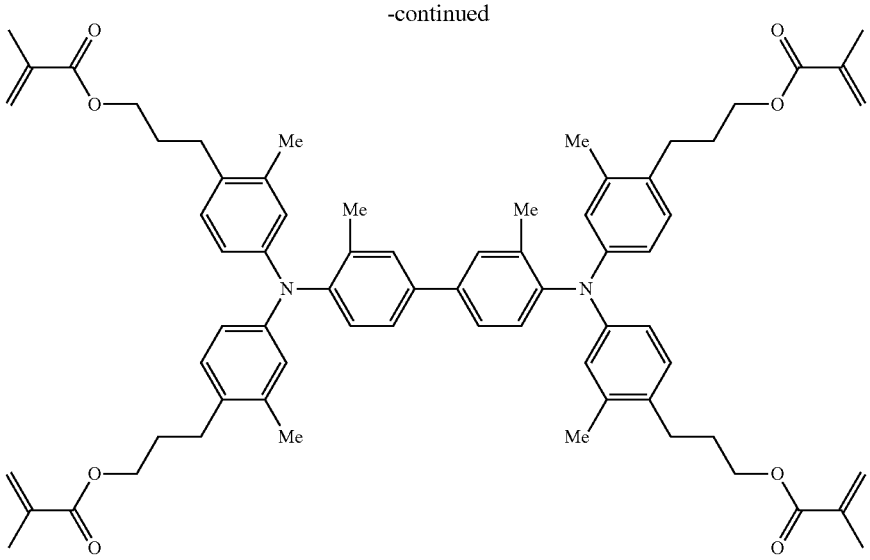

(A-18)

50 g of Compound (3), 107 g of methacrylic acid, 300 mL of toluene and 2 g of p-toluene sulfonic acid are put into a 500 mL flask and are refluxed under heating for 10 hrs. After the reaction, the mixture is cooled. By adding 2000 mL of water, washing is carried out, followed by further washing with water. A toluene layer is dried over anhydrous sodium sulfate and purified by silica gel column chromatography to obtain 38 g of Compound (A-18).

Example 1

Formation of Photoreceptor (Formation of Undercoating Layer)

100 parts by weight of zinc oxide (volume average particle diameter: 70 nm, manufactured by Tayca Corporation, specific surface area: 15 $m^2/g$) is stirred and mixed with 500 parts by weight of tetrahydrofuran, into which 1.3 parts by weight of a silane coupling agent (trade name: KBM503, manufactured by Shin-Etsu Chemical Co., Ltd.) is added and stirred for 2 hours. Subsequently, the solvent is removed by distillation under reduced pressure, and baking is carried out at a temperature of 120° C. for 3 hours to obtain the zinc oxide having the surface treated with the silane coupling agent.

110 parts by weight of the surface-treated zinc oxide is stirred and mixed with 500 parts by weight of tetrahydrofuran, into which a solution in which 1.0 part by weight of alizarin is dissolved in 50 parts by weight of tetrahydrofuran is added, then stirred at a temperature of 50° C. for 5 hours. Subsequently, the zinc oxide to which the alizarin is added is collected by filtration under a reduced pressure, and dried under reduced pressure at a temperature of 60° C. to obtain alizarin-added zinc oxide.

38 parts by weight of a solution, in which 60 parts by weight of an alizarin-added zinc oxide, 13.5 parts by weight of a curing agent (blocked isocyanate, trade name: SUMIDUR 3175, manufactured by Sumitomo Bayer Urethane Co., Ltd) and 15 parts by weight of a butyral resin (trade name: S-LEC BM-1, manufactured by Sekisui Chemical Co., Ltd.) are dissolved in 85 parts by weight of methylethyl ketone, is admixed with 25 parts by weight of methylethyl ketone, followed by dispersion for 2 hrs using a sand mill using glass beads having a diameter of 1 mm to obtain a dispersion liquid.

To the dispersion liquid obtained, 0.005 parts by weight of dioctyl tin dilaurate and 45 parts by weight of silicone resin particles (trade name: TOSPEARL 145, manufactured by GE Toshiba Silicone Co., Ltd.) are added to obtain a liquid for coating an underlying layer. The coating liquid is applied on an aluminum substrate (30 mm in diameter, 340 mm in length, and 1 mm in thickness) by immersion coating method. After dry curing at 170° C. for 40 min, the underlying layer having a thickness of 18 μm is obtained.

(Formation of Charge Generating Layer)

A mixture including 15 parts by weight of hydroxy gallium phthalocyanine having the diffraction peaks at least at 7.3°, 16.0°, 24.9° and 28.0° of Bragg angles)(2θ±0.2° in an X-ray diffraction spectrum of Cuka X ray as a charge generating substance, 10 parts by weight of vinyl chloride-vinyl acetate copolymer resin (trade name: VMCH, manufactured by Nippon Unicar Co., Ltd.) as a binding resin, and 200 parts by weight of n-butyl acetate is dispersed using a sand mill with the glass beads of 1 mm diameter for 4 hours. 175 parts by weight of n-butyl acetate and 180 parts by weight of methyl ethyl ketone are added to the obtained dispersion, then are stirred to obtain a coating solution for a charge generating layer. The coating solution for charge generating layer is applied to the undercoating layer by dip coating, and is dried at an ordinary temperature (25° C.) to form a charge generating layer having a film thickness of 0.2 μm.

(Formation of Charge Transporting Layer) 45 parts by weight of N,N'-diphenyl-N,N-bis(3-methylphenyl)-[1,1']biphenyl-4,4'-diamine (TPD) and 55 parts by weight of bisphenol Z polycarbonate resin (PC(Z): viscosity average molecular weight: 60,000) are dissolved in 800 parts by weight of chlorobenzene to obtain a coating solution for a charge transporting layer. The coating solution is applied onto the charge generating layer, then is dried at a temperature of 130° C. for 45 minutes to form a charge transporting layer having a film thickness of 15 μm as a charge transporting layer of the electrophotographic photoreceptor 1.

(Preparation of Surface Layer)

20 parts by weight of N,N-diphenyl-N,N-bis(3-methylphenyl)-[1,1']-biphenyl 4,4'-diamine (TPD), 20 parts by weight of a bisphenol Z polycarbonate resin (viscosity average molecular weight: 30,000), 60 parts by weight of the compound A-17, 2 parts by weight of OTAZO-15 (trade name, manufactured by Otsuka Chemical Co., Ltd., molecular weight 354.4) are dissolved in 500 parts by weight of monochlorobenzene, and are coated on a charge transporting layer by spray-coating. After drying with air at room temperature for 30 minutes, the mixture is subjected to a heat treatment at 150° C. for one hour after the temperature is raised from the room temperature to 150° C. at a rate of 10° C. per minute under nitrogen at an oxygen concentration of 200 ppm and cured, to form a protective layer having a film thickness of 15 μm, thereby preparing a photoreceptor for Example 1.

By using the Nicolet 6700 Fourier-transformed IR spectrophotometer (trade name; manufactured by Thermo Fisher Scientific inc.), IR absorption spectrum of the surface layer based on micro-ATR (Attenuated Total Reflection) method in which ATR prism and Ge are used is measured. The obtained IR absorption spectrum is corrected by advanced ATR and the noise originating from water vapor is removed. As a result, $I_A/I_C$−1.35 and the full width at half maximum of the absorption peak resulting from stretching vibration is 25 $cm^{-1}$.

Figure 7:
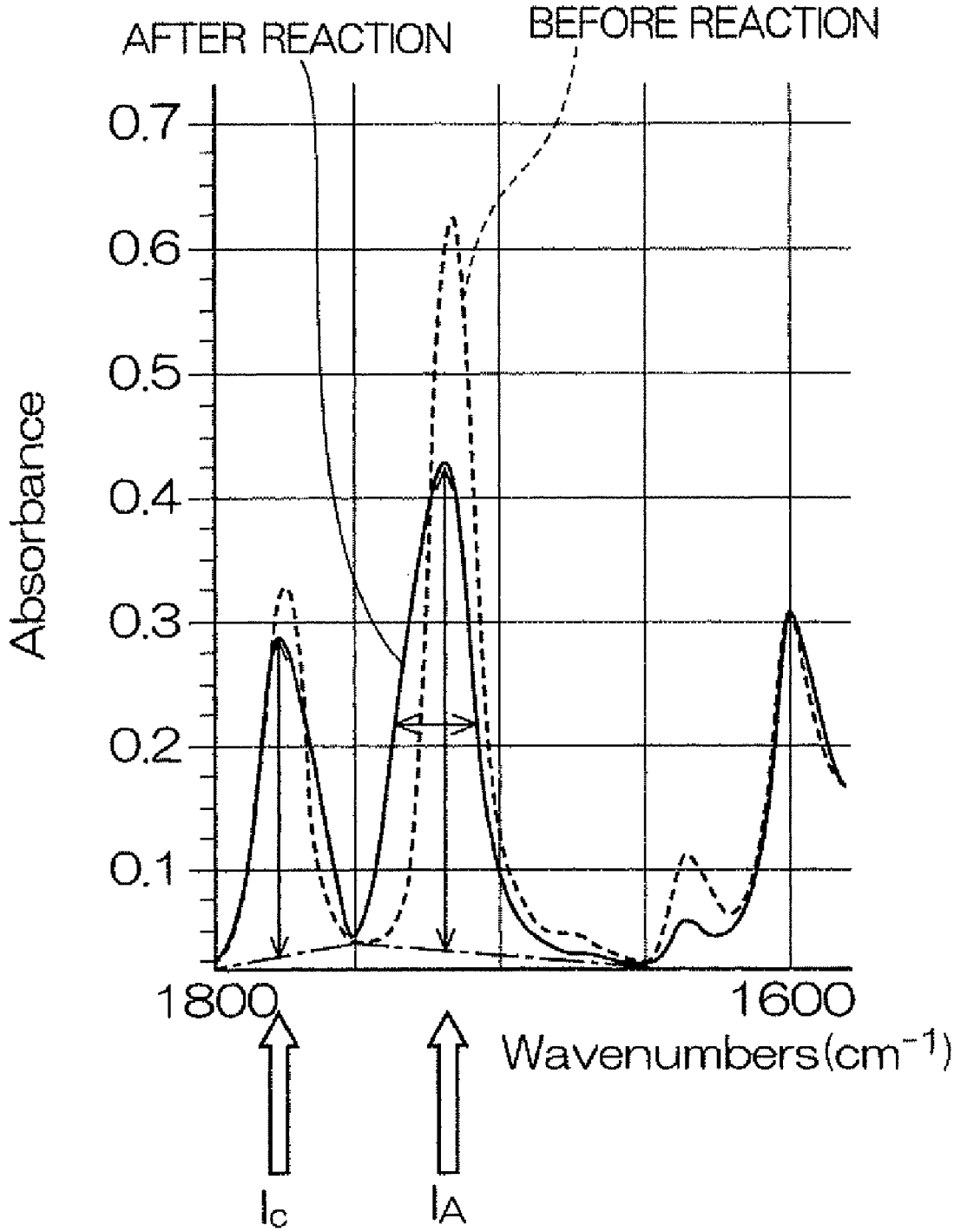
FIG. 7 is a diagram illustrating an infrared absorption spectrum of a surface layer of Example 1.

FIG. 7 illustrates IR spectra before and after the curing of the surface layer. From the absorption intensity and the full width at half maximum of the absorption peak compared with the baseline defined above, $I_A$ and $I_C$ are obtained.

<Evaluation of Images>

The electrophotographic photoreceptor, which has been produced according to the description above, is mounted on ApeosPort-III C4400 (trade name, manufactured by Fuji Xerox Co.; image forming apparatus), and the following evaluation is continuously carried out under the condition of low temperature and low humidity (8° C., 20% RH) and under the condition of high temperature and high humidity condition (28° C., 85% RH).

Under the environment of low temperature and low humidity (8° C., 20% RH), a test for forming 10,000 images is carried out. The $10,000^{th}$ image is then subjected to the image quality evaluation (ghost, fogs, streaks and image degradation). After that, the image forming apparatus mounted with the electrophotographic photoreceptor is kept under the low temperature and low humidity environment (8° C., 20% RH) for 24 hrs. Subsequently, a test for forming images is carried out and the first image is subjected to the image quality evaluation.

The results are described in Table 4.

Following the image quality evaluation under the low temperature and low humidity environment, a test for forming 10,000 images is carried out under the environment of high temperature and high humidity (28° C., 85% RH). The $10,000^{th}$ image is then subjected to the image quality evaluation. After that, the image forming apparatus mounted with the electrophotographic photoreceptor is kept under the high temperature and high humidity environment (28° C., 85% RH) for 24 hrs. Then, a test for forming images is carried out and the first image is subjected to the image quality evaluation.

The results are described in Table 5.

(Evaluation of Ghosts)

Figure 6A:
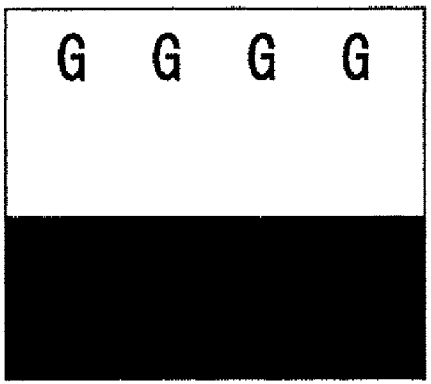
FIGS. 6A, 6B and 6C are explanatory views for explaining the criteria for evaluating ghost.

A pattern chart, in which G as shown in FIG. 6A and a gray area having an image density of 50% are provided, is printed, and the state of letter G appearing in the 50% gray area is visually evaluated.

A: Image is good or ghosts are minor like FIG. 6A.

Figure 6B:
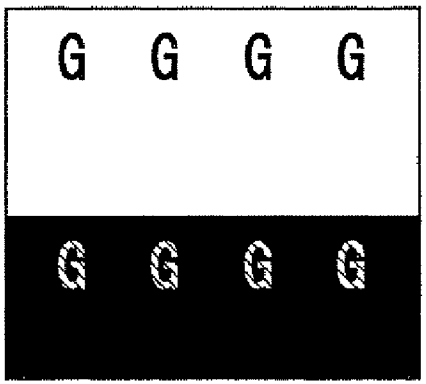

B: Ghosts are slightly visible like FIG. 6B.

Figure 6C:
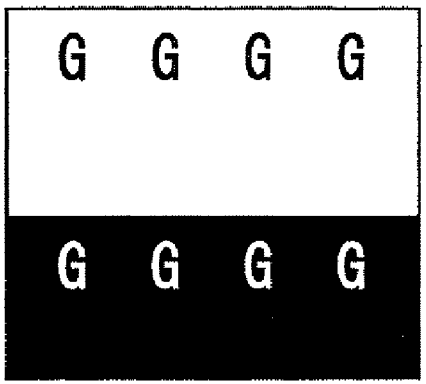

C: Ghosts are clearly visible like FIG. 6C.

<Evaluation of Fogs>

The degree of toner adhesiveness to the white area is evaluated by visual observation using the same sample with the evaluation of ghost of image quality.

A: Good.

B: Light fog is developed.

C: Fog having a damaging effect of image quality is developed.

<Evaluation of Streaks>

Development of streaks is evaluated by visual observation using the same sample with the evaluation of ghost of image quality.

A: Good.

B: Streaks are partially developed.

C: Streaks having a damaging effect on image quality are developed.

<Evaluation of Image Degradation>

The image degradation is visually evaluated using the same samples as those of the above-described ghost evaluation.

A: Good.

B: While the printing tests are continuously carried out, there is no problem, but after leaving for one day (24 hours), a problem occurs.

C: Even while the printing tests are continuously carried out, a problem occurs.

<Evaluation of Adhesiveness of the Surface Layer>

For the evaluation of adhesiveness of the surface layer, 5×5 specimens with 2 mm squares are formed by forming cutting lines on the photoreceptor obtained after the image forming test by using a cutter knife, and a mending tape (manufactured by 3M) is applied thereto and then is peeled off. The evaluation is made by counting the remaining number of the lines.

Results are described in Table 4 and 5.

A: 21 specimens or more remain.

B: from 11 to 20 specimens remain.

C: 10 or less specimens remain.

<Evaluation of the Abraded Amount of the Surface Layer>

After the completion of the test for measuring an initial film thickness of a photoreceptor and the image forming test, the film thickness is determined by using an eddy current meter (Fisherscope MMS; trade name) to evaluate the abraded amount.

Comparative Example 1

Except that bisphenol Z polycarbonate resin (PC(Z)) is not added in the surface layer, a photoreceptor is prepared in substantially the same manner as that in Example 1. For this case, $I_A/I_C$ corresponds to an infinite.

The resulting film has partial crystallization, and therefore a homogeneous layer is not formed. The evaluation results are shown in Table 4 and Table 5.

Comparative Example 2 & 3

In the preparation of the surface layer, except that AIBN (trade name, manufactured by Wako Pure Chemicals Industries, Ltd., molecular weight 164.2) or V-601 (trade name, manufactured by Wako Pure Chemicals Industries, Ltd., molecular weight 230.3) is used as a polymerization initiator in an amount of 2 parts by weight instead of OTazo-15 (trade name, manufactured by Otsuka Chemical Co., Ltd., molecular weight 354.4) in Example 1, each of photoreceptors is individually prepared and evaluated in substantially the same manner as that in Example 1. The evaluation results are shown in Table 4 and Table 5.

Example 2

In the preparation of the surface layer, except that VE-73 (trade name, manufactured by Wako Pure Chemicals Industries, Ltd., molecular weight 310.4) is used as the polymerization initiator in an amount of 2 parts by weight instead of OTazo-15 (trade name, manufactured by Otsuka Chemical Co., Ltd., molecular weight 354.4) in Example 1, a photoreceptor is prepared and evaluated in substantially the same manner as that in Example 1. The evaluation results are shown in Table 4 and Table 5.

Examples 3 to 14

In the preparation of the surface layer, except the charge transporting materials (a) and (b), the polycarbonate resin and the polymerization initiator in Example 1 are changed as listed in Table 1, each of photoreceptors is individually prepared and evaluated in substantially the same manner as that in Example 1. The evaluation results are shown in Table 4 and Table 5.

Examples 15 and 16

In the preparation of the surface layer, except that AIBN (trade name, manufactured by Wako Pure Chemicals Industries, Ltd., molecular weight 164.2) or V-601 (trade name, manufactured by Wako Pure Chemicals Industries, Ltd., molecular weight 230.3) is used as the polymerization initiator in an amount of 2 parts by weight instead of OTazo-15 (trade name, manufactured by Otsuka Chemical Co., Ltd., molecular weight 354.4) in Example 1, the temperature is raised from the room temperature to 170° C. at a rate of 2° C./min, and the curing temperature is set to 170° C.; photoreceptors are prepared and evaluated in substantially the same manner as that in Example 1. The evaluation results are shown in Table 4 and Table 5.

Example 17

Without forming the charge transporting layer of Example 1, 25 parts by weight of N,N'-diphenyl-N,N'-bis(3-methylphenyl)-[1,1']-biphenyl-4,4'-diamine, 25 parts by weight of bisphenol Z polycarbonate resin (viscosity average molecular weight: 30,000), 60 parts by weight of Compound A-17 and 2 parts by weight of OTazo-15 (trade name, manufactured by Otsuka Chemical Co., Ltd, molecular weight 354.4) are dissolved in 200 parts by weight of monochlorobenzene, and the mixture is coated on the top of the charge generating layer by immersion coating. After air-drying at the room temperature for 30 min, it is subjected to heating treatment at 150° C. for 1 hr after the temperature is raised from the room temperature to 150° C. at a rate of 10° C./min under nitrogen stream containing oxygen in a concentration of 200 ppm for curing. As a result, with the formation of the surface layer having a film thickness of about 25 μm, a photoreceptor is prepared. The evaluation results are shown in Table 4 and Table 5.

Example 18 to Example 22

In the preparation of the surface layer, except that the temperature is raised from the room temperature to 150° C. at a rate of 1° C./min and the heating treatment is carried out at 150° C. for 1 hr, each of photoreceptors is individually prepared and evaluated in substantially the same manner as each of those in Example 1 to Example 5, respectively. The evaluation results are shown in Table 4 and Table 5.

Example 23 to Example 27

In the preparation of the surface layer, except that the temperature is raised from the room temperature to 165° C. at a rate of 1° C./min and the heating treatment is carried out at 165° C. for 1 hr, each of photoreceptors is individually prepared and evaluated in substantially the same manner as each of those in Examples 1 to 5, respectively. The evaluation results are shown in Table 4 and Table 5.

Example 28 and Example 29

In the preparation of the surface layer, except that the charge transporting materials (a) and (b), the polycarbonate resin, and the polymerization initiator in Example 23 are changed as listed in Table 2, each of photoreceptors is individually prepared and evaluated in substantially the same manner as that in Example 23. The evaluation results are shown in Table 4 and Table 5.

Comparative Examples 4 and 5

In the preparation of the surface layer, except that the oxygen concentration during polymerization in Example 1 is changed to 700 ppm or 1000 ppm, each of photoreceptors is individually prepared and evaluated in substantially the same manner as that in Example 1. The evaluation results are shown in Table 4 and Table 5.

Comparative Examples 6 and 7

In the preparation of the surface layer, except that the charge transporting materials (a) and (b), the polycarbonate resin and the polymerization initiator in Example 1 are changed as listed in Table 3, each of photoreceptor is individually prepared and evaluated in substantially the same manner as that in Example 1. The evaluation results are shown in Table 4 and Table 5. Partial crystallization is observed.

Comparative Example 8

In the preparation of the surface layer, except that the charge transporting material (a) in Example 1 is changed as listed in Table 3, a photoreceptor is prepared and evaluated in substantially the same manner as that in Example 1. The evaluation results are described in Table 4 and Table 5.

Comparative Example 9

Regarding the fabrication of the surface layer, except that the charge transporting material (a) was changed as described in Table 3, the photoreceptor was prepared and evaluated in the same manner as Example 23. The evaluation results are described in Table 4 and Table 5.

TABLE 1

| | Reactive charge transporting compound (a) | | Non reactive charge transporting compound (b) | | Polycarbonate resin | | Polymerization initiator | | | Absorption peak | Width |
|---|---|---|---|---|---|---|---|---|---|---|---|
| | Kind | Amount (parts by weight) | Kind | Amount (parts by weight) | Kind | Amount (parts by weight) | Kind | Amount (parts by weight) | Mw | intensity ratio $I_A/I_C$ | at half maximum of $I_A$ ($cm^{-1}$) |
| Example1 | A-17 | 60 | TPD | 20 | PC(Z) | 20 | Otazo-15 | 2 | 354.4 | 1.35 | 25 |
| Example2 | A-17 | 60 | TPD | 20 | PC(Z) | 20 | VE-73 | 2 | 310.4 | 1.50 | 25 |
| Example3 | A-19 | 60 | — | — | PC(Z) | 20 | VE-73 | 2 | 310.4 | 1.55 | 26 |
| Example4 | A-17 | 60 | — | — | PC(Z) | 20 | VE-73 | 2 | 310.4 | 1.55 | 25 |
| Example5 | A-17 | 40 | TPD | 20 | PC(Z) | 20 | VE-73 | 2 | 310.4 | 1.10 | 25 |
| | A-40 | 20 | | | | | | | | | |
| Example6 | A-19 | 60 | — | — | PC(Z) | 10 | VE-73 | 2 | 310.4 | 3.55 | 26 |
| Example7 | A-19 | 60 | — | — | PC(Z) | 5 | VE-73 | 2 | 310.4 | 6.95 | 25 |
| Example8 | A-17 | 40 | TPD | 20 | PC(Z) | 5 | VE-73 | 2 | 310.4 | 5.05 | 26 |
| | A-40 | 20 | | | | | | | | | |
| Example9 | A-17 | 10 | TPD | 20 | PC(Z) | 20 | VE-73 | 2 | 310.4 | 0.55 | 26 |
| | A-39 | 20 | | | | | | | | | |
| Example10 | A-17 | 10 | TPD | 20 | PC(Z) | 20 | VE-73 | 2 | 310.4 | 0.70 | 25 |
| | A-51 | 30 | | | | | | | | | |
| Example11 | A-17 | 10 | TPD | 20 | PC(Z) | 20 | VE-73 | 2 | 310.4 | 0.95 | 25 |
| | A-68 | 30 | | | | | | | | | |
| Example12 | A-17 | 60 | TPD | 20 | PC(Z) | 60 | VE-73 | 2 | 310.4 | 0.60 | 26 |
| Example13 | A-29 | 60 | — | — | PC(Z) | 10 | VE-73 | 2 | 310.4 | 3.50 | 25 |
| Example14 | A-31 | 60 | — | — | PC(Z) | 10 | VE-73 | 2 | 310.4 | 3.10 | 25 |

TABLE 2

| | Reactive charge transporting compound (a) | | Non reactive charge transporting compound (b) | | Polycarbonate resin | | Polymerization initiator | | | Absorption peak | Width |
|---|---|---|---|---|---|---|---|---|---|---|---|
| | Kind | Amount (parts by weight) | Kind | Amount (parts by weight) | Kind | Amount (parts by weight) | Kind | Amount (parts by weight) | Mw | intensity ratio $I_A/I_C$ | at half maximum of $I_A$ ($cm^{-1}$) |
| Example15 | A-16 | 60 | TPD | 20 | PC(Z) | 20 | AIBN | 2 | 164.2 | 1.45 | 26 |
| Example16 | A-16 | 60 | TPD | 25 | PC(Z) | 15 | V-601 | 2 | 230.3 | 1.75 | 26 |
| Example17 | A-17 | 60 | TPD | 25 | PC(Z) | 15 | Otazo-15 | 2 | 354.4 | 1.05 | 25 |
| Example18 | A-17 | 60 | TPD | 20 | PC(Z) | 20 | Otazo-15 | 2 | 354.4 | 1.20 | 26 |
| Example19 | A-17 | 60 | TPD | 20 | PC(Z) | 20 | VE-73 | 2 | 310.4 | 1.30 | 27 |
| Example20 | A-19 | 60 | — | — | PC(Z) | 20 | VE-73 | 2 | 310.4 | 1.35 | 28 |
| Example21 | A-17 | 60 | — | — | PC(Z) | 20 | VE-73 | 2 | 310.4 | 1.45 | 27 |
| Example22 | A-17 | 40 | TPD | 20 | PC(Z) | 20 | VE-73 | 2 | 310.4 | 1.00 | 27 |
| | A-40 | 20 | | | | | | | | | |
| Example23 | A-17 | 60 | TPD | 20 | PC(Z) | 20 | Otazo-15 | 2 | 354.4 | 1.10 | 27 |
| Example24 | A-17 | 60 | TPD | 20 | PC(Z) | 20 | VE-73 | 2 | 310.4 | 1.20 | 28 |
| Example25 | A-19 | 60 | — | — | PC(Z) | 20 | VE-73 | 2 | 310.4 | 1.20 | 29 |
| Example26 | A-17 | 60 | — | — | PC(Z) | 20 | VE-73 | 2 | 310.4 | 1.20 | 28 |
| Example27 | A-17 | 40 | TPD | 20 | PC(Z) | 20 | VE-73 | 2 | 310.4 | 0.90 | 28 |
| | A-40 | 20 | | | | | | | | | |
| Example28 | A-55 | 60 | — | — | PC(Z) | 20 | VE-73 | 2 | 310.4 | 1.40 | 26 |
| Example29 | A-75 | 60 | — | — | PC(Z) | 20 | VE-73 | 2 | 310.4 | 1.45 | 27 |

TABLE 3

| | Reactive charge transporting compound (a) | | Non reactive charge transporting compound (b) | | Polycarbonate resin | | Polymerization initiator | | | Absorption peak | Width |
|---|---|---|---|---|---|---|---|---|---|---|---|
| | Kind | Amount (parts by weight) | Kind | Amount (parts by weight) | Kind | Amount (parts by weight) | Kind | Amount (parts by weight) | Mw | intensity ratio $I_A/I_C$ | at half maximum of $I_A$ ($cm^{-1}$) |
| Comparative Example1 | A-17 | 60 | TPD | 20 | — | — | Otazo-15 | 2 | 354.4 | Infinite | 25 |
| Comparative Example2 | A-17 | 60 | TPD | 20 | PC(Z) | 20 | AIBN | 2 | 164.2 | 1.90 | 22 |

TABLE 3-continued

| | Reactive charge transporting compound (a) | | Non reactive charge transporting compound (b) | | Polycarbonate resin | | Polymerization initiator | | | Absorption peak | Width |
|---|---|---|---|---|---|---|---|---|---|---|---|
| | Kind | Amount (parts by weight) | Kind | Amount (parts by weight) | Kind | Amount (parts by weight) | Kind | Amount (parts by weight) | Mw | intensity ratio $I_A/I_C$ | at half maximum of $I_A$ ($cm^{-1}$) |
| Comparative Example3 | A-17 | 60 | TPD | 20 | PC(Z) | 20 | V-601 | 2 | 230.3 | 1.80 | 23 |
| Comparative Example4 | A-17 | 60 | TPD | 20 | PC(Z) | 20 | Otazo-15 | 2 | 354.4 | 2.30 | 21 |
| Comparative Example5 | A-17 | 60 | TPD | 20 | PC(Z) | 20 | Otazo-15 | 2 | 354.4 | 2.50 | 19 |
| Comparative Example6 | A-17 | 60 | TPD | 30 | PC(Z) | 3 | Otazo-15 | 2 | 354.4 | 12.0 | 25 |
| Comparative Example7 | A-17 | 60 | TPD | 30 | PC(Z) | 2 | Otazo-15 | 2 | 354.4 | 18.5 | 25 |
| Comparative Example8 | A-40 | 60 | TPD | 20 | PC(Z) | 20 | Otazo-15 | 2 | 354.4 | 0.75 | 23 |
| Comparative Example9 | A-40 | 60 | TPD | 20 | PC(Z) | 20 | Otazo-15 | 2 | 354.4 | 0.60 | 25 |

TABLE 4

| | | | Low temperature, Low humidity environment (8° C., 20% RH) | | | | | | | |
|---|---|---|---|---|---|---|---|---|---|---|
| | | Abraded | 10,000th image | | | | 1st image after left stand 24 hrs | | | |
| | Adhesiveness | amount (μm) | Ghost | Fog | Streaks | Image degradation | Ghost | Fog | Streaks | Image degradation |
| Example1 | A | 0.21 | A | A | B | A | A | A | B | A |
| Example2 | A | 0.25 | A | A | B | A | A | A | B | A |
| Example3 | A | 0.28 | A | A | B | A | A | A | B | A |
| Example4 | A | 0.19 | A | A | A | A | A | A | A | A |
| Example5 | A | 0.35 | A | A | A | A | A | A | A | A |
| Example6 | A | 0.21 | A | A | A | A | A | A | A | A |
| Example7 | A | 0.22 | A | A | A | A | A | A | A | A |
| Example8 | A | 0.33 | A | A | A | A | A | A | A | A |
| Example9 | A | 0.45 | A | A | A | A | A | A | A | A |
| Example10 | A | 0.40 | A | A | B | A | A | A | B | A |
| Example11 | A | 0.35 | A | A | A | A | A | A | A | A |
| Example12 | A | 0.30 | A | A | A | A | A | A | A | A |
| Example13 | B | 0.25 | A | A | A | A | A | A | A | A |
| Example14 | A | 0.24 | A | A | A | A | A | A | A | A |
| Example15 | A | 0.23 | A | A | A | A | A | A | A | A |
| Example16 | A | 0.28 | A | A | A | A | A | A | A | A |
| Example17 | A | 0.24 | A | A | A | A | A | A | A | A |
| Example18 | A | 0.18 | A | A | A | A | A | A | A | A |
| Example19 | A | 0.21 | A | A | A | A | A | A | A | A |
| Example20 | B | 0.23 | A | A | A | A | A | A | A | A |
| Example21 | A | 0.17 | A | A | A | A | A | A | A | A |
| Example22 | A | 0.30 | A | A | A | A | A | A | A | A |
| Example23 | A | 0.15 | A | A | A | A | A | A | A | A |
| Example24 | A | 0.19 | A | A | A | A | A | A | A | A |
| Example25 | A | 0.20 | A | A | A | A | A | A | A | A |
| Example26 | A | 0.14 | A | A | A | A | A | A | A | A |
| Example27 | A | 0.24 | A | A | A | A | A | A | A | A |
| Example28 | A | 0.41 | A | A | A | A | A | A | A | A |
| Example29 | A | 0.34 | A | A | A | A | A | A | A | A |
| Comparative Example1 | C | 0.20 | A | A | A | A | A | B | B | A |
| Comparative Example2 | B | 0.63 | A | A | A | A | A | B | B | A |
| Comparative Example3 | B | 0.60 | A | A | A | A | A | B | B | A |
| Comparative Example4 | B | 0.84 | A | A | A | A | A | B | B | A |
| Comparative Example5 | B | 0.75 | A | B | A | A | A | B | B | A |
| Comparative Example6 | B | 0.60 | A | B | C | A | A | B | C | A |
| Comparative Example7 | B | 0.70 | A | B | C | A | A | B | C | A |
| Comparative Example8 | A | 1.20 | A | A | A | A | A | B | C | A |

TABLE 4-continued

| | | | Low temperature, Low humidity environment (8° C., 20% RH) | | | | | | | |
|---|---|---|---|---|---|---|---|---|---|---|
| | | Abraded | 10,000th image | | | | 1st image after left stand 24 hrs | | | |
| | Adhesiveness | amount (μm) | Ghost | Fog | Streaks | Image degradation | Ghost | Fog | Streaks | Image degradation |
| Comparative Example9 | A | 1.05 | A | A | A | A | A | B | C | A |

TABLE 5

| | High temperature, High humidity environment (28° C., 85% RH) | | | | | | | |
|---|---|---|---|---|---|---|---|---|
| | 10,000th image | | | | 1st image after left stand 24 hrs | | | |
| | Ghost | Fog | Streaks | Image degradation | Ghost | Fog | Streaks | Image degradation |
| Example1 | A | A | B | A | A | A | B | A |
| Example2 | A | A | B | A | A | A | B | A |
| Example3 | A | A | B | A | A | B | B | A |
| Example4 | A | A | B | B | A | A | B | A |
| Example5 | A | A | A | B | A | A | A | A |
| Example6 | A | A | A | A | A | A | A | A |
| Example7 | A | A | A | B | A | A | A | A |
| Example8 | A | A | A | B | A | A | A | A |
| Example9 | A | A | A | B | A | A | A | A |
| Example10 | A | A | B | A | A | B | B | A |
| Example11 | A | A | A | A | A | A | A | B |
| Example12 | A | A | A | B | A | A | A | A |
| Example13 | A | B | A | B | A | B | A | A |
| Example14 | A | A | A | B | A | A | A | B |
| Example15 | A | A | A | A | A | A | A | A |
| Example16 | A | A | A | A | A | A | A | A |
| Example17 | A | A | A | A | A | A | A | A |
| Example18 | A | A | B | A | A | A | B | A |
| Example19 | A | A | B | A | A | A | B | A |
| Example20 | A | A | B | A | A | B | B | A |
| Example21 | A | A | B | B | A | A | B | A |
| Example22 | A | A | A | B | A | A | A | A |
| Example23 | A | A | B | A | A | A | B | B |
| Example24 | A | A | B | A | A | A | B | A |
| Example25 | A | A | B | A | A | B | B | A |
| Example26 | A | A | B | B | A | A | B | B |
| Example27 | A | A | A | B | A | A | A | A |
| Example28 | A | A | A | B | A | A | A | A |
| Example29 | A | A | A | B | A | A | A | A |
| Comparative Example1 | A | B | C | A | A | B | C | B |
| Comparative Example2 | A | B | C | A | A | B | C | B |
| Comparative Example3 | A | B | C | A | A | B | C | B |
| Comparative Example4 | A | B | C | A | A | B | C | A |
| Comparative Example5 | A | B | B | C | A | B | B | C |
| Comparative Example6 | A | B | B | C | A | B | B | C |
| Comparative Example7 | A | B | B | C | A | B | B | C |
| Comparative Example8 | A | B | C | A | A | B | C | B |
| Comparative Example9 | A | B | C | A | A | B | C | B |

As shown in Tables 4 and 5, in Examples 1 to 29 in each of which the outermost layer is a cured film of a composition containing the charge transporting compound (a) having a charge transporting skeleton and at least two structures represented by R—O—CO—CR'═CH—R" in the same molecule and at least one kind of the polycarbonate resin, and in an IR absorption spectrum of the outermost layer, the $I_A/I_C$ is from 0.5 or about 0.5 to 10 or about 10, and the width at half maximum of the $I_A$ absorption peak is within the range of 25 $cm^{-1}$ or about 25 $cm^{-1}$ or more; even when the type of the reactive charge transporting material (a), the addition amount of the polycarbonate resin, the type and addition amount of the polymerization initiator, and the polymerization condition are changed; it was found that deterioration in image quality after repetitive use is suppressed compared with Comparative examples 1 to 9.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a photosensitive layer on a conductive substrate, an outermost layer of the electrophotographic photoreceptor including:

a cured film of a composition which comprises at least one charge transporting compound (a) having a charge transporting skeleton and at least two structural units represented by R—O—CO—CR'═CH—R" in the same molecule, and at least one polycarbonate resin;

wherein a ratio ($I_A/I_C$) of an absorption peak intensity ($I_A$) resulting from stretching vibration of a carbonyl group originating from the structural unit represented by R—O—CO—CR'═CH—R" of the charge transporting compound (a) to an absorption peak intensity ($I_C$) resulting from stretching vibration of a carbonyl group originating from the polycarbonate resin in an IR absorption spectrum of the outermost layer is from about 0.5 to about 10, and a width at half maximum of the absorption peak of the absorption peak intensity ($I_A$) is about 25 $cm^{-1}$ or more, wherein either R or R' is bonded to the charge transporting skeleton; wherein, in a case in which R is bonded to the charge transporting skeleton, R represents a single bond or a divalent linking group which may have a substituent group, and R' represents a hydrogen atom or an alkyl group which may have a substituent group; wherein, in a case in which R' is bonded to the charge transporting skeleton, R' represents a divalent linking group which may have a substituent group, and R represents a hydrogen atom or an alkyl group which may have a substituent group; R" represents a hydrogen atom or an alkyl group which may have a substituent group; wherein the divalent linking group represented by R or R' is selected from the group consisting of an alkylene group, an arylene group, —O—, —COO—, —CO— and a combination thereof; and wherein the substituent group is selected from the group consisting of an alkyl group, an alkoxy group, an ester group, and an acyl group.

2. The electrophotographic photoreceptor according to claim 1, wherein the outermost layer of the electrophotographic photoreceptor comprises a cured film of a composition excluding a compound (c) without the charge transporting skeleton and having the at least two structural units represented by R—O—CO—CR'═CH—R".

3. The electrophotographic photoreceptor according to claim 1, wherein the charge transporting compound (a) comprises three or more of the structural units represented by R—O—CO—CR'═CH—R" in the same molecule.

4. The electrophotographic photoreceptor according to claim 1, wherein the charge transporting compound (a) comprises four or more of the structural units represented by R—O—CO—CR'═CH—R" in the same molecule.

5. The electrophotographic photoreceptor according to claim 1, wherein the outermost layer of the electrophotographic photoreceptor comprises a cured film of a composition further comprising a compound (b) having the charge transporting skeleton and having no radical-polymerizable unsaturated double bond.

6. The electrophotographic photoreceptor according to claim 1, wherein the composition further comprises another charge transporting compound having the charge transporting skeleton and only one of the structural unit represented by R—O—CO—CR'═CH—R" in the same molecule.

7. The electrophotographic photoreceptor according to claim 1, wherein the charge transporting skeleton is derived from a nitrogen-containing compound selected from the group consisting of a triarylamine-based compound, a benzidine-based compound and a hydrazone-based compound.

8. The electrophotographic photoreceptor according to claim 1, wherein the charge transporting compound (a) comprises a skeleton derived from a triphenylamine and four or more methacryloyl groups in the same molecule.

9. The electrophotographic photoreceptor according to claim 1, wherein the charge transporting compound (a) is represented by the following Formula (A):

Formula (A)

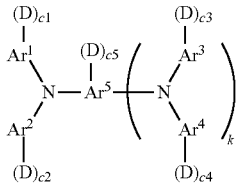

wherein, in the formula (A), $Ar^1$, $Ar^2$, $Ar^3$, and $Ar^4$ each independently represent a substituted or unsubstituted aryl group; $Ar^5$ represents a substituted or unsubstituted aryl group or a substituted or unsubstituted arylene group; D represents a group having the structural unit represented by R—O—CO—CR'═CH—R" in a terminal of the group; c1, c2, c3, c4, c5 each independently represent an integer of 0, 1 or 2; k represents an integer of 0 or 1; and the total number of D is 2 or more.

10. An image forming apparatus comprising:

the electrophotographic photoreceptor according to claim 1;

a charging unit that charges a surface of the electrophotographic photoreceptor;

an exposing unit that forms an electrostatic latent image at the surface of the charged electrophotographic photoreceptor by exposure to light;

a developing unit that develops the electrostatic latent image formed at the electrophotographic photoreceptor by a developer to form a toner image; and a transfer unit that transfers the toner image to a transfer-receiving medium.

11. A process cartridge which comprises the electrophotographic photoreceptor according to claim 1, and is attachable to and detachable from an image forming apparatus.

* * * * *